US008373625B2

(12) United States Patent
Kimura

(10) Patent No.: US 8,373,625 B2
(45) Date of Patent: Feb. 12, 2013

(54) DISPLAY DEVICE AND METHOD OF DRIVING THEREOF

(75) Inventor: Hajime Kimura, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 925 days.

(21) Appl. No.: 11/974,163

(22) Filed: Oct. 10, 2007

(65) Prior Publication Data

US 2008/0117132 A1 May 22, 2008

Related U.S. Application Data

(63) Continuation of application No. 10/208,554, filed on Jul. 30, 2002, now Pat. No. 7,283,111.

(30) Foreign Application Priority Data

Aug. 3, 2001 (JP) ..... 2001-236592
Jul. 10, 2002 (JP) ..... 2002-200854

(51) Int. Cl.
*G09G 3/30* (2006.01)

(52) U.S. Cl. ..... 345/77; 345/691; 345/82; 345/204

(58) Field of Classification Search ..... 345/55, 345/60, 63, 72, 87–89, 690–693, 76–83, 345/204; 315/169.3
See application file for complete search history.

(56) References Cited

U.S. PATENT DOCUMENTS 4,070,663 A 1/1978 Kanatani et al.
4,773,738 A 9/1988 Hayakawa et al.
5,091,722 A 2/1992 Kitajima et al.
5,200,846 A 4/1993 Hiroki et al.
5,225,823 A 7/1993 Kanaly
5,302,966 A 4/1994 Stewart
(Continued)

FOREIGN PATENT DOCUMENTS

EP 0 831 449 A2 3/1998
EP 0 838 799 A1 4/1998
(Continued)

OTHER PUBLICATIONS

Inukai K. et al. "4.0-in. TFT-OLED Displays and a Novel Digital Driving Method," SID 00 Digest, 2000, pp. 924-927.
(Continued)

*Primary Examiner* — Lun-Yi Lao
*Assistant Examiner* — Tom Sheng
(74) *Attorney, Agent, or Firm* — Husch Blackwell LLP

(57) ABSTRACT

False contouring during display by time division gray scales can be prevented with high efficiency. The order of appearance of subframe periods, and the times at which the subframe periods begin, are changed between pixels driven by odd number gate signal lines and pixels driven by even number gate signal lines. For example, assume that display is performed in a display period $T_{r1}$ of a subframe period $SF_1$, a display period $T_{r2}$ of a subframe period $SF_2$, and a display period $T_{r3}$ of a subframe period $SF_3$. The order of appearance of the display periods is changed between pixels driven by the odd number gate signal lines (B1) and pixels driven by the even number gate signal lines (B2). Although the non-light emitting display periods (display periods $T_{r3}$, $T_{r2}$, and $T_{r1}$) are continuous over nearly one frame period in the odd number lines of pixels when there is a gray scale change, non-light emission and light emission are repeated alternately at the same time for the even number lines of pixels. Accordingly, the brightness of the above light emission is averaged by human eyes, and therefore the generation of unnatural dark lines (false contouring) can be suppressed.

40 Claims, 18 Drawing Sheets

U.S. PATENT DOCUMENTS

| | | | | | |
|---|---|---|---|---|---|
| 5,349,366 | A | | 9/1994 | Yamazaki et al. | |
| 5,414,442 | A | | 5/1995 | Yamazaki et al. | |
| 5,424,752 | A | | 6/1995 | Yamazaki et al. | |
| 5,471,225 | A | | 11/1995 | Parks | |
| 5,475,448 | A | * | 12/1995 | Saegusa | 348/797 |
| 5,479,283 | A | | 12/1995 | Kaneko et al. | |
| 5,583,534 | A | | 12/1996 | Katakura et al. | |
| 5,600,169 | A | | 2/1997 | Burgener et al. | |
| 5,642,129 | A | | 6/1997 | Zavracky et al. | |
| 5,652,600 | A | | 7/1997 | Khormaei et al. | |
| 5,712,652 | A | | 1/1998 | Sato et al. | |
| 5,748,160 | A | * | 5/1998 | Shieh et al. | 345/82 |
| 5,767,828 | A | | 6/1998 | McKnight | |
| 5,798,746 | A | | 8/1998 | Koyama | |
| 5,940,142 | A | * | 8/1999 | Wakitani et al. | 348/671 |
| 5,969,710 | A | | 10/1999 | Doherty et al. | |
| 5,986,640 | A | | 11/1999 | Baldwin et al. | |
| 5,990,629 | A | | 11/1999 | Yamada et al. | |
| 6,034,659 | A | | 3/2000 | Wald et al. | |
| 6,040,812 | A | | 3/2000 | Lewis | |
| 6,040,819 | A | | 3/2000 | Someya | |
| 6,091,203 | A | | 7/2000 | Kawashima et al. | |
| 6,147,792 | A | | 11/2000 | Jones et al. | |
| 6,157,356 | A | | 12/2000 | Troutman | |
| 6,215,466 | B1 | | 4/2001 | Yamazaki et al. | |
| 6,222,512 | B1 | | 4/2001 | Tajima et al. | |
| 6,229,506 | B1 | | 5/2001 | Dawson et al. | |
| 6,229,508 | B1 | | 5/2001 | Kane | |
| 6,249,265 | B1 | | 6/2001 | Tajima et al. | |
| 6,278,423 | B1 | | 8/2001 | Wald et al. | |
| 6,373,454 | B1 | | 4/2002 | Knapp et al. | |
| 6,417,864 | B1 | | 7/2002 | Jones et al. | |
| 6,424,325 | B1 | * | 7/2002 | Van Dijk | 345/60 |
| 6,452,341 | B1 | | 9/2002 | Yamauchi et al. | |
| 6,501,227 | B1 | | 12/2002 | Koyama | |
| 6,518,977 | B1 | | 2/2003 | Naka et al. | |
| 6,542,138 | B1 | | 4/2003 | Shannon et al. | |
| 6,563,480 | B1 | | 5/2003 | Nakamura | |
| 6,563,483 | B1 | | 5/2003 | Sakumoto | |
| 6,583,775 | B1 | | 6/2003 | Sekiya et al. | |
| 6,633,270 | B2 | * | 10/2003 | Hashimoto | 345/76 |
| 6,636,187 | B2 | | 10/2003 | Tajima et al. | |
| 6,700,330 | B2 | | 3/2004 | Koyama | |
| 6,727,871 | B1 | | 4/2004 | Suzuki et al. | |
| 6,753,854 | B1 | | 6/2004 | Koyama et al. | |
| 6,774,578 | B2 | | 8/2004 | Tanada | |
| 6,778,152 | B1 | * | 8/2004 | Huang | 345/60 |
| 6,876,145 | B1 | | 4/2005 | Yamazaki et al. | |
| 2002/0047852 | A1 | | 4/2002 | Inukai et al. | |
| 2003/0057423 | A1 | | 3/2003 | Shimoda et al. | |
| 2003/0058195 | A1 | | 3/2003 | Adachi et al. | |

FOREIGN PATENT DOCUMENTS

| | | | |
|---|---|---|---|
| EP | 0 945 844 | A2 | 9/1999 |
| EP | 0 953 956 | A1 | 11/1999 |
| EP | 0 953 957 | A1 | 11/1999 |
| EP | 11-352942 | | 12/1999 |
| EP | 1 035 535 | A1 | 9/2000 |
| EP | 1 087 366 | A2 | 3/2001 |
| EP | 1 184 833 | A2 | 3/2002 |
| EP | 1 187 087 | A1 | 3/2002 |
| EP | 1 713 054 | A2 | 10/2006 |
| JP | 4-291392 | | 10/1992 |
| JP | 7-140922 | | 6/1995 |
| JP | 7-175439 | | 7/1995 |
| JP | 7-261700 | | 10/1995 |
| JP | 8-54852 | | 2/1996 |
| JP | 8-63121 | | 3/1996 |
| JP | 9-34399 | | 2/1997 |
| JP | 9-97035 | | 4/1997 |
| JP | 9-172589 | | 6/1997 |
| JP | 9-330054 | | 12/1997 |
| JP | 10-97217 | | 4/1998 |
| JP | 10-171401 | | 6/1998 |
| JP | 10-333641 | | 12/1998 |
| JP | 11-24625 | | 1/1999 |
| JP | 11-45070 | | 2/1999 |
| JP | 11-282398 | | 10/1999 |
| JP | 11-296131 | | 10/1999 |
| JP | 11-352941 | | 12/1999 |
| JP | 2000-112426 | | 4/2000 |
| JP | 2000-231359 | | 8/2000 |
| JP | 2000-258750 | | 9/2000 |
| JP | 2000-267617 | | 9/2000 |
| JP | 2001-142427 | | 5/2001 |
| JP | 2001-159878 | | 6/2001 |
| JP | 2001-166730 | | 6/2001 |
| WO | WO 98/33165 | A1 | 7/1998 |
| WO | WO 99/60557 | A1 | 11/1999 |
| WO | WO 99/65012 | A2 | 12/1999 |
| WO | WO 01/52229 | A1 | 7/2001 |

OTHER PUBLICATIONS

Office Action re Chinese Patent Application No. CN 02128217.X, dated May 12, 2006 (in English).

Komaki, T. et al, "Employment of New Drive Method for Improving Image Quality of PDP to Contrast Ratio of 560:1," Nikkei Electronics, No. 753, Oct. 4, 1999, pp. 153-162 (with full English translation pp. 1-10).

Masuda, T. et al, "New Category Contour Noise Observed in Pulse-Width-Modulated Moving Images," ITEJ Technical Report, vol. 19, No. 2, pp. 61-66 (with English abstract).

* cited by examiner 9008
9006
9002
9007
9006
9003
9006
9001
9004
9005
9009

9203
9202
9204
9205
9201

9306
9302
9303
9301
9305
9304

9602
9601
9603
9604

9701
9703
9704
9705
9702

9804
9803
9802
9801

9403
9401
9405
9406
9402
9404

DISPLAY DEVICE AND METHOD OF DRIVING THEREOF

This application is a continuation of U.S. application Ser. No. 10/208,554, filed on Jul. 30, 2002 now U.S. Pat. No. 7,283,111.

BACKGROUND OF THE INVENTION

1. Field of the Invention

The present invention relates to a display device and to a method of driving the display device. Specifically, the present invention relates to a display device in which frame periods are structured by a plurality of subframe periods, the display device having a method of controlling the brightness of light emission by using the subframe periods as one of methods of controlling gray scales. The present invention also relates to a method of driving the display device.

2. Description of the Related Art

Along with the arrival of computerized industrial society, the demand for thin, flat-panel displays has increased recently, and the development of display devices using organic light emitting elements (hereinafter referred to as organic light emitting displays) has flourished. Organic light emitting displays are of self light emitting type, and a back light is unnecessary. Therefore, they are easier to be made thin compared with liquid crystal display devices. It is expected that they will be used in mobile telephones, personal digital assistants (EDAs), and the like.

Organic light emitting elements, also referred to as organic light emitting diodes (OLEDs), are light emitting elements. Organic light emitting elements each have a structure in which an organic compound layer is sandwiched between a cathode layer and an anode layer, and light emission is performed at a brightness corresponding to the amount of electric current flowing in the organic compound layer.

There is a method for displaying gray scales on an active matrix organic light emitting display referred to as an analog gray scale method. However, for cases of controlling gray scales by analog gray scale drive the amount of drain current changes greatly due to dispersion in the electric field effect mobility of driver TFTs formed as connected to organic light emitting elements, making the display of an image having uniform brightness difficult.

Drive by digital gray scales has thus been proposed as a means of achieving display having a uniform brightness. The term "digital gray scales" refers to a method of controlling gray scales by combining periods of light emission from organic light emitting elements with periods of no light emission.

A method referred to time gray scale drive exists as one of methods of driving by digital gray scales. The term "time division gray scales" refers to a method of performing gray scale display by dividing one frame period into a plurality of subframe periods, and controlling the emission of light or the non-emission of light by organic light emitting elements during each of the subframe periods.

However, it is known that false contours are generated, and image quality deteriorates, for cases of performing display by time gray scales. False contouring is a phenomenon in which unnatural light and dark lines be seen as mixed in an image when displaying half tones. (Nikkei Electronics, No. 753, pp. 152-62, October 1999; and "Pseudo Contouring Noise Seen in Pulse Width Fluctuation Dynamic Display," TV Society Technical Bulletin, Vol. 19, No. 2, IDY9521, pp. 61-66.)

A method of separating and dividing the subframes of the longer time and higher order bits, for example, has been proposed as a method of preventing false contouring (JP 09-34399 A, JP 09-172589 A).

As stated above, problems develop with conventional time gray scale drive in that display disturbances due to false contours are generated, and display performance drops.

In order to control display disturbances caused by false contours with a conventional driving method, the subframe periods are separated and divided, for example, as discussed in JP 09-34399 A and JP 09-172589 A. However, if the false contours are prevented by the method of separating and dividing the subframe periods, a problem develops in that the electric power consumption increases.

That is, if the number of subframe period divisions increases, then the number of times that signals are input during one frame period increases. If the number of signal inputs increases, then the number of times that the electric charge is charged or discharged for giving the signals a desired electric potential also increases, and therefore the electric power consumption increases. In addition, if the number of divisions of the subframe period increases, then it is necessary to drive a driver circuit at a high frequency in order to fit the divided subframe periods into one frame period. The driving voltage becomes higher with high frequency drive, and therefore the electric power consumption, determined in proportion to the product of the driver frequency and the square of the driving voltage, increases.

In addition, there are cases with which it is not possible to apply the above method of dividing the higher order bit subframe periods with a driver circuit having low driver performance. This is because, even if an increase in the number of divisions of the subframe periods is attempted in order to reduce false contouring, there are cases in which the divided subframe periods cannot be fit within one frame period with the low driver performance driver circuit, and a limit on the number of divisions of the subframe period thus develops.

SUMMARY OF THE INVENTION

The present invention has been made in view of the aforementioned problems, and an object of the present invention is to provide a display device that achieves good display performance without an increase in electric power consumption and with big lowering of false contour noise, and in addition, to provide a method of driving the display device.

Further, another object of the present invention is to provide a display device capable of reducing display disturbances due to false contours without depending upon the driver performance of a driver circuit, and to provide a method of driving the display device.

Causes leading to the generation of display disturbance problems due to false contours are considered below. It has been found that the cause of false contours is that portions in which light emission or non-light emission are continuous, exist over a wide range capable of being recognized by the resolution of human eyes.

In particular, display disturbances due to false contouring appear prominently during display of dynamic images, and therefore an explanation is first made regarding the causes of display disturbances due to false contouring for cases of performing dynamic image display, with reference to FIGS. 19A to 19C.

FIG. 19A shows a display image of a pixel portion in which m columns×n rows of pixels are arranged in a matrix shape. A 3-bit of the digital video signal capable of displaying gray scales 1 to 8 is input to each of the pixels, and an image is displayed. Pixels in the upper half of the pixel portion perform display of the number 3 gray scale, and pixels in the bottom half perform display of the number 4 gray scale.

When a dynamic image is displayed, it is assumed that a boundary between a portion displaying the number 3 gray scale and a portion displaying the number 4 gray scale moves in the direction of the solid line arrow in FIG. 19A, and the surface area of the portion displaying the number 4 gray scale increases. That is, the pixels in the vicinity of the boundary switch over from displaying the number 3 gray scale to displaying the number 4 gray scale.

Pixel display of the portion in which the gray scale changes is explained while referring to FIG. 19B. FIG. 19B shows a timing chart for light emission and non-light emission of pixels in which the gray scale changes from the number 3 gray scale to the number 4 gray scale when displaying a dynamic image. The horizontal axis shows the passage of time. Changes in the pixel display (light emission, non-light emission) when moving in time from a frame period $F_1$ to a frame period $F_2$ are shown. In display periods $T_{r1}$ to $T_{r3}$, the display periods during which the pixels emit light are shown in white, and the display periods during which the pixels do not emit light are shown with lines slanting downward to the right.

Note that one frame period is structure by number 1 bit to number 3 bit subframe periods, and the display periods of the respective subframe periods have different time lengths. The number 1 bit subframe period has the first bit display period $T_{r1}$, the number 2 bit subframe period has the second bit display period $T_{r2}$, and the number 3 bit subframe period has the third bit display period $T_{r3}$. The ratio between lengths of time of the display periods is $T_{r1}:T_{r2}:T_{r3}=2^0:2^1:2^2$, and the pixel gray scales are determined by calculating the length of time of the display periods during which the pixels emit light in the frame periods ($F_1$ and $F_2$).

For example, the pixels are in a state of emitting light during the number 1 bit display period $T_{r1}$ and the number 2 bit display period $T_{r2}$, and are not in a state of emitting light during the number 3 bit display period $T_{r3}$, when performing display of the number 3 gray scale.

For cases of displaying the number 4 gray scale, the pixels are in a non-light emitting state during the number 1 bit display period $T_{r1}$ and the number 2 bit display period $T_{r2}$, and in a light emitting state during the number 3 bit display period $T_{r3}$.

The pixels displaying the number 3 gray scale in the frame period $F_1$ here display the number 4 gray scale during the frame period $F_2$. When switch over between the gray scales occurs, the pixels in the vicinity of the boundary continue to be in a non-light emitting state over the number 3 bit display period $T_{r3}$ of the frame period $F_1$, and the number 1 bit display period $T_{r1}$ and the number 2 bit display period $T_{r2}$ of the frame period $F_2$. In other words, the non-emitting state for displaying the number 4 gray scale begins immediately after the non-light emitting state for displaying the number 3 gray scale, and the non-light emitting state is continuous over one frame period of time.

That is, the non-light emitting state for displaying the number 4 gray scale begins immediately after the non-light emitting state for displaying the number 3 gray scale with the pixels near the boundary. These pixels can therefore be seen by human eyes to have no light emission for one frame period. This is perceived as an unnatural dark line on a screen.

Further, the boundary between the portion performing display of the number 3 gray scale and the portion performing display of the number 4 gray scale moves in the direction of the dotted line arrow in FIG. 19A, and the surface area of the portion displaying the number 3 gray scale increases. That is, the pixels in the vicinity of the boundary switch over from displaying the number 4 gray scale to displaying the number 3 gray scale.

The pixel display of portions in which the gray scale changes is explained while referring to FIG. 19C. FIG. 19C shows a timing chart for light emission and non-light emission of pixels in which the gray scale changes from the number 4 gray scale to the number 3 gray scale when displaying a dynamic image. In the display periods $T_{r1}$ to $T_{r3}$, those during which the pixels emit light are shown in white, while the display periods during which the pixels do not emit light are shown with lines slanting downward to the right.

The pixels displaying the number 4 gray scale in the frame period $F_1$ here display the number 3 gray scale during the frame period $F_2$. When switch over between the gray scales occurs, the pixels in the vicinity of the boundary continue to be in a light emitting state over the number 3 bit display period $T_{r3}$ of the frame period $F_1$, and the number 1 bit display period $T_{r1}$ and the number 2 bit display period $T_{r2}$ of the frame period $F_2$. In other words, the light emitting state for displaying the number 3 gray scale begins immediately after the light emitting state for displaying the number 4 gray scale, and the light emitting state is continuous over one frame period of time.

That is, the light emitting state for displaying the number 3 gray scale begins immediately after the light emitting state for displaying the number 4 gray scale with the pixels near the boundary. These pixels can therefore be seen by human eyes to have light emission for one frame period. This is perceived as an unnatural light line on the screen.

False contouring is a phenomenon in which unnatural light lines and dark lines develop and are seen in boundary portions where the gray scale changes.

Display disturbances due to false contouring can be seen also in static images. The false contours that develop in static images are a phenomenon in which unnatural light lines and dark lines are perceived when one's line of sight moves along boundary portions where the gray scale changes. The principle for that this type of display disturbance can be seen in a static image is explained with reference to FIGS. 20A and 20B.

There is a minute amount of movement of human eyes even if one intends to look at one point, and it is difficult to stare accurately at a fixed point. Therefore, even if one intends to stare at the boundary between the portions displaying the number 3 gray scale and the portions displaying the number 4 gray scale in a pixel portion, there will in practice be a minute amount of movement of one's eyes, left and right, and up and down.

For example, display of a pixel portion shown in FIG. 20A in which m columns×n rows of pixels are arranged in a matrix state is explained here as an example. Pixels of the upper half of the pixel portion perform display of the number 3 gray scale, and pixels of the lower half perform display of the number 4 gray scale. As shown by the solid line arrow, in this pixel portion the line of sight moves from the portion displaying the number 3 gray scale to the portion displaying the number 4 gray scale. For a case in which the pixels are in a light emitting state when the line of sight is located on the portion displaying the number 3 gray scale, and the pixels are in a light emitting state when the line of sight is located on the portion displaying the number 4 gray scale, human eyes perceive a state in which the pixels emit light constantly over one frame period.

Line B of FIG. 20B shows the pixel light emission in the portion that displays the number 3 gray scale, and line C of FIG. 20B shows the pixel light emission in the portion that displays the number 4 gray scale. This state is now explained.

Lines B and C of FIG. 20B show a timing chart for light emission and non-light emission of the pixels in which the gray scale changes from the number 4 gray scale to the number 3 gray scale when displaying a static image. The horizontal axis shows the passage of time. Changes in the pixel display (light emission, non-light emission) when moving in time from the frame period $F_1$ to the frame period $F_2$ are shown. Among the display periods $T_{r1}$ to $T_{r3}$, the display periods during which the pixels emit light are shown in white, and the display periods during which the pixels do not emit light are shown with lines slanting downward to the right. In practice, there is a slight deviation between the time at which a frame period F begins in the pixels displaying the number 3 gray scale and the time that the frame period F begins in the pixels displaying the number 4 gray scale, but the explanation is put forth assuming that the slight deviation in time can be ignored because the pixels are located adjacent to each other.

Human eyes move as shown by the solid line arrows of FIG. 20B, and therefore there is recognition, in the portion displaying the number 3 gray scale, of light emission for the number 1 bit display period $T_{r1}$ and the number 2 bit display period $T_{r2}$ (line B of FIG. 20B), and there is recognition, in the portion displaying the number 4 gray scale, of light emission during the number 3 bit display period $T_{r3}$ (line C of FIG. 20B). Human eyes will therefore perceive that the pixels are continuously in a light emitting state throughout one frame period.

Conversely, the line of sight moves from the portion displaying the number 4 gray scale to the portion displaying the number 3 gray scale as shown by the dotted line arrow in the pixel portion display shown in FIG. 20A. For a case in which the pixels are in a non-light emitting state when the line of sight is located on the portion displaying the number 4 gray scale, and the pixels are in a non-light emitting state when the line of sight is located on the portion displaying the number 3 gray scale, human eyes perceive a state in which the pixels continuously do not emit light over one frame period.

Human eyes move as shown by the dotted line arrows of FIG. 20B, and therefore there is recognition, in the portion displaying the number 4 gray scale, of no light emission for the number 1 bit display period $T_{r1}$ and the number 2 bit display period $T_{r2}$, (line C of FIG. 20B), and there is recognition, in the portion displaying the number 3 gray scale, of no light emission during the number 3 bit display period $T_{r3}$ (line B of FIG. 20B). Human eyes will therefore perceive that the pixels are continuously in a non-light emitting state throughout one frame period.

The pixels can thus be seen to be in a light emitting state, or in a non-light emitting state, continuously over one frame period by human eyes because the line of sight moves slightly left and right, and up and down. Dark lines or light lines are therefore perceived to develop in the boundary portions where the gray scale changes.

Image disturbances due to false contouring thus develop at the boundary portions where the gray scale changes with the time division gray scale drive, regardless of whether a dynamic image or a static image is displayed. Thus, the display quality is lost.

In order to achieve the aforementioned objects, according to the present invention, there is provided a display device in which display disturbances due to false contouring are prevented, and a method of driving the display device, as discussed below. The present invention employs a technique of reducing the surface area of portions that continuously emit light or continuously do not emit light, such that human eyes do not perceive false contours. Specifically, in the present invention, the order in which the subframe periods appear, the time at which the subframe periods begin, or both are changed, per line of pixels such that light emission and non-light emission occurs randomly in each pixel.

Note that a pixel line address is the same as a gate signal line address of the pixel. For example, pixels of a number 1 gate signal line correspond to pixels disposed in a number 1 line.

The number of subframe periods into which one frame period is capable of being divided remains the same as the conventional number, even if the order of appearance of the subframe periods or the time at which the subframe periods begin is changed False contouring noise can therefore be greatly reduced, and good display performance can be achieved without increasing the amount of electric power consumption. Further, display disturbances due to false contours can be reduced without depending on the driver performance of the driver circuit.

The present invention is therefore provided as shown below.

The present invention relates to a method of driving a display device, characterized by comprising dividing frame periods into two or more subframe periods, in which the order of appearance of the subframe periods differs between pixels arranged in a number K line (where K is a natural number) and pixels arranged in a number L line (where L is a natural number, $L \neq K$).

The present invention relates to a method of driving a display device, characterized by comprising dividing frame periods into two or more subframe periods, in which there are n orders of appearance of the subframe periods (where n is an integer equal to or greater than 2); and the order of appearance of the subframe periods is the same for every n gate signal lines.

The present invention relates to a method of driving a display device, characterized by comprising dividing frame periods into two or more subframe periods, in which a period for selecting a gate signal line for one line is taken as $\Delta G$; and a time $t_k$ at which a frame period begins for pixels arranged in a number K line, and a time $t_{k+1}$ at which a frame period begins for pixels arranged in a number K+1 line satisfy the equation $t_{k+1} > t_k + \Delta G$.

In the above structure, in the method of driving a display device, it is characterized in that the order of appearance of the subframe periods differs between the pixels arranged in the number K line and the pixels arranged in the number K+1 line.

The present invention relates to a method of driving a display device, characterized by comprising dividing frame periods into two or more subframe periods, in which a period for selecting a gate signal line for one line is taken as $\Delta G$; and a time $t_k$ at which a frame period begins for pixels arranged in a number K line (where K is a natural number), and a time $t_{k+n}$ at which a frame period begins for pixels arranged in a number K+n line (where K+n is an integer equal to or greater than 2) satisfy the equation $t_{k+n} = t_k + \Delta G$.

Further, in the above structure, in the method of driving a display device, it is characterized in that the order of appearance of the subframe periods differs between the pixels arranged in the number K line and the pixels arranged in the number K+n line.

Further, in the above structure, in the method of driving a display device, it is characterized in that the gate signal line is selected by an address decoder of a gate signal side driver circuit.

Further, in the above structure, in the method of driving a display device, it is characterized in that the pixels have light emitting elements.

The present invention relates to a display device in which frame periods are divided into n subframe periods (where n is a natural number equal to or greater than 2), characterized by comprising: pixels; gate signal lines arranged in a column direction; m memory circuits (where m is a natural number, and m>n) for storing the brightness of light emitted from the pixels in each of the n subframe periods; memory circuit specifying means for specifying one of the m memory circuits; line number specifying means for specifying a line number; and a gate signal side driver circuit for selecting the gate signal line of the specified line number.

Further, in the above structure, in the display device, it is characterized in that: the line number specifying means specifies a first line number, and the memory circuit specifying means specifies a first memory circuit; the line number specifying means specifies a second line number, and the memory circuit specifying means specifies a second memory circuit; and a first subframe period begins by the gate signal line of the first line number, and a second subframe period begins by the gate signal line of the second line number. Here, the first line number and the second line number may be consecutive.

In the above structure, in the display device, it is characterized in that: the line number specifying means specifies a first line number, and the memory circuit specifying means specifies a first memory circuit; the line number specifying means specifies a second line number, separated from the first line number by two or greater, and the memory circuit specifying means specifies the first memory circuit; and the subframe period thus begins by the gate signal line of the second line number, separated from the first line number by two or more, followed by the gate signal line of the first line number.

In the above structure, in the display device, it is characterized in that the gate signal side driver circuit has an address decoder.

In any one of the above structures, in the display device, it is characterized in that the pixels have light emitting elements.

BRIEF DESCRIPTION OF THE DRAWINGS

In the accompanying drawings:

FIGS. 1A to 1C2 are diagrams showing an organic light emitting display, and light emission timing of light emitting elements for performing display, respectively (Embodiment Mode 1);

DETAILED DESCRIPTION OF THE PREFERRED EMBODIMENTS

Embodiment Mode 1

Embodiment Mode 1 of the present invention is explained below. Note that the display device of the present invention, and the method of driving the display device of the present invention, are not limited to the example shown below. Embodiment Mode 1 shows the case where the order of appearance of subframe periods differs between the odd number lines of pixels connected to the gate signal line of odd number line and the even number lines of pixels connected to the gate signal line of the even number line.

Figures 1, 1A:
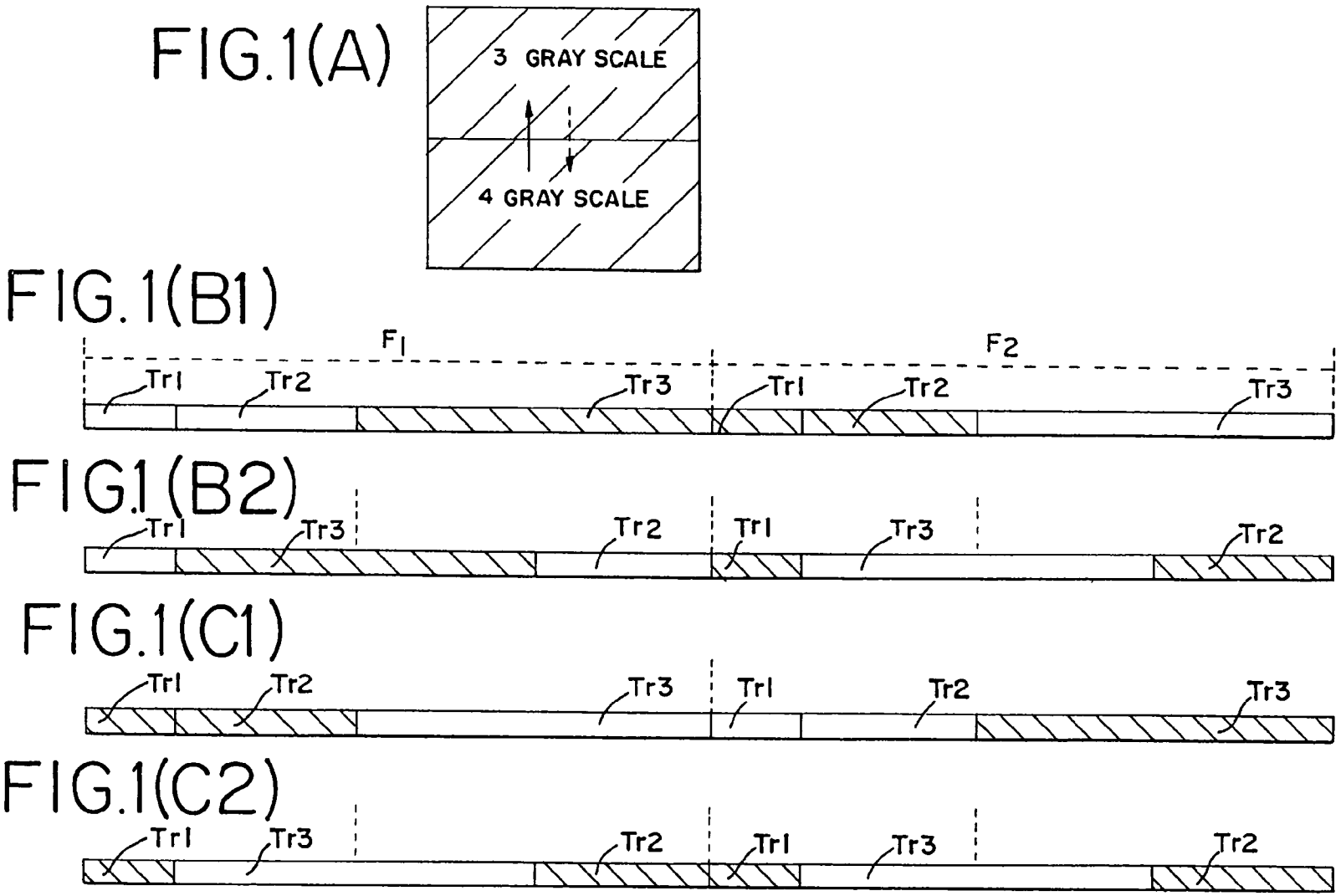

Embodiment Mode 1 is explained while referring to FIGS. 1A to 1C2. FIG. 1A shows a display image of a pixel portion in which m columns×n rows of pixels are arranged in a matrix shape. A 3-bit of a digital video signal capable of displaying gray scales 1 to 8 is input to each of the pixels, and an image is displayed. Pixels in the upper half of the pixel portion perform display of the number 3 gray scale, and pixels in the lower half of the pixel portion perform display of the number 4 gray scale.

A boundary between a portion displaying the number 3 gray scale and a portion displaying the number 4 gray scale moves in the direction of the solid line arrow in FIG. 1A, and the surface area of the portion displaying the number 4 gray scale increases. That is, the pixels in the vicinity of the boundary switch over from displaying the number 3 gray scale to displaying the number 4 gray scale.

Pixel display of the portion in which the gray scale changes is explained while referring to FIGS. 1B1 and 1B2. FIGS. 1B1 and 1B2 show timing charts for light emission and non-light emission of pixels in which the gray scale changes from the number 3 gray scale to the number 4 gray scale when displaying a dynamic image. FIG. 1B1 shows the timing chart for odd number lines of pixels, and FIG. 1B2 shows the timing chart for even number lines of pixels. The horizontal axis shows the passage of time. Changes in the pixel display (light emission, non-light emission) when moving in time from a frame period $F_1$ to a frame period $F_2$ are shown. Among display periods $T_{r1}$ to $T_{r3}$, those during which the pixels emit light are shown in white, while the display periods during which the pixels do not emit light are shown with lines slanting downward to the right.

Note that one frame period is structure by number 1 bit to number 3 bit subframe periods, and the display periods of the respective subframe periods have different time lengths. The number 1 bit subframe period has the first bit display period $T_{r1}$ the number 2 bit subframe period has the second bit display period $T_{r2}$, and the number 3 bit subframe period has the third bit display period $T_{r3}$. The ratio between lengths of time of the display periods is $T_{r1}:T_{r2}:T_{r3}=2^0:2^1:2^2$, and the pixel gray scales are determined by calculating the length of time of the display periods during which the pixels emit light in the frame periods ($F_1$ and $F_2$).

The order of appearance of the subframe periods in the odd number lines of pixels is a sequence of the number 1 bit subframe period, the number 2 bit subframe period, and the number 3 bit subframe period. The order of appearance of the subframe periods in the even number lines of pixels is a sequence of the number 1 bit subframe period, the number 3 bit subframe period, and the number 2 bit subframe period. Note that the gray scale in the frame period is determined by calculating the amount of time that the light emitting elements emit light during the display periods. Therefore only the display periods are shown in FIGS. 1A to 1C2, and the subframe periods are omitted from being shown in the figures.

When the gray scale changes, a non-light emitting state is continuous in the odd number lines of pixels in the vicinity of the boundary during the number 3 bit display period $T_{r3}$ of the frame period $F_1$, and the number 1 bit display period $T_{r1}$ and the number 2 bit display period $T_{r2}$ of the frame period $F_2$ (FIG. 1B1). That is, the non-light emitting state for displaying the number 4 gray scale begins immediately after the non-light emitting state for displaying the number 3 gray scale, and the non-light emitting state is continuous over nearly the length of one frame period.

However, although the non-light emitting state continues in the odd number lines of pixels in the vicinity of the boundary during the display periods $T_{r3}$, $T_{r1}$, and $T_{r2}$, the display periods appear in a sequence of the non-light emitting display period $T_{r3}$, the light emitting display period $T_{r2}$, the non-light emitting display period $T_{r1}$, and the non-light emitting display period $T_{r3}$ in the even number lines of pixels in the vicinity of the boundary which display the light emitting state shown in FIG. 1B2. Namely, the light emitting states and the non-light emitting states appear alternately.

The brightness of adjacent pixels is seen as averaged by human eyes. Therefore, even if the non-light emitting display periods continue in the odd number lines of pixels, when the non-light emitting display periods and the light emitting display periods appear in the even number lines of pixels, the brightness of the odd number lines of pixels and the brightness of the even number lines of pixels will be seen as averaged. Display disturbances will become more difficult to be perceived. Display disturbances due to false contouring are therefore reduced.

Further, FIG. 1A shows the display image of the pixel portion in which the m columns×n rows of pixels are arranged in a matrix shape. A 3-bit digital video signal capable of displaying gray scales 1 to 8 is input to each of the pixels, and an image is displayed. Pixels in the upper half of the pixel portion perform display of the number 3 gray scale, and pixels in the lower half of the pixel portion perform display of the number 4 gray scale.

The boundary between the portion displaying the number 3 gray scale and the portion displaying the number 4 gray scale moves in the direction of the dotted line arrow in FIG. 1A, and the surface area of the portion displaying the number 3 gray scale increases. That is, the pixels in the vicinity of the boundary switch over from displaying the number 4 gray scale to displaying the number 3 gray scale.

Pixel display of the portion in which the gray scale changes is explained while referring to FIGS. 1C1 and 1C2. FIGS. 1C1 and 1C2 show timing charts for light emission and non-light emission of pixels in which the gray scale changes from the number 4 gray scale to the number 3 gray scale when displaying a dynamic image. FIG. 1C1 shows the timing chart for odd number lines of pixels, and FIG. 1C2 shows the timing chart for even number lines of pixels. The horizontal axis shows the passage of time. Changes in the pixel display (light emission, non-light emission) when moving in time from the frame period $F_1$ to the frame period $F_2$ are shown. Among the display periods $T_{r1}$ to $T_{r3}$, those during which the pixels emit light are shown in white, while the display periods during which the pixels do not emit light are shown with lines slanting downward to the right.

The pixels displaying the number 4 gray scale in the frame period $F_1$ display the number 3 gray scale during the frame period $F_2$. When the gray scale changes, a light emitting state is continuous in the odd number lines of pixels in the vicinity of the boundary during the number 3 bit display period $T_{r3}$ of the frame period $F_1$, and the number 1 bit display period $T_{r1}$ and the number 2 bit display period $T_{r2}$ of the frame period $F_2$ (FIG. 1C1). In other words, the light emitting state for displaying the number 3 gray scale begins immediately after the light emitting state for displaying the number 4 gray scale, and the light emitting state is continuous over nearly the length of one frame period.

However, although the light emitting state continues in the odd number lines of pixels in the vicinity of the boundary during the display periods $T_{r3}$, $T_{r1}$, and $T_{r2}$, the display periods appear in a sequence of the light emitting display period $T_{r3}$, the non-light emitting display period $T_{r2}$, the non-light emitting display period $T_{r1}$, and the light emitting display period $T_{r3}$ in the even number lines of pixels in the vicinity of the boundary which display the light emitting state shown in FIG. 1C2. Namely, the light emitting states and the non-light emitting states appear alternately.

The brightness of adjacent pixels is seen as averaged by human eyes. Therefore, even if the light emitting state continues in the odd number lines of pixels, when the non-light emitting state appears in the even number lines of pixels, the brightness of the odd number lines of pixels and the brightness of the even number lines of pixels will be seen as averaged, and display disturbances will become more difficult to be perceived. Display disturbances due to false contouring are therefore reduced.

That is, display disturbances due to false contouring are reduced because regions having continuous light emission or non-light emission are made smaller and dispersed when the human line of sight moves.

A driving method of Embodiment Mode 1 not only can prevent the generation of false contours for cases of displaying dynamic images, but can also prevent display disturbances due to false contouring when displaying static images. A reason for which display disturbances due to false contouring can be suppressed in static images is explained while referring to FIGS. 2A and 2B.

Figure 2A:
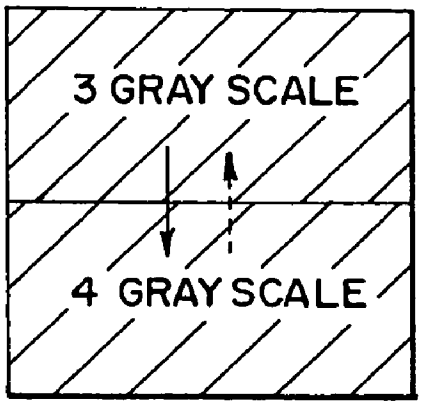
FIGS. 2A and 2B are diagrams showing an organic light emitting display, and light emission timing of light emitting elements for performing display, respectively (Embodiment Mode 1)

For example, display of a pixel portion in which m columns×n rows of pixels are arranged in a matrix shape as shown in FIG. 2A is taken as an example and explained. Pixels in the upper half of the pixel portion perform display of the number 3 gray scale, and pixels in the lower half of the pixel portion perform display of the number 4 gray scale.

Figure 2B:
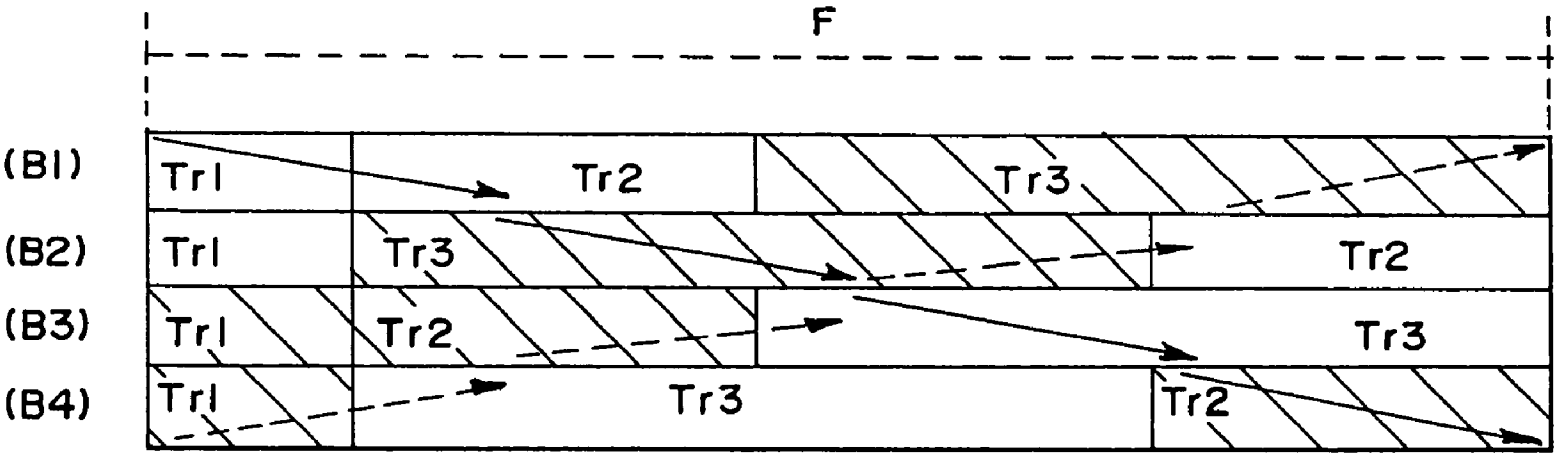

Lines B1, B2, C1, and C2 of FIG. 2B are timing charts for pixel light emission and non-light emission when displaying a static image. Display periods during which the pixels emit light are shown in white, and periods during which the pixels do not emit light are shown by lines slanting downward to the right.

Line B1 of FIG. 2B shows a timing chart for the odd number lines of pixels when displaying the number 3 gray scale, and line B2 of FIG. 2B shows a timing chart for the even number lines of pixels when displaying the number 3 gray scale.

Further, line C1 of FIG. 2B is a timing chart for the odd number lines of pixels when displaying the number 4 gray scale, and line C2 of FIG. 2B is a timing chart for the even number lines of pixels when displaying the number 4 gray scale.

In practice, there is a slight deviation between the time at which the frame period F begins in the pixels displaying the number 3 gray scale and the time at which the frame period F begins in the pixels displaying the number 4 gray scale. However, the explanation is put forth assuming that the slight deviation in time can be ignored because the pixels are located adjacent to each other.

For example, a case is considered in which the line of sight moves as shown by the solid line arrow from a portion displaying the number 3 gray scale to a portion displaying the number 4 gray scale in the static image of FIG. 2A. That is, the line of sight moves across the boundary between the portion displaying the number 3 gray scale and the portion displaying the number 4 gray scale.

The line of sight moves as shown by the solid line arrow, and therefore: the light emission during the number 1 bit display period $T_{r1}$ and the number 2 bit display period $T_{r2}$ in the odd number lines of pixels displaying the number 3 gray scale in line B1 of FIG. 2B; the non-light emission during the number 3 bit display period $T_{r3}$ in the even number lines of pixels displaying the number 3 gray scale shown in line B2 of FIG. 2B; the light emission during the number 3 bit display period $T_{r3}$ in the odd number lines of pixels displaying the number 4 gray scale shown in line C1 of FIG. 2B; and the non-light emission during the number 2 bit display period $T_{r2}$ in the even number lines of pixels displaying the number 4 gray scale shown in line C2 of FIG. 2B are recognized. Namely, pixel light emission and non-light emission are recognized alternately by human eyes.

Pixel light emitting states and non-light emitting states are thus not perceived as being continuous, even with movement of the line of sight, and therefore the generation of unnatural light lines and unnatural dark lines can be controlled. Thus, display disturbances due to false contouring are reduced.

Conversely, a case is considered in which the line of sight moves from the portion displaying the number 4 gray scale to the portion displaying the number 3 gray scale, as shown by the dotted line in FIG. 2A.

The line of sight moves as shown by the dotted line arrow, and therefore: the non-light emission during the number 1 bit display period $T_{r1}$, and the light emission during the number 3 bit display period $T_{r3}$, in the even number lines of pixels displaying the number 4 gray scale in line C2 of FIG. 2B; the non-light emission during the number 2 bit display period $T_{r2}$, and the light emission during the number 3 bit display period $T_{r3}$, in the odd number lines of pixels displaying the number 4 gray scale shown in line C1 of FIG. 2B; the non-light emission during the number 3 bit display period $T_{r3}$, and the light emission during the number 2 bit display period $T_{r2}$, in the even number lines of pixels displaying the number 3 gray scale shown in line B2 of FIG. 2B; and the non-light emission during the number 3 bit display period $T_{r3}$ in the odd number lines of pixels displaying the number 3 gray scale shown in line B1 of FIG. 2B are recognized. Namely, pixel light emission and non-light emission are recognized alternately by human eyes.

Pixel light emitting states and non-light emitting states are thus not perceived as being continuous, even with movement of the line of sight, and therefore the generation of unnatural light lines and unnatural dark lines can be controlled. Thus, display disturbances due to false contouring are reduced.

That is, display disturbances due to false contouring are reduced because regions having continuous light emission or non-light emission are made smaller and dispersed so as to be difficult to be perceived by human eyes.

Display disturbances due to false contouring can therefore be suppressed when displaying a static image in accordance with Embodiment Mode 1.

Figure 3A:
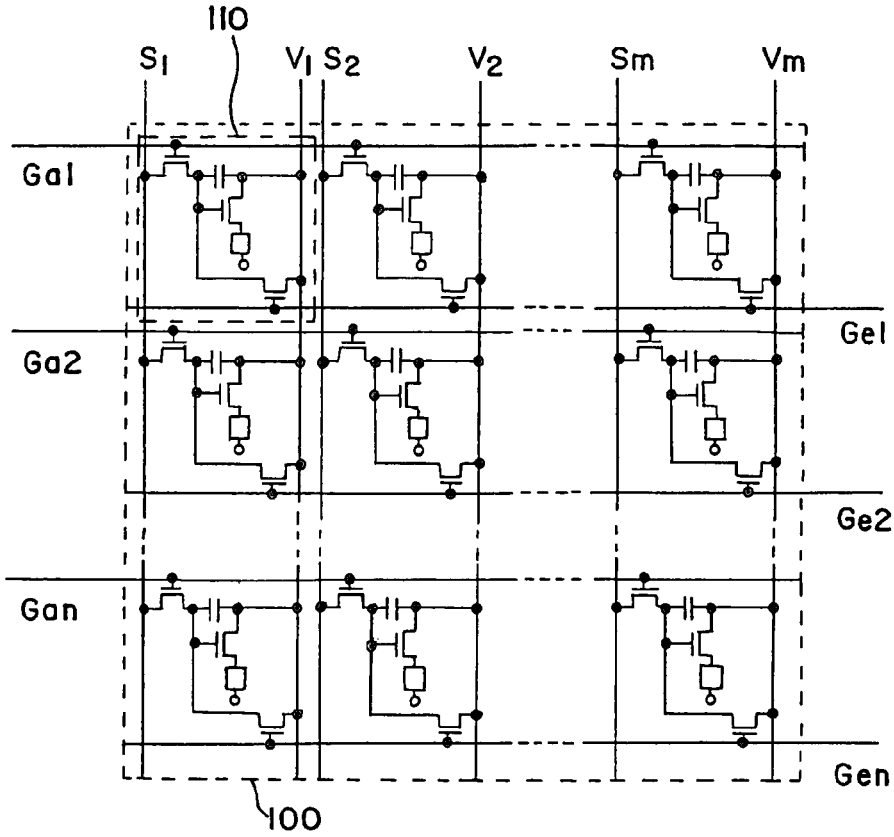
FIGS. 3A and 3B are examples of circuit diagrams of organic light emitting display pixels (Embodiment Mode 1)

Further, a pixel portion of a light emitting display (organic light emitting display) used in Embodiment Mode 1 is explained with reference to FIGS. 3A and 3B. FIG. 3A shows a pixel portion circuit. Source signal lines $S_1$ to $S_m$ connected to a source signal line driver circuit, electric power source supply lines $V_1$ to $V_m$ connected to an electric power source external to the organic light emitting display through an FPC (flexible printed circuit), write in gate signal lines $G_{a1}$ to $G_{an}$ connected to a write in gate signal line driver circuit, and erasure gate signal lines $G_{e1}$ to $G_{en}$ connected to an erasure gate signal line driver circuit are formed in a pixel portion 100.

A plurality of pixels 110 are arranged in a matrix shape in the pixel portion 100. An enlarged diagram of one of the pixels 110 is shown in FIG. 3B. Each of the pixels has a write in gate signal line $G_a$, an erasure gate signal line $G_e$, a source signal line S, an electric power source supply line V, a switching TFT 101, a driver TFT 102, a capacitor 103, an erasure TFT 104, and a light emitting element 105.

A gate electrode of the switching TFT 101 is connected to the write in gate signal line $G_a$. One of a source region and a drain region of the switching TFT 101 is connected to the source signal line S, and the other one is connected to a gate electrode of the driver TFT 102, the capacitor 103, and a source region or a drain region of the erasure TFT 104 of each pixel.

The capacitor 103 is formed in order to hold a gate voltage of the driver TFT 102 when the switching TFT 101 is in an off state (non-selected state).

Further, one of a source region and a drain region of the driver TFT 102 is connected to the electric power source supply line V, and the other one is connected to a pixel electrode of the light emitting element 105. The electric power source supply line V is connected to the capacitor 103.

Further, among the source region and the drain region of the erasure TFT 104, the one not connected to the source region or the drain region of the switching TFT 101 is connected to the electric power source supply line V. A gate electrode of the erasure TFT 104 is connected to the erasure gate signal line $G_e$.

The light emitting element 105 has a layer containing an organic compound (hereinafter referred to as an organic compound layer) in which electroluminescence generated by the application of an electric field is obtained, an anode layer, and a cathode layer. Luminescence includes light emission when returning from a singlet excitation state to a base state (fluorescence), and light emission when returning from a triplet excitation state to a base state (phosphorescence), and it is possible to apply the present invention to a light emitting element using either type of light emission.

For cases in which the anode layer of the light emitting element 105 is connected to the source region or the drain region of the driver TFT 102, the anode layer becomes a pixel electrode, and the cathode layer becomes an opposing electrode. Conversely, for cases in which the cathode layer of the light emitting element 105 is connected to the source region or the drain region of the driver TFT 102, the cathode layer becomes the pixel electrode, and the anode layer becomes the opposing electrode.

An opposing electric potential is imparted to the opposing electrode of the light emitting element 105. Further, an electric power source electric potential is imparted to the electric power source supply line V. The electric potential difference between the opposing electric potential and the electric power source electric potential is maintained at all times at the electric potential difference with such an extent that the light emitting element will emit light when the electric power source electric potential is imparted to the pixel electrode. The electric power source electric potential and the opposing electric potential are imparted from an electric power source external to the organic light emitting display through the FPC. Note that the power source that imparts the opposing electric potential is referred to specifically as an opposing electric power source 106 in this specification.

Note that circuits to which the present invention can be applied are not limited to these. Provided that a digital video signal can be written into pixels at an arbitrary timing, and that the digital video signal can be erased at an arbitrary timing, the driving method of the present invention can be applied. Pixel circuits may be freely employed such that this type of function is expressed.

Figure 3B:
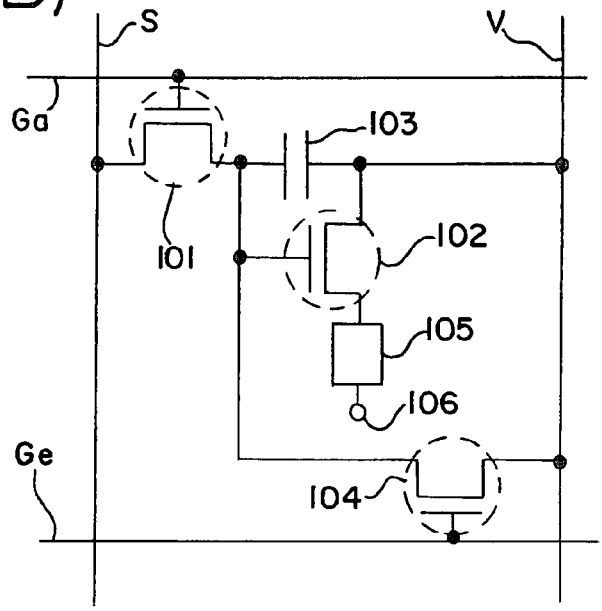

The timing for driving the pixels by the circuits of FIGS. 3A and 3B is explained with reference to FIGS. 4 and 5.

Figure 4:
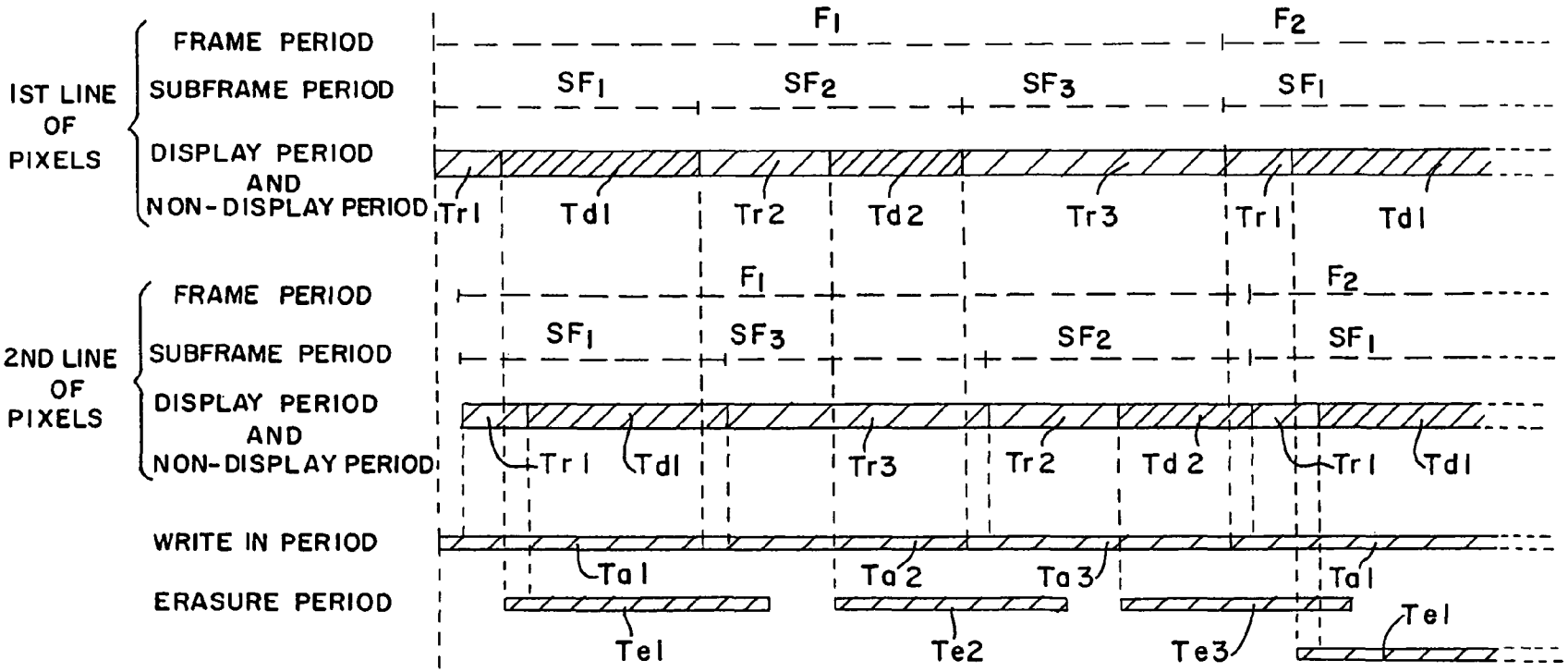
FIG. 4 is a timing chart for time division gray scale display drive (Embodiment Mode 1)

FIG. 4 is a diagram of a chart showing the driving method of Embodiment Mode 1. For simplicity, the frame periods and the subframe periods are only shown for a first line of pixels and a second line of pixels.

One frame period is divided to structure subframe periods. The number of frame period divisions is arbitrary, and one frame period can also be divided into a number 1 bit subframe period $SF_1$ to a number n bit subframe period $SF_n$. However, for simplicity an example of a case in which three subframe periods are formed in each of frame periods $F_0$ and $F_1$ is explained here. That is, one frame period is divided into a number 1 bit subframe period to a number 3 bit subframe period.

The subframe periods appear in the order of the number 1 bit subframe period $SF_1$, the number 2 bit subframe period $SF_2$, and the number 3 bit subframe period $SF_3$ in odd number lines of pixels (for example, the first line of pixels).

In even number lines of pixels (for example, the second line of pixels), the subframe periods appear in the order of the number 1 bit subframe period $SF_1$, the number 3 bit subframe period $SF_3$, and the number 2 bit subframe period $SF_2$.

The number 1 bit subframe period $SF_1$ is a combination of a number 1 bit display period $T_{r1}$ and a number 1 bit non-display period $T_{d1}$. The number 2 bit subframe period $SF_2$ is a combination of a number 2 bit display period $T_{r2}$ and a number 2 bit non-display period $T_{d2}$. The number 3 bit subframe period $SF_3$ consists of a number 3 bit display period $T_{r3}$.

The ratio of the lengths of time of the respective display periods $T_{r1}$ to $T_{r3}$ becomes $T_{r1}:T_{r2}:T_{r3}=2^0:2^1:2^2$. Light emission and non-light emission of the pixels are controlled for each of the display periods, and 3-bit, 8-gray scale display is performed. The non-display periods $T_{d1}$ and $T_{d2}$ of the number 1 bit subframe period and the number 2 bit subframe period, respectively, are periods during which the pixels do not perform display.

Write in periods $T_{a1}$ to $T_{a3}$ are periods necessary for inputting write in selection signals to the write in gate signal lines $G_{a1}$ to $G_{an}$. The write in periods are continuous from the write in period $T_{q1}$, the write in period $T_{a2}$, and the write in period $T_{a3}$.

For cases in which the display period is shorter than the write in period, erasure selection signals are input to the erasure gate signal lines, and the digital video signal held in the pixels is erased. Periods necessary for inputting the erasure selection signals into all desired erasure gate signal lines are erasure periods $T_{e1}$ to $T_{e3}$.

Note that the display period finishes, and the non-display period begins, for pixels into which the erasure selection signal is input during the erasure period.

Figure 5:
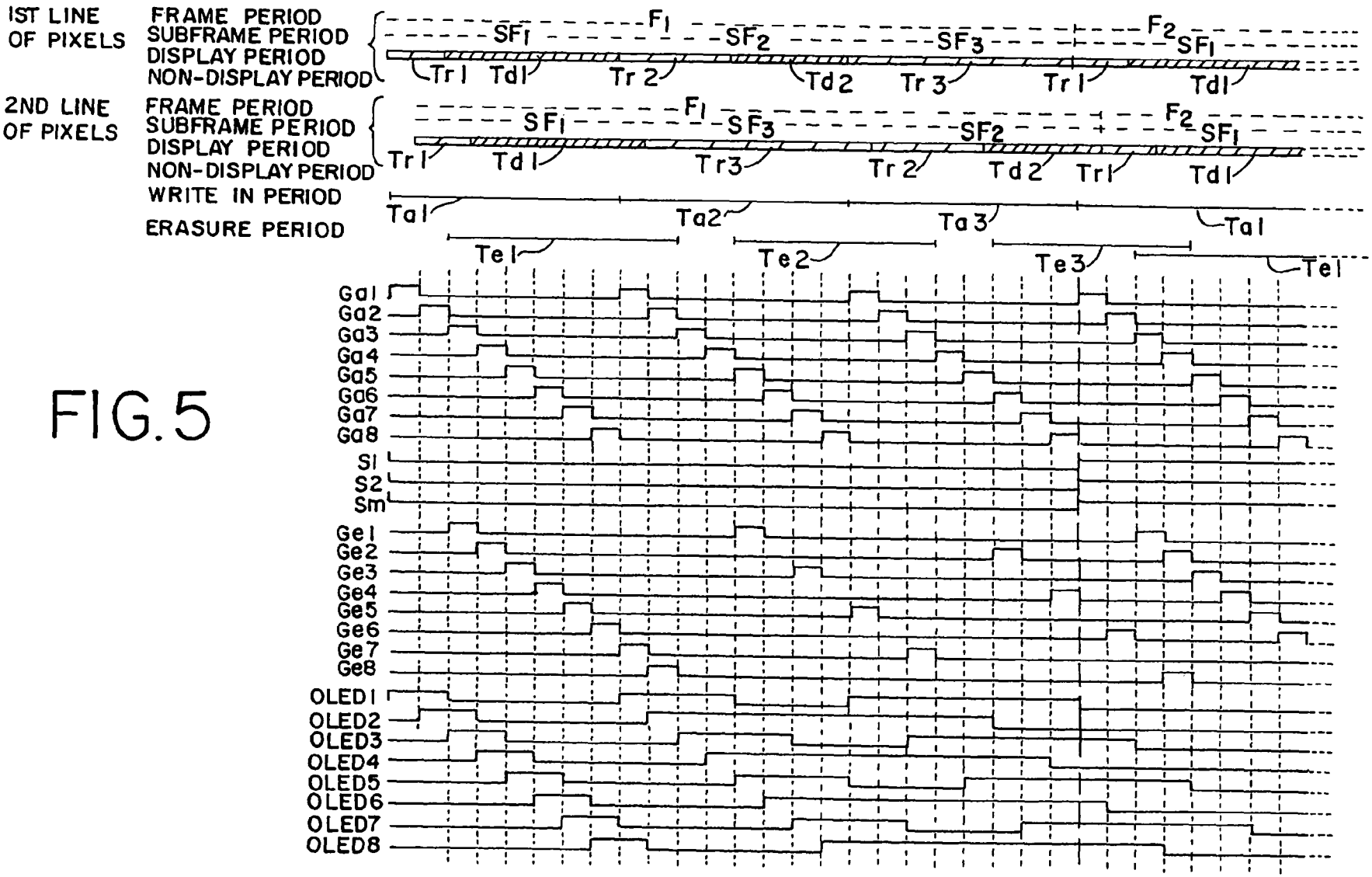
FIG. 5 is a timing chart for time division gray scale display drive (Embodiment Mode 1)

FIG. 5 is a timing chart for the drive shown by the chart of FIG. 4. The number of the write in gate signal lines and the number of the erasure gate signal lines can be determined arbitrarily with the present invention, but for simplicity, the number is reduced for the explanation here.

Note that the write in gate signal line driver circuit adopts a structure having an address decoder in the present invention, and it therefore becomes possible to input write in selection signals to an arbitrary number of write in gate signal lines at an arbitrary timing. Further, the erasure gate signal line driver circuit adopts a structure having an address decoder, and it therefore becomes possible to input erasure selection signals to an arbitrary number of erasure gate signal lines at an arbitrary timing.

For simplicity, all of the pixel light emitting elements emit light in the frame period $F_1$, and none of the pixel light emitting elements emit light during the frame period $F_2$. The signals input from the source signal lines $S_1$ to $S_m$ during the frame period $F_1$, and the frame period $F_2$ are therefore the same for all of the pixels.

Whether the light emitting elements are in a light emitting state or a non-light emitting state is determined by the electric potential difference between the pixel electrode and the opposing electrode of the light emitting elements. The electric potential difference between the pixel electrode and the opposing electrode is denoted by $OLED_1$ to $OLED_8$. $OLED_1$ is the voltage applied to the light emitting elements of a number 1 line of pixels. Similarly, $OLED_2$ to $OLED_8$ denote the voltages applied to the light emitting elements of a number 2 to a number 8 line of pixels, respectively. In Embodiment Mode 1, the light emitting elements emit light if a positive polarity, forward bias voltage is applied, and the light emitting elements do not emit light if a positive polarity, forward bias voltage is not applied.

Driving of the light emitting elements is explained below. A write in selection signal is input to the number 1 line write in gate signal line $G_{a1}$ from the gate signal line driver circuit. As a result, the switching TFTs of all the pixels connected to the number 1 line write in gate signal line $G_{a1}$ (the number 1 line of pixels) are placed in an on state. At the same time, the first bit of the digital video signal is input to the source signal line $S_1$ to $S_m$ all at once from the source signal line driver circuit.

In Embodiment Mode 1, the driver TFT is in an on state when the digital video signal has an "L" voltage. As a result, a forward bias is applied to the organic light emitting elements of pixels to which the digital video signal having the "L" voltage is input, and light emission occurs.

Conversely, the driver TFT is in an off state if the digital video signal has an "H" voltage. As a result, a forward bias is not applied to the organic light emitting elements of pixels to which the digital video signal having the "H" voltage is input, and there is no light emission.

The number 1 line of pixels are thus controlled to emit light or not to emit light at the same time as the digital video signal is input to the number 1 line of pixels, the number 1 line of pixels perform display, and the number 1 bit display period $T_{r1}$ begins in the number 1 line of pixels.

Next, the write in selection signal is input to the number 2 line write in gate signal line $G_{a2}$ at the same time as input of the write in selection signal to the number 1 line write in gate signal line $G_{a1}$ finishes.

A period for inputting the write in selection signal to the number 1 line write in gate signal line $G_{a1}$ (a period for selecting the number 1 gate signal line) is a line period (AG). Note that the line periods have the same length for cases of inputting the selection signal into the number 2 line write in gate signal line $G_{a2}$ to the number n line write in gate signal line $G_{an}$.

The switching TFTs of all the pixels connected to the number 2 line write in gate signal line $G_{a2}$ are then placed in an on state, and the number 1 bit of the digital video signal is input to the number 2 line of pixels from the source signal lines $S_1$ to $S_m$. The number 2 line of pixels thus perform display, and the number 1 bit display period $T_{r1}$ begins in the number 2 line of pixels.

Thereafter, the number 1 bit of the digital video signal is input to the number 3 line of pixels and the number 4 line of pixels in order. The write in selection signal is input to the write in gate signal lines $G_{a1}$ to $G_{an}$ in sequence, and a period up until the number 1 bit of the digital video signal is input to all lines of the pixels is the write in period $T_{a1}$.

The number 1 bit display period $T_{r1}$ is shorter than the number 1 bit write in period $T_{a1}$, and therefore the digital video signal held in the number 1 line of pixels must be erased before the write in period $T_{a1}$ is completed. An erasure selection signal is input to the number 1 line erasure gate signal line from the erasure gate signal line driver circuit.

The erasure TFTs of all the pixels connected to the number 1 line erasure gate signal line $G_{e1}$ (the number 1 line of pixels) are then placed in an on state when the erasure selection signal is input to the number 1 line erasure gate signal line $G_{e1}$. The number 1 bit of the digital video signal held by the gate electrodes of the driver TFTs is then erased by the input of the erasure selection signal.

The number 1 bit display period $T_{n1}$ for the number 1 line of pixels is completed when the number 1 bit of the digital video signal held by the number 1 line of pixels is erased, and the number 1 bit non-display period $T_{d1}$ begins.

Then, at the same time as input of the erasure selection signal to the number 1 line erasure gate signal line $G_{e1}$ ends, the erasure selection signal is input to the number 2 line erasure gate signal line $G_{e2}$. As a result, the organic light emitting elements of the number 2 line of pixels are all placed in a non-light emitting state, and display is not performed. The number 1 bit display period $T_{r1}$ therefore ends in the number 2 line of pixels, and the number 1 bit non-display period $T_{d1}$ begins.

Thereafter, the number 1 bit of the digital video signal held by the pixels is erased in the order of the number 3 line of pixels and the number 4 line of pixels. The erasure selection signal is input to the erasure gate signal lines $G_{e1}$ to $G_{en}$ in sequence, and a period up until the number 1 bit of the digital video signal is erased from all of the lines of pixels is the erasure period $T_{e1}$.

The write in period $T_{a1}$ ends, and the write in period $T_{a2}$ begins, while erasure of the number 1 bit of the digital video signal held in the pixels is performed during the erasure period $T_{e1}$. The write in selection signal is then input to the number 1 line write in gate signal line $G_{a1}$, and all of the switching TFTs connected to the number 1 line write in gate signal line $G_{a1}$ are placed in an on state. At the same time, the number 2 bit of the digital video signal is input from the source signal lines $S_1$ to $S_m$. The number 1 line of pixels again perform display as a result, the number 1 bit non-display period $T_{d1}$ ends, and the number 2 bit display period $T_{r2}$ begins.

Next, the write in selection signal is input to the number 2 line write in gate signal line $G_{a2}$, and the number 3 bit of the digital video signal is input to the number 2 line of pixels. The number 2 line of pixels again perform display as a result, the number 1 bit non-display period $T_{d1}$ ends, and the number 3 bit display period $T_{r3}$ begins.

The number 2 bit display period $T_{r2}$ begins in the number 1 line of pixels when the number 1 bit non-display period $T_{d1}$ is completed, and the number 3 bit display period $T_{r3}$ begins in the number 2 line of pixels.

The number 2 bit of the digital video signal is next input to the pixels of the number 3 line write in gate signal line $G_{a3}$, the number 3 line of pixels again perform display, and the number 2 bit display period $T_{r2}$ begins.

The number 3 bit of the digital video signal is next input to the pixels of the number 4 line write in gate signal line $G_{a4}$, the number 4 line of pixels again perform display, and the number 3 bit display period $T_{r3}$ begins.

Thereafter, the number 2 bit of the digital video signal is input into odd number lines of pixels, and the number 3 bit of the digital video signal is input into even number lines of pixels, in sequence in the number 5 line of pixels and the number 6 line of pixels. The write in selection signal is input to the write in gate signal lines $G_{a1}$ to $G_{an}$ one after another, and the period for inputting the number 2 bit of the digital video signal or the number 3 bit of the digital video signal to all of the lines of pixels is the write in period $T_{a2}$.

The number 2 bit display period $T_{r2}$ during which the odd number lines of pixels perform display is short in comparison with the write in period $T_{a2}$, and therefore it is necessary to form an erasure period $T_{e2}$ before the write in period $T_{a2}$ ends and erase the number 2 bit of the digital video signal held in the odd number lines of pixels. The erasure selection signal is therefore input to only the odd number erasure gate signal lines in the erasure period $T_{e2}$.

First, the erasure selection signal is input to the number 1 line erasure gate signal line $G_{e1}$ from the erasure gate signal line driver circuit. The number 2 bit display period $T_{r2}$ therefore ends in the number 1 line of pixels, and the number 2 bit non-display period $T_{d2}$ begins.

The number 2 bit display periods $T_{r2}$ are equal for the number 1 line of pixels and the number 3 line of pixels, and therefore the erasure selection signal is input to the number 3 line erasure gate signal line $G_{e3}$ following a predetermined period after input of the erasure selection signal to the number 1 line erasure gate signal line $G_{e1}$ is completed. The number 2 bit display period $T_{r2}$ ends in the number 3 line of pixels when the erasure gate signal is input to the number 3 line erasure gate signal line $G_{e3}$, and the number 2 bit non-display period $T_{d2}$ begins.

Thereafter, the number 2 bit of the digital video signal held in the odd number lines of pixels is erased from the odd number lines of pixels in the order of the number 5 line of pixels and the number 7 line of pixels. The period up until the erasure selection signal is input in sequence to the odd number erasure gate signal lines, and the number 2 bit of the digital video signal held in all of the odd number lines of pixels is erased is the erasure period $T_{e2}$.

Display in the number 3 bit display period is performed for all of the even lines of pixels, and therefore the erasure selection signal is not input in the erasure period $T_{e2}$.

The write in period $T_{a2}$ ends, and the write in period $T_{a3}$ begins, while erasure of the number 2 bit of the digital video signal held in the pixels is performed during the erasure period $T_{e2}$. The write in selection signal is then input to the number 1 line write in gate signal line $G_{a1}$, and the number 3 bit of the digital video signal is input to the number 1 line of pixels. The number 1 line of pixels again perform display as a result, the number 2 bit non-display period $T_{r2}$ ends, and the number 3 bit display period $T_{r3}$ begins.

Next, the write in selection signal is input to the number 2 line write in gate signal line $G_{a2}$ from the gate signal line driver circuit, and the number 2 bit of the digital video signal is input from the source signal lines $S_1$ to $S_m$.

Thus, the number 3 bit display period $T_{r3}$ begins in the number 1 line of pixels, and the number 2 bit display period $T_{r2}$ begins in the number 2 line of pixels.

The number 3 bit of the digital video signal is next input to the pixels of the number 3 line write in gate signal line $G_{a3}$, the number 2 bit display period $T_{r2}$ ends, and the number 3 bit display period $T_{r3}$ begins in the number 3 line of pixels.

The number 2 bit of the digital video signal is next input to the pixels of the number 4 line write in gate signal line $G_{a4}$, the number 3 bit display period $T_{r3}$ ends, and the number 2 bit display period $T_{r2}$ begins in the number 4 line of pixels.

Thereafter, the number 3 bit of the digital video signal is input to the odd number lines of pixels, the number 5 line of pixels and the number 7 line of pixels, and the number 3 bit display period $T_{r3}$ begins. The number 2 bit of the digital video signal is input to the even number lines of pixels, and the number 2 bit display period $T_{r2}$ begins. The write in selection signal is input to the write in gate signal lines $G_{a1}$ to $G_{an}$ in order, and the period during which the number 2 bit of the digital video signal or the number 3 bit of the digital video signal is input to all the lines of pixels is the write in period $T_{a3}$.

The number 2 bit display period $T_{r2}$ during which the even number lines of pixels perform display is short in comparison with the write in period $T_{a3}$, and therefore it is necessary to form an erasure period $T_{e3}$ before the write in period $T_{a3}$ ends and erase the number 2 bit of the digital video signal held in the even number lines of pixels. The erasure selection signal is therefore input to only the even number erasure gate signal lines in the erasure period $T_{e3}$.

First, the erasure selection signal is input to the number 2 line erasure gate signal line $G_{e2}$ from the erasure gate signal line driver circuit. The number 2 bit display period $T_{r2}$ therefore ends in the number 2 line of pixels, and the number 2 bit non-display period $T_{d2}$ begins. Thus, the number 2 line of pixels do not perform display.

The number 2 bit display periods $T_{r2}$ are equal for the number 2 line of pixels and the number 4 line of pixels, and therefore the erasure selection signal is input to the number 4 line erasure gate signal line $G_{e4}$ following a predetermined period after input of the erasure selection signal to the number 2 line erasure gate signal line $G_{e2}$ is completed. The number 2 bit display period $T_{r2}$ ends in the number 4 line of pixels when the erasure gate signal is input to the number 4 line erasure gate signal line $G_{e4}$, and the number 2 bit non-display period $T_{d2}$ begins.

The erasure selection signal is then input to all the even number erasure gate signal lines in order. The period for selecting all of the even number erasure gate signal lines one after another, and erasing the number 2 bit of the digital video signal held in all of the even number lines of pixels is the erasure period $T_{e3}$.

All of the odd number lines of pixels perform display of the number 3 bit display period, and therefore the erasure selection signal is not input in the erasure period $T_{e3}$.

The frame period $F_2$ begins in the number 1 line of pixels when the write in period $T_{a3}$ ends. The write in selection signal is input to the number 1 line write in gate signal line $G_{a1}$ when the write in period $T_{e1}$ begins in the frame period $F_2$, the number 3 bit display period $T_{r3}$ ends in the number 1 line of pixels, and the number 1 bit display period $T_{r1}$ begins.

Next, the write in selection signal is input to the number 2 line write in gate signal line $G_{a2}$, and the number 1 bit of the digital video signal is input to the number 2 line of pixels. As a result, the number 2 bit non-display period $T_{d2}$ ends in the number 2 line of pixels, and the number 1 bit display period $T_{r1}$ begins.

The display periods also appear during the frame period $F_2$, in the sequence of the number 1 bit display period $T_{r1}$, the number 2 bit display period $T_{r2}$, and the number 3 bit display period $T_{r3}$ in the odd number lines of pixels. That is, the subframe periods appear in the order of the number 1 bit subframe period $SF_1$, the number 2 bit subframe period $SF_2$, and the number 3 bit subframe period $SF_3$.

Further, in the even number lines of pixels, the display periods appear in the sequence of the number 1 bit display period $T_{r1}$, the number 3 bit display period $T_{r3}$, and the number 2 bit display period $T_{r2}$. Namely, the subframe periods appear in the order of the number 1 bit subframe period $SF_1$, the number 3 bit subframe period $SF_3$, and the number 2 bit subframe period $SF_2$.

The above operations are repeatedly performed for each frame period, and an image is continuously displayed. The order of appearance of the subframe periods can thus be changed between the even number lines of pixels and the odd number lines of pixels.

The gray scale displayed by a pixel in one frame period can be found by taking the total length of the display periods during which the light emitting elements emit light within one frame period.

In Embodiment Mode 1, when three-bit, 8-gray scale display is performed, and the number 1 bit subframe period $SF_1$ to the number 3 bit subframe period $SF_3$ are formed, the write in selection signal is input to each of the write in gate signal lines $G_{a1}$ to Gas three times. The number of times that the signal is input during one frame period is the same as that of known methods. Therefore an increase in the number of charge and discharges of electric charge and an increase in the frequency of the driver circuit can be suppressed, and the electric power consumption is not different from that of the known methods. As a result, display disturbances due to false contouring can be prevented while suppressing an increase in the electric power consumption For example, the frame periods can also be made to appear in the odd number lines of pixels as follows: in the frame period $F_1$, the subframe periods may appear in the sequence of the number 1 bit subframe period, the number 2 bit subframe period, and the number 3 bit subframe period; and in the frame period $F_2$, the subframe periods may appear in the sequence of the number 1 bit subframe period, the number 3 bit subframe period, and the number 2 bit subframe period.

Note that, although an example is explained in Embodiment Mode 1 in which the order of appearance of the subframe periods is the same for the frame period $F_1$ and the frame period $F_2$, the present invention is not limited to this. The order of appearance of the subframe periods may be changed for each of the frame periods.

In this case, the frame periods can be made to appear in the even number lines of pixels as follows: in the frame period $F_1$, the subframe periods may appear in the sequence of the number 1 bit subframe period, the number 3 bit subframe period, and the number 2 bit subframe period; and in the frame period $F_2$, the subframe periods may appear in the sequence of the number 1 bit subframe period, the number 3 bit subframe period, and the number 2 bit subframe period.

Note that it is possible to combine Embodiment Mode 1 with Embodiment Modes 5 and 6.

Further, although an example of applying the present invention to the light emitting display (organic light emitting display) is shown as one embodiment mode of the present invention, the present invention is not limited to this. For example, it is also possible to apply the present invention to displays performing display by time division gray scales, such as FEDs (field emission displays), PDPs (plasma display panels), and ferroelectric liquid crystal display devices (liquid crystal displays).

Furthermore, merely provided that the display method of the present invention may be applied to a time division gray scale method, display devices having all types of structures may be employed. It is not always necessary that the display devices of the present invention have elements such as TFTs or TEDs (thin film diodes), and active matrix display does not need to be performed. In other words, it is also possible to apply the present invention to display devices that perform passive matrix display, typically ferroelectric LCDs. Furthermore, the present invention may also be used in combination with a surface area gray scale method.

In accordance with Embodiment Mode 1, it is possible to reduce the surface area of portions continuously emitting light, or continuously not emitting light, to a level that the portions are not perceivable by the resolution of human eyes, and display disturbances due to false contouring can be suppressed. Further, false contouring can be reduced without increasing the number of divisions of the subframe periods. Therefore, display quality can be improved without depending upon the driver performance of the driver circuit, and a good display quality can be achieved without increasing electric power consumption.

Embodiment Mode 2

An embodiment mode of the present invention is explained below. Note that the display device and the method of driving the display device of the present invention, are not limited to the example shown below. In Embodiment Mode 2, there is shown a structure in which the starting time of frame periods differs greatly between odd number lines of pixels and even number lines of pixels. In other words, the order of appearance of subframe periods is the same for the odd number lines of pixels and the even number lines of pixels in Embodiment Mode 2, but the times at which the frame periods, structured by the subframe periods, begin are shifted greatly.

Figure 6A:
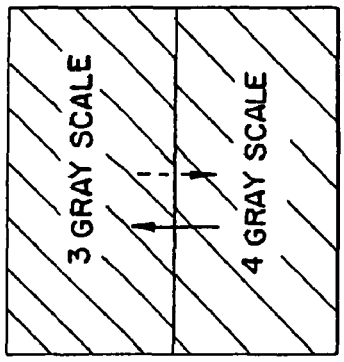
FIGS. 6A to 6C are diagrams showing an organic light emitting display, and light emission timing for performing display, respectively (Embodiment Mode 1)

Embodiment Mode 2 is explained with reference to FIGS. 6A to 6C. Elements that are the same as those of Embodiment Mode 1 have the same reference numerals attached. FIG. 6A shows pixel portion display. Similar to the display of FIG. 1A, an image is displayed in FIG. 6A using a 3-bit of the digital video signal capable of displaying the gray scales 1 to 8. The upper half of the pixel portion performs display of the number 3 gray scale, and the lower half of the pixel portion performs display of the number 4 gray scale.

When displaying a dynamic image, for example in FIG. 6A, a boundary between a portion performing display of the number 3 gray scale and a portion performing display of a number 4 gray scale moves in the direction of the solid line arrow. That is, the pixels in the vicinity of the boundary switch over from displaying the number 3 gray scale to displaying the number 4 gray scale.

Pixel display is explained with reference to FIG. 6B. Lines B1 and B2 of FIG. 6B are timing charts for light emission and non-light emission of pixels that change from the number 3 gray scale to the number 4 gray scale when displaying a dynamic image. Line B1 of FIG. 6B is a timing chart for odd number lines of pixels, and line B2 of FIG. 6B is a timing chart for even number lines of pixels. Display periods during which the pixels emit light are shown in white, and display periods during which the pixels do not emit light are shown by lines slanting downward to the right.

The times at which the frame periods $F_0$ to $F_2$ begin differ greatly between the odd number lines of pixels and the even number lines of pixels. Therefore, the times at which the subframe periods formed by dividing the frame periods begin, and accordingly the times at which the display periods $T_{r1}$ to $T_{r3}$ contained within the respective subframe periods begin, also differ greatly between the odd number lines of pixels and the even number lines of pixels. The periods for performing light emission and non-light emission therefore are shifted between the number 1 line of pixels and the number 2 line of pixels, even for cases in which the same gray scale is displayed.

The pixels displaying the number 3 gray scale in the frame period $F_1$ then display the number 4 gray scale in the frame period $F_2$ when the gray scale switches over. Then, the odd number lines of pixels near the boundary are continuously in a non-light emitting state for the display periods $T_{r3}$, $T_{r1}$, and $T_{r2}$ (see line B1 of FIG. 6B). In other words, the non-light emitting state for displaying the number 4 gray scale begins immediately after the non-light emitting state for displaying the number 3 gray scale, and the non-light emitting state continuous over one frame period amount of time.

Figure 6B:
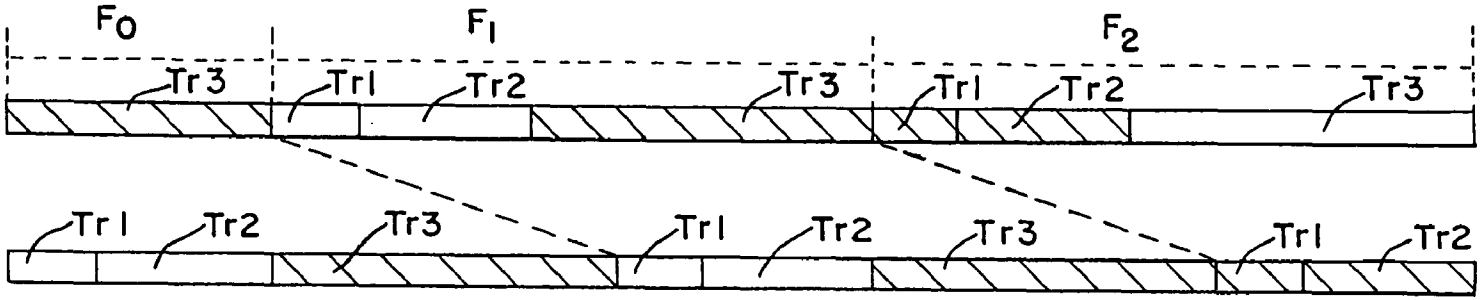

However, while the odd number lines of pixels in the vicinity of the boundary are continuously in a non-light emitting state during the display periods $T_{r3}$, $T_{r1}$, and $T_{r2}$, the display of the frame period $F_1$ is performed for the even number lines of pixels near the boundary showing a light emitting state in line B2 of FIG. 6B, and the and the display period $T_{r3}$ during which the pixels are in a non-light emitting state follows the display periods $T_{r1}$ and $T_{r2}$, during which the pixels are in a light emitting state. That is, light emitting and non-light emitting states are performed in order.

The brightness of adjacent pixels is seen as averaged by human eyes. Therefore, although the non-light emitting display periods are continuous in the odd number lines of pixels, if the non-light emitting display periods and the light emitting display periods appear in the even number lines of pixels, then the brightness of the odd number lines of pixels and the brightness of the even number lines of pixels will be seen as averaged. Display disturbances will become more difficult to be perceived. Display disturbances due to false contouring are therefore reduced.

Further, assume that the boundary between the portion displaying the number 3 gray scale and the portion displaying the number 4 gray scale moves in the direction of the dotted line arrow in FIG. 6A. That is, the pixels in the vicinity of the boundary switch over from displaying the number 4 gray scale to displaying the number 3 gray scale.

Figure 6C:
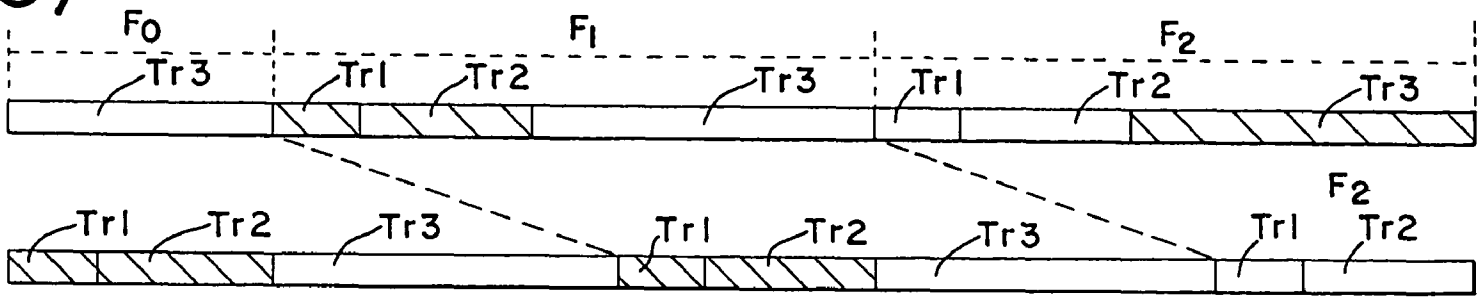

Pixel display of the portion in which the gray scale changes is explained while referring to FIG. 6C. Lines C1 and C2 of FIG. 6C show timing charts for light emission and non-light emission of pixels in which the gray scale changes from the number 4 gray scale to the number 3 gray scale when displaying a dynamic image. Line C1 of FIG. 6C shows the timing chart for odd number lines of pixels, and line 2 of FIG. 6C shows the timing chart for even number lines of pixels. Display periods during which the pixels emit light are shown in white, while the display periods during which the pixels do not emit light are shown with lines slanting downward to the right.

The pixels displaying the number 4 gray scale in the frame period $F_1$ then display the number 3 gray scale in the frame period $F_2$ when the gray scale switches over. The odd number lines of pixels near the boundary are continuously in a light emitting state for the display periods $T_{r3}$, $T_{r1}$, and $T_{r2}$ (see line C1 of FIG. 6C). In other words, the light emitting state for displaying the number 3 gray scale begins immediately after the light emitting state for displaying the number 4 gray scale, and the light emitting state continuous over one frame period amount of time.

However, while the odd number lines of pixels in the vicinity of the boundary are continuously in a light emitting state during the display periods $T_{r3}$, $T_{r1}$, and $T_{r2}$, the display of the frame period $F_1$ is performed for the even number lines of pixels near the boundary showing a light emitting state in line C2 of FIG. 6C, and the and the display period $T_{r3}$ during which the pixels are in a light emitting state follows the display periods $T_{r1}$ and $T_{r2}$, during which the pixels are in a non-light emitting state. That is, non-light emitting and light emitting states are performed in order.

The brightness of adjacent pixels is seen as averaged by human eyes. Therefore, although the light emitting display periods are continuous in the odd number lines of pixels, if the non-light emitting display periods and the light emitting display periods appear in the even number lines of pixels, then the brightness of the odd number lines of pixels and the brightness of the even number lines of pixels will be seen as averaged. Display disturbances will become more difficult to be perceived. Display disturbances due to false contouring are therefore reduced.

The driving method of Embodiment Mode 2 not only can prevent the generation of false contours for cases of displaying dynamic images, but can prevent display disturbances due to false contouring when displaying static images.

Figure 7A:
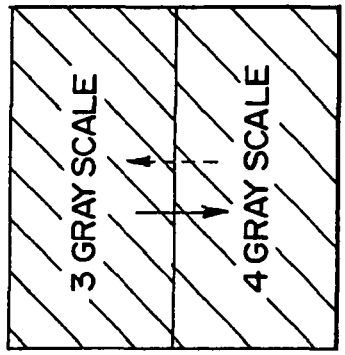
FIGS. 7A and 7B are diagrams showing an organic light emitting display, and light emission timing for performing display, respectively (Embodiment Mode 1)
Figure 7B:
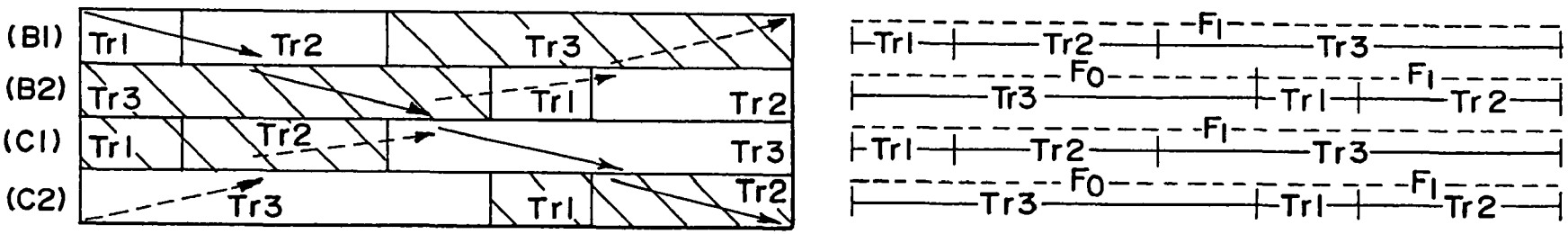

A reason for which display disturbances due to false contouring can be suppressed in static images is explained while referring to FIGS. 7A and 7B. FIG. 7A shows pixel portion display, and the display periods $T_{r1}$ to $T_{r3}$ appearing in the frame periods in the pixel portion are shown in FIG. 7B. Display periods during which the pixels emit light are shown in white, and display periods during which the pixels do not emit light are shown by lines slanting downward to the right.

Line B1 of FIG. 7B is a timing chart for light emission and non-light emission for the odd number lines of pixels when displaying the number 3 gray scale. A sequence of the display period $T_{r1}$, the display period $T_{r2}$, and the display period $T_{r3}$ of the frame period $F_1$ is shown. Line B2 of FIG. 7B is a timing chart for light emission and non-light emission for the even number lines of pixels when displaying the number 3 gray scale. When the odd lines of pixels are performing display as stated above, the even number lines of pixels display the display period $T_{r3}$ of the frame period $F_0$. Next, a sequence of the display period $T_{r2}$ and the display period $T_{r3}$ of the frame period $F_1$ is displayed.

Further, line C1 of FIG. 7B is a timing chart for light emission and non-light emission for the odd number lines of pixels when displaying the number 4 gray scale. Line C2 of FIG. 7B is a timing chart for light emission and non-light emission for the even number lines of pixels when displaying the number 4 gray scale.

The times at which the frame periods $F_0$ and $F_1$ begin differ greatly between the odd number lines of pixels and the even number lines of pixels. Therefore, the times at which the subframe periods formed by dividing the frame periods begin, and accordingly the times at which the display periods $T_{r1}$ to $T_{r3}$ contained within the respective subframe periods begin, also differ greatly between the odd number lines of pixels and the even number lines of pixels. The periods for performing light emission and non-light emission therefore are shifted in the number 1 line of pixels and the number 2 line of pixels, even for cases in which the same gray scale is displayed.

For example, a case is considered in which the line of sight moves from a portion displaying the number 3 gray scale to a portion displaying the number 4 gray scale as shown by the solid line arrow in FIG. 7A. That is, the line of sight moves in the vicinity of the boundary between the portion displaying the number 3 gray scale and the portion displaying the number 4 gray scale.

Human eyes move as shown by the solid line arrow, and therefore: the light emission during the display periods $T_{r1}$ and $T_{r2}$ in the odd number lines of pixels displaying the number 3 gray scale (see line B1 of FIG. 7B); the non-light emission during the display period $T_{r3}$ in the even number lines of pixels displaying the number 3 gray scale (see line B2 of FIG. 7B); the light emission during the display period $T_{r3}$ in the odd number lines of pixels displaying the number 4 gray scale (see line C1 of FIG. 7B); and the non-light emission during the display period $T_{r2}$ in the even number lines of pixels displaying the number 4 gray scale (see line C2 of FIG. 7B) are recognized by human eyes. In other words, pixel light emission and non-light emission are recognized alternately.

Pixel light emitting states and non-light emitting states are thus not perceived as being continuous, even with movement of the line of sight. Therefore the generation of unnatural light lines and unnatural dark lines can be controlled, and display disturbances due to false contouring are reduced.

Conversely, a case is considered in which the line of sight moves from the portion displaying the number 4 gray scale to the portion displaying the number 3 gray scale, as shown by the dotted line arrow in FIG. 7A. That is, the line of sight moves in the vicinity of the boundary between the portion displaying the number 4 gray scale and the portion displaying the number 3 gray scale.

Human eyes move as shown by the dotted line arrow, and therefore: the non-light emission during the display period $T_{r3}$ in the even number lines of pixels displaying the number 4 gray scale (see line C2 of FIG. 7B); the non-light emission during the display period $T_{r2}$ in the odd number lines of pixels displaying the number 4 gray scale (see line C1 of FIG. 7B); the non-light emission during the display periods $T_{r3}$ and the light emission during the display period $T_{r1}$ in the even number lines of pixels displaying the number 3 gray scale (see line B2 of FIG. 7B); and the non-light emission during the display period $T_{r3}$ in the odd number lines of pixels displaying the number 3 gray scale (see line B1 of FIG. 7B) are recognized by human eyes. In other words, pixel light emission and non-light emission are recognized alternately.

Pixel light emitting states and non-light emitting states are thus not perceived as being continuous, even with movement of the line of sight. Therefore the generation of unnatural light lines and unnatural dark lines can be controlled, and display disturbances due to false contouring are reduced.

Therefore, display disturbances due to false contouring can also be suppressed for cases of displaying a static image in accordance with Embodiment Mode 2.

Pixel drive timing is explained next with reference to FIGS. 8 and 9.

Figure 8:
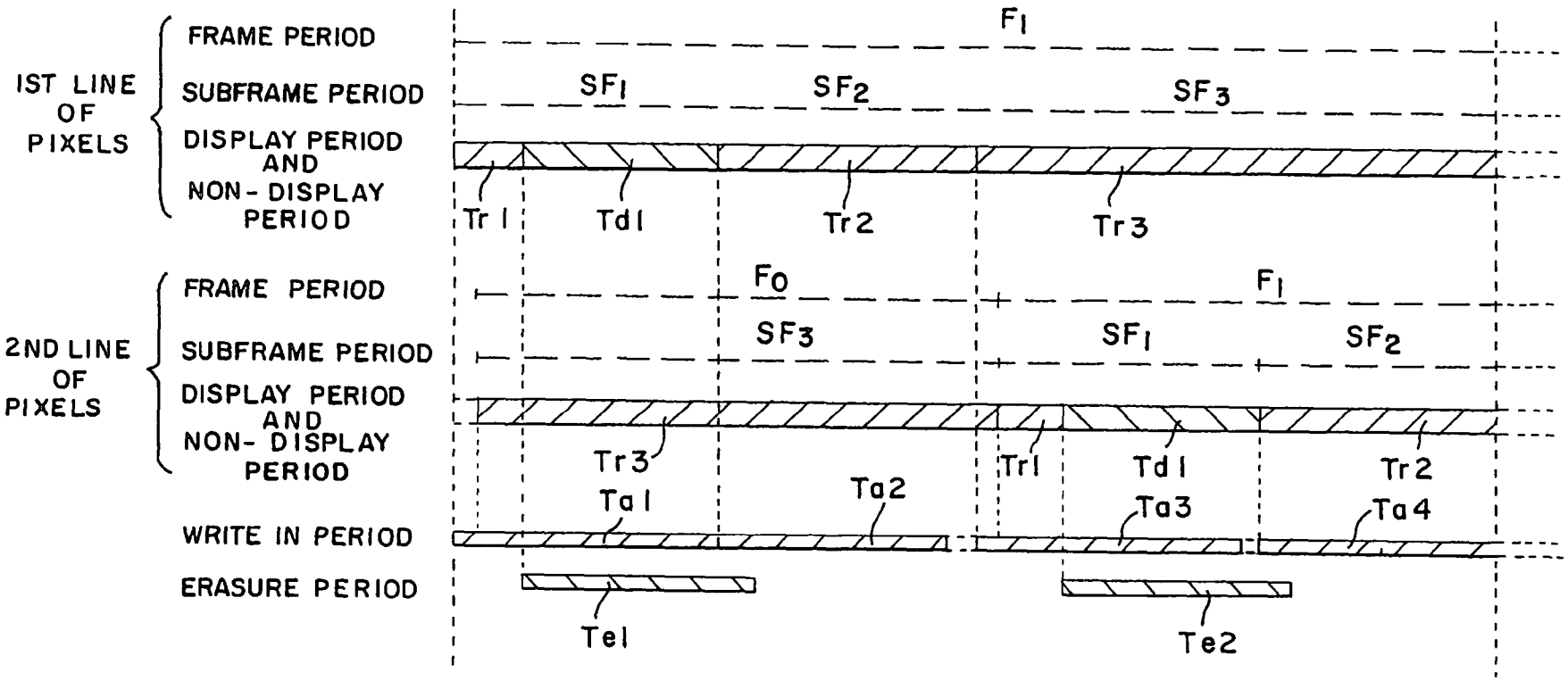
FIG. 8 is a timing chart for time division gray scale display drive (Embodiment Mode 2)

FIG. 8 is a diagram of a chart showing the driving method of Embodiment Mode 2. For simplicity, the frame periods and the subframe periods are only shown for a first line of pixels and a second line of pixels.

One frame period is divided to structure subframe periods. The number of frame period divisions is arbitrary, and one frame period can also be divided into a number 1 bit subframe period $SF_1$ to a number n bit subframe period $SF_n$. However, an example of a case wherein three subframe periods are formed in one frame period is explained here for simplicity. That is, one frame period is divided into a number 1 bit subframe period to a number 3 bit subframe period.

The subframe periods appear in the order of the number 1 bit subframe period $SF_1$, the number 2 bit subframe period $SF_2$, and the number 3 bit subframe period $SF_3$ in all lines of pixels. However, the time at which the number 1 bit subframe period begins in the even number lines of pixels (for example, the number 2 line of pixels) is shifted greatly compared with the time at which the number 1 bit subframe period begins in the odd number lines of pixels (for example, the number 1 line of pixels).

The subframe periods are structured by the display periods $T_{r1}$ and $T_{r2}$, and the non-display periods $T_{d1}$ and $T_{d2}$, or by only the display period $T_{r3}$. The pixels are in a light emitting state or a non-light emitting state during the display periods, and thus display is performed. The pixels are in a non-light emitting state during the non-display periods, and thus display is not performed.

The write in periods $T_{a1}$ to $T_{a4}$ are periods necessary for inputting write in selection signals to the write in gate signal lines $G_{a1}$ to $G_{an}$.

For cases in which the write in period is longer than the display period, erasure selection signals are input to the pixels from the erasure gate signal lines after the display period ends, and the digital video signal held in the pixels is erased. Periods necessary for inputting the erasure selection signals into all desired erasure gate signal lines $G_{e1}$ to $G_{en}$ are the erasure periods $T_{e1}$ and $T_{e2}$. In Embodiment Mode 2, only the number 1 bit display period is short compared with the write in period, and therefore the erasure period $T_{e1}$ or the erasure period $T_{e2}$ is formed after the display period $T_{r1}$ in the number 1 line of pixels or the number 2 line of pixels ends.

Figure 9:
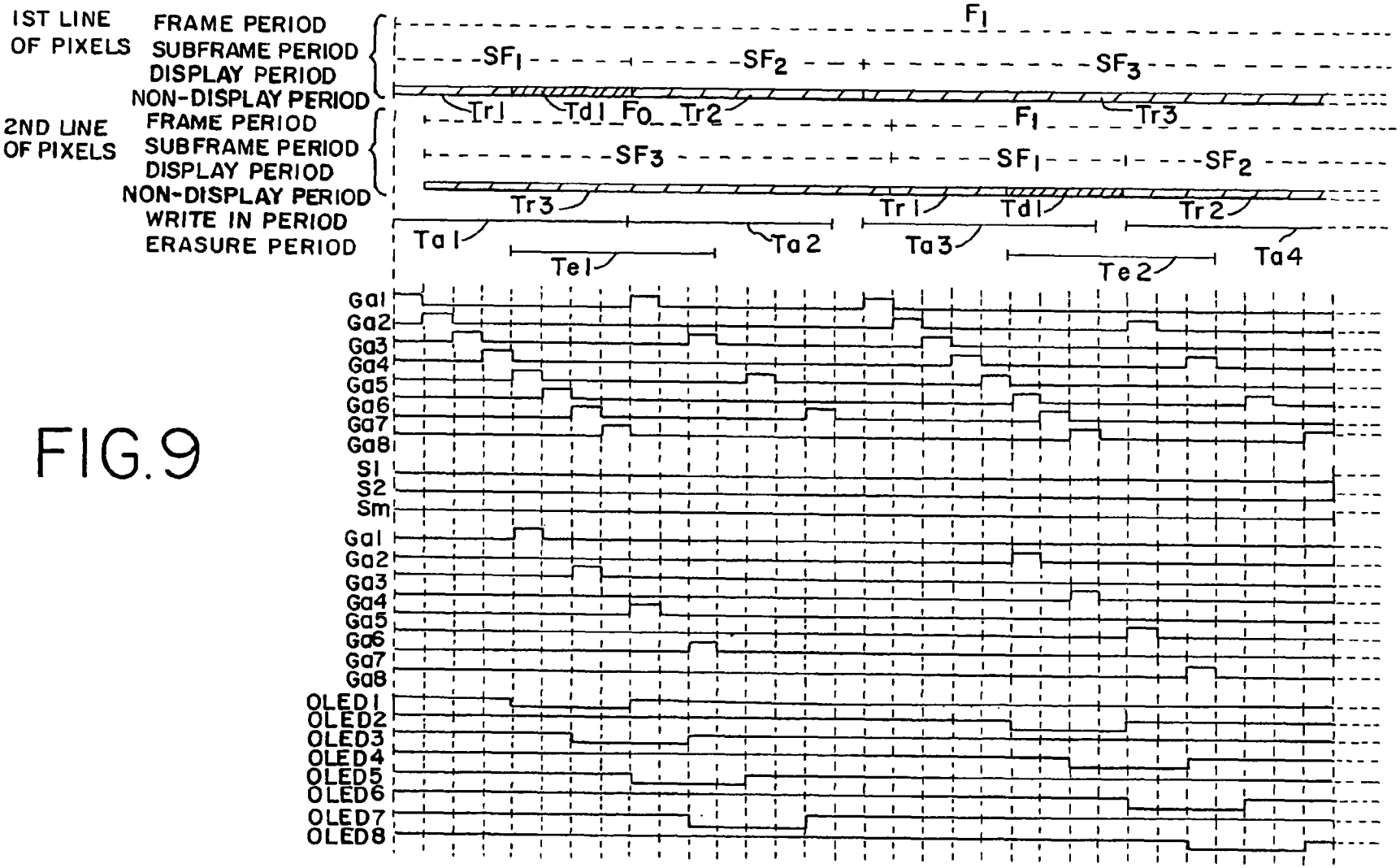
FIG. 9 is a timing chart for time division gray scale display drive (Embodiment Mode 2)

FIG. 9 is a timing chart for the drive shown by the chart of FIG. 7. The number of the write in gate signal lines and the number of the erasure gate signal lines can be determined arbitrarily with the present invention, but for simplicity, the number is reduced for the explanation here.

Further, all of the pixels are shown in the diagram as emitting light in the frame periods $F_0$ and $F_1$ for simplicity. The signals input from the source signal lines $S_1$ to $S_m$ to all of the pixels in the frame periods $F_0$ and $F_1$ are therefore the same.

The frame periods $F_0$ and $F_1$ are each divided into the subframe periods $SF_1$ to $SF_3$. The number 1 bit subframe period $SF_1$ is composed of the number 1 bit display period $T_{r1}$ and the number 1 bit non-display period $T_{d1}$. The number 2 bit subframe period $SF_2$ is composed of the number 2 bit display period $T_{r2}$. The number 3 bit subframe period $SF_3$ is composed of the number 3 bit display period $T_{r3}$.

In Embodiment Mode 2, the display periods appear in the sequence of the number 1 bit display period $T_{r1}$, the number 2 bit display period $T_{r2}$, and the number 3 bit display period $T_{r3}$ for the even number lines of pixels and the odd number lines of pixels. However, the time at which the number 1 bit display period $T_{r1}$ appears is shifted greatly between the even number lines of pixels and the odd number lines of pixels. Therefore, when the number 1 bit display period $T_{r1}$ and the number 2 bit display period $T_{r2}$ of the frame period $F_1$ are displayed in the odd number lines of pixels, display of the number 3 bit display period $T_{r3}$ of the frame period $F_0$ is performed in the even number lines of pixels.

First, a write in selection signal is input to the number 1 line write in gate signal line $G_{a1}$ from the gate signal line driver circuit. The switching TFTs of all pixels connected to the number 1 line write in gate signal line $G_{a1}$ (the number 1 line of pixels) are placed in an on state as a result. At the same time, the number 1 bit of the digital video signal for the frame period $F_1$ is input to the source signal lines $S_1$ to $S_m$ all at once from the source signal line driver circuit.

The number 1 line of pixels are thus controlled to emit light or not to emit light simultaneously with the input of the digital video signal into the number 1 line of pixels. The number 1 line of pixels perform display, and the number 1 bit display period $T_{r1}$ begins. Note that the display performed by the number 1 line of pixels is display of the number 1 bit display period $T_{r1}$ of the frame period $F_1$.

At the same time that input of the write in selection signal to the number 1 line write in gate signal line $G_{a1}$ finishes, the write in selection signal is similarly input to the number 2 line write in gate signal line $G_{a2}$. The switching TFTs of all pixels connected to the number 2 line write in gate signal line $G_{a2}$ are then placed in an on state, and the number 3 bit of the digital video signal is input to the number 2 line of pixels from the source signal lines $S_1$ to $S_m$. The number 2 line of pixels thus perform display, and the number 3 bit display period $T_{r3}$ begins. Note that the display performed by the number 2 line of pixels is display of the number 3 bit display period $T_{r3}$ of the frame period $F_0$.

Display of the number 1 bit display period $T_{r1}$ of the frame period $F_1$ is thus performed by the number 1 line of pixels, and display of the number 3 bit display period $T_{r3}$ is performed by the number 2 line of pixels.

At the same time as input of the write in selection signal to the number 2 line write in gate signal line $G_{a2}$ is completed, the write in selection signal is similarly input to the number 3 line write in gate signal line $G_{a3}$, and the number 1 bit of the digital video signal is input to the number 3 line of pixels. The number 3 line of pixels thus perform display, and the number 1 bit display period $T_{r1}$ begins. Note that the display performed by the number 3 line of pixels is display of the number 1 bit display period $T_{r1}$ of the frame period $F_1$.

At the same time as input of the write in selection signal to the number 3 line write in gate signal line $G_{a3}$ is completed, the write in selection signal is similarly input to the number 4 line write in gate signal line $G_{a4}$, and the number 3 bit of the digital video signal is input to the number 4 line of pixels. The number 4 line of pixels thus perform display, and the number 3 bit display period $T_{r3}$ of the frame period $F_0$ begins. Note that the display performed by the number 3 line of pixels is display of the number 3 bit display period $T_{r3}$ of the frame period $F_0$.

Thereafter, the number 1 bit of the digital video signal or the number 3 bit of the digital video signal is input to the number 5 line of pixels and the number 6 line of pixels, in order. A period up until the write in selection signal is input in sequence to the write in gate signal lines $G_{a1}$ to $G_{an}$, and the number 1 bit of the digital video signal or the number 3 bit of the digital video signal is input to all of the lines of pixels is the write in period $T_{a1}$.

The number 1 bit display period $T_{r1}$ is short compared with the number 1 bit write in period $T_{a1}$, and therefore it is necessary to provide the erasure period $T_{e1}$ before the write in period $T_{a1}$ is completed. An erasure selection signal is thus input from the erasure gate signal line driver circuit to only the odd number erasure gate signal lines, in parallel with the input of the number 1 bit of the digital video signal.

The erasure TFTs of all pixels connected to the number 1 line erasure gate signal line $G_{e1}$ (the number 1 line of pixels) are then placed in an on state when the erasure selection signal is input to the number 1 line erasure gate signal line $G_{e1}$. The number 1 bit of the digital video signal held by the gate electrodes of the driver TFTs is then erased by the input of the erasure selection signal.

The number 1 bit display period $T_{r1}$ of the number 1 line of pixels is completed when the number 1 bit of the digital video signal held by the number 1 line of pixels is erased, and the number 1 bit non-display period $T_{d1}$ of the frame period $F_1$ begins.

The number 1 bit display periods $T_{r1}$ are equal for the number 1 line of pixels and the number 3 line of pixels, and therefore the write in selection signal is input to the number 3 line erasure gate signal line $G_{a3}$ following a predetermined period of time after input of the erasure gate signal to the number 1 line erasure gate signal line $G_{e1}$ is finished. The number 1 bit display period $T_{r1}$ ends in the number 3 line of pixels when the erasure selection signal is input to the number 3 line erasure gate signal line $G_{e3}$, and the number 1 bit non-display period $T_{d1}$ of the frame period $F_1$ begins.

Thereafter, the number 1 bit of the digital video signal held by the odd number lines of pixels is erased in the order of the number 5 line of pixels and the number 7 line of pixels. A period up until the erasure selection signal is input in sequence to all of the odd number erasure gate signal lines, and the number 1 bit of the digital video signal held in all of the odd number lines of pixels is erased is the erasure period $T_{e1}$.

All of the even number lines of pixels perform display of the number 3 bit display period $T_{r3}$ of the frame period $F_0$ during the erasure period $T_{e1}$, and therefore the erasure signal is not input during the erasure period $T_{e1}$.

The write in period $T_{a1}$ ends, and the write in period $T_{a2}$ begins, while erasure of the number 1 bit of the digital video signal held in the odd number lines of pixels is performed during the erasure period $T_{e1}$. The write in selection signal is then input to the number 1 line write in gate signal line $G_{a1}$, and all of the switching TFTs connected to the number 1 line write in gate signal line $G_{a1}$ are placed in an on state. At the same time, the number 2 bit of the digital video signal is input from the source signal lines $S_1$ to $S_m$. The number 1 line of pixels again perform display as a result, the number 1 bit non-display period $T_{d1}$ ends, and the number 2 bit display period $T_{r2}$ begins. Note that the display performed by the number 1 line of pixels is display of the number 2 bit display period $T_{r2}$ of the frame period $F_1$.

Next, the number 2 bit display period $T_{r2}$ of the number 1 line of pixels and the number 2 bit display period $T_{r2}$ of the number 3 line of pixels are equal, and therefore the write in selection signal is input to the number 3 line write in gate signal line $G_{a2}$ following a predetermined period of time after input of the write in selection signal to the number 1 line write in gate signal line $G_{a1}$ is completed. Note that the display performed by the number 3 line of pixels is display of the number 2 bit display period $T_{r2}$ of the frame period $F_1$.

Thereafter, the number 2 bit of the digital video signal is input to the number 5 line of pixels and the number 7 line of pixels in order. A period up until the write in selection signal is input to the write in gate signal lines $G_{a1}$ to $G_{an}$, and the number 2 bit of the digital video signal is input to all of the odd number lines of pixels is the write in period $T_{a2}$.

Display of the number 3 bit display period $T_{r3}$ of the frame period $F_0$ is performed during the write in period $T_{a2}$ of the odd number lines of pixels.

The write in period $T_{a2}$ ends when the number 2 bit of the digital video signal is input to the final odd number line of pixels, and after a predetermined period of time, the write in period $T_{a3}$ begins. Note that the display performed by the final odd number line of pixels is display of the number 2 bit display period $T_{r2}$ of the frame period $F_1$. The write in selection signal is then input to the number 1 line write in gate signal line $G_{a1}$, and the number 3 bit of the digital video signal is input to the number 1 line of pixels. As a result, the number 2 bit display period $T_{r2}$ ends, and the number 3 bit display period $T_{r3}$ begins, in the number 1 line of pixels.

Next, the write in selection signal is input to the number 2 line write in gate signal line $G_{a2}$ from the gate signal line driver circuit, and the number 1 bit of the digital video signal is input from the source signal lines. The number 2 bit display period $T_{r2}$ of the frame period $F_0$ ends, and the number 1 bit display period $T_{r1}$ of the frame period $F_1$ begins, in the number 2 line of pixels as a result.

The number 3 bit display period $T_{r3}$ of the frame period $F_1$ thus begins in the number 1 line of pixels, and the number 1 bit display period $T_{r1}$ of the frame period $F_1$ begins in the number 2 line of pixels.

Next, the number 3 bit of the digital video signal is input to the pixels of the number 3 line write in gate signal line $G_{a3}$. The number 2 bit display period $T_{r2}$ ends, and the number 3 bit display period $T_{r3}$ begins, in the number 3 line of pixels. Note that the display performed by the number 3 line of pixels is display of the number 3 bit display period $T_{r3}$ of the frame period $F_1$.

In addition, the number 1 bit of the digital video signal is input to the pixels of the number 4 line write in gate signal line $G_{a4}$. The number 3 bit display period $T_{r3}$ of the frame period $F_0$ ends, and the number 1 bit display period $T_{r1}$ of the frame period $F_1$ begins, in the number 4 line of pixels.

The digital video signal is subsequently input to the number 5 line of pixels and the number 6 line of pixels. The number 3 bit of the digital video signal is input to the odd number lines of pixels, and the number 3 bit display period $T_{r3}$ of the frame period $F_0$ begins. In the even number lines of pixels, the number 1 bit of the digital video signal of the frame period $F_1$ is input, and the number 1 bit display period $T_{r1}$ begins. A period up until the number 3 bit of the digital video signal or the number 1 bit of the digital video signal is input to all of the pixels is the write in period $T_{a3}$.

The number 1 bit display period $T_{r1}$ is short compared with the write in period $T_{a3}$, and therefore it is necessary to form the erasure period $T_{e2}$ before the write in period $T_{a3}$ ends, and to erase the number 1 bit of the digital video signal held in the even number lines of pixels. The erasure selection signal is therefore input to only the even number erasure gate signal lines in the erasure period $T_{e2}$.

First, the erasure selection signal is input to the number 2 line erasure gate signal line $G_{e2}$ from the erasure gate signal line driver circuit. The number 1 bit display period $T_{r1}$ therefore ends and the number 1 bit non-display period $T_{d1}$ begins in the number 2 line of pixels.

The number 1 bit display period $T_{r1}$ for the number 2 line of pixels is equal to the number 1 bit display period $T_{r1}$ for the number 4 line of pixels, and therefore the erasure selection signal is input to the number 4 line erasure gate signal line $G_{e4}$ following a predetermined period of time after input of the erasure selection signal to the number 2 line erasure gate signal line $G_{e2}$ is completed.

Thereafter, the erasure selection signal is input to the even number erasure gate signal lines of the number 6 line of pixels and the number 8 line of pixels, in order. A period up until the even number erasure gate signal lines are selected in sequence, and the number 1 bit of the digital video signal held by all of the even number lines of pixels is erased, is the erasure period $T_{e2}$.

The write in period $T_{a3}$ ends, and the write in period $T_{a4}$ begins, while erasure of the number 1 bit of the digital video signal held in the even number lines of pixels is performed in the erasure period $T_{e2}$. The write in selection signal is then input to the number 2 line write in gate signal line $G_{a2}$, and all of the switching TFTs connected to the number 2 line write in gate signal line $G_{a2}$ are placed in an on state. At the same time, the number 2 bit of the digital video signal is input from the source signal lines $S_1$ to $S_m$. As a result, the number 2 line of pixels again perform display, the number 1 bit non-display period $T_{d1}$ ends, and the number 2 bit display period $T_{r2}$ begins. Note that the display performed by the even number lines of pixels is display of the number 2 bit display period $T_{r2}$ of the frame period $F_1$.

The digital video signal is subsequently input to the number 4 line of pixels and the number 6 line of pixels. The number 2 bit of the digital video signal is input to the even number lines of pixels, and the number 2 bit display period $T_{r2}$ begins. A period up until the number 2 bit of the digital video signal is input to all of the even number lines of pixels is the write in period $T_{a4}$.

The appearance of the number 1 bit display period $T_{r1}$, the number 2 bit display period $T_{r2}$, and the number 3 bit display period $T_{r3}$ Of the frame period $F_1$ for the odd number lines of pixels, and the appearance of the number 3 bit display period $T_{r3}$ of the frame period $F_0$, and the number 1 bit display period $T_{r1}$ and the number 2 bit display period $T_{r2}$ of the frame period $F_1$ for the even number lines of pixels are explained as stated above. Thereafter, the display periods $T_{r1}$ to $T_{r3}$ are made to appear in a similar order, and an image is displayed continuously. The times at which the frame periods begin in the even number lines of pixels and the odd number lines of pixels, namely the times at which arbitrary subframe periods begin, can thus be shifted greatly.

In accordance with Embodiment Mode 2, it is possible to reduce the surface area of portions continuously emitting light, or continuously not emitting light, to a level that the portions are not perceivable by the resolution of human eyes, and display disturbances due to false contouring can be suppressed. In addition, false contouring can be reduced without increasing the number of divisions of the subframe periods. It is therefore possible to improve display quality without depending upon the driver performance of the driver circuit, and a good display quality can be achieved without increasing electric power consumption.

Note that it is possible to combine Embodiment Mode 2 with Embodiment Modes 5 and 6.

Embodiment Mode 3

In Embodiment Mode 3, the order of appearance of subframe periods, and the time at which the subframe periods begin, are changed between odd number lines of pixels and even number lines of pixels.

Figure 10:
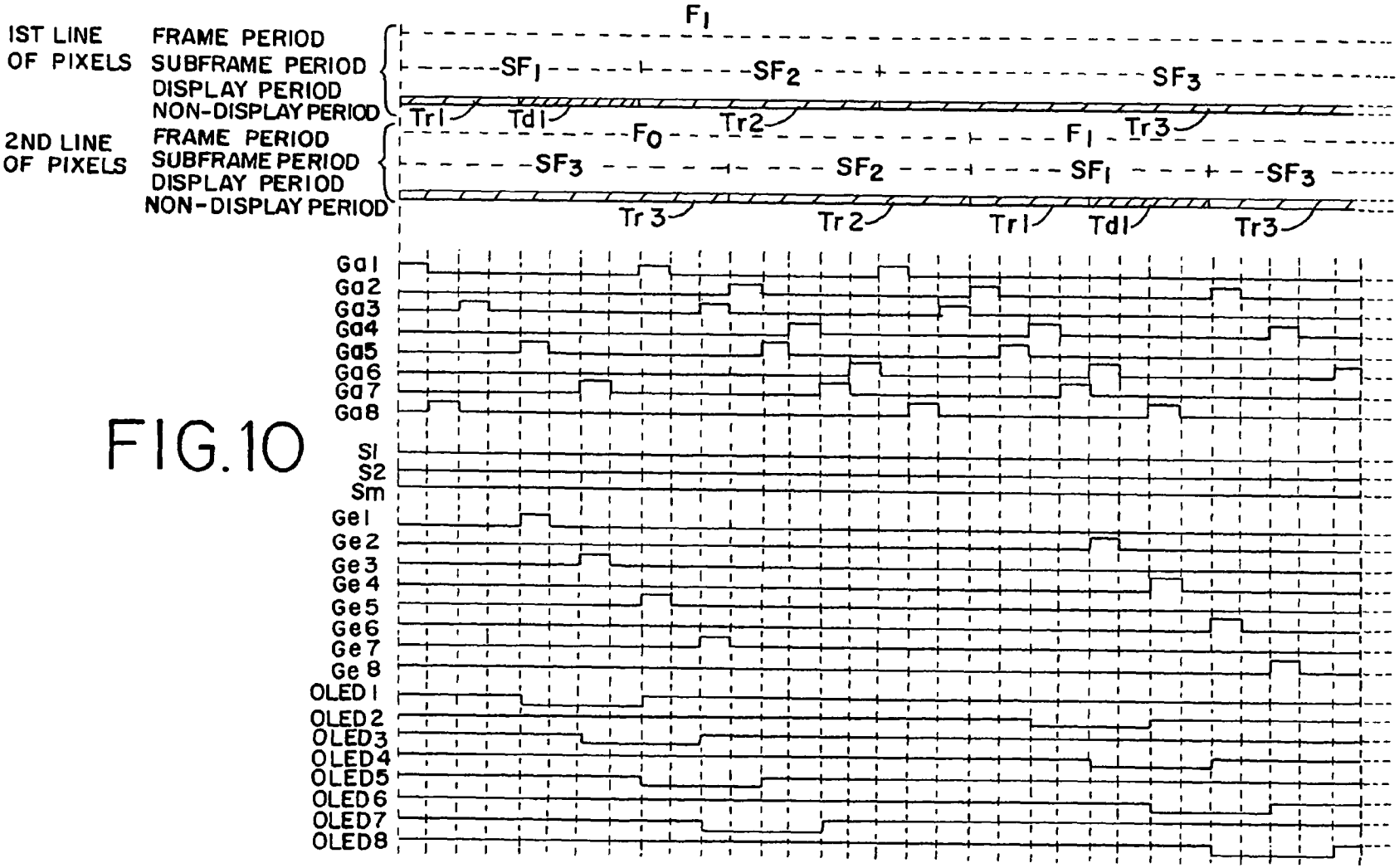
FIG. 10 is a timing chart for time division gray scale display drive (Embodiment Mode 3)

The structure of Embodiment Mode 3 is explained using FIG. 10. Elements that are the same as those of FIG. 5 and FIG. 9 have the same reference numerals attached. The frame periods, the subframe periods, the display periods, and the non-display periods for the number 1 line of pixels, and the frame periods, the subframe periods, the display periods, and the non-display periods for the number 2 line of pixels are shown for convenience of description in the figure.

The subframe periods appear in the frame period $F_1$ in a sequence of the number 1 bit subframe period $SF_1$, the number 2 bit subframe period $SF_2$, and the number 3 bit subframe period $SF_3$ in the odd number lines of pixels (the number 1 line of pixels, for example).

The subframe periods appear in the frame period in a sequence of the number 1 bit subframe period $SF_1$, the number 3 bit subframe period $SF_3$, and the number 2 bit subframe period $SF_2$ in the even number lines of pixels (the number 2 line of pixels, for example).

The times at which the frame periods begin in the odd number lines of pixels (for example, the number 1 line of pixels) and in the even number lines of pixels (for example, the number 2 line of pixels) differ greatly. The number 1 bit subframe period is formed in the beginning of the frame period here, and therefore the times at which the number 1 bit subframe period begins in the odd number lines of pixels and the even number lines of pixels differ greatly. As such, the times at which the pixels emit light and do not emit light when displaying the same gray scale also differ greatly.

The number 1 bit subframe period is structured by the number 1 bit display period $T_{r1}$ and the number 1 bit non-display period $T_{d1}$. The number 2 bit subframe period is structured by only the number 2 bit display period $T_{r2}$. The number 3 bit subframe period is structured by only the number 3 bit display period $T_{r3}$.

Embodiment Mode 3 can be achieved by the timing chart of FIG. 10 showing various types of signals. Elements that are the same as Embodiment Modes 1 and 2 have the same reference numerals attached. Further, for simplicity, the figure shows all of the light emitting elements of all pixels emitting light during the frame period $F_1$, and none of the light emitting elements of the pixels emitting light during the frame period $F_2$. The signals input from the source signal lines $S_1$ to $S_m$ in the frame period $F_1$ and the frame period $F_2$ are therefore the same for all of the pixels.

The order of appearance of subframe periods, and the time at which the subframes appear in the odd number lines and even number lines of pixels, are explained below using signals input to the write in gate signal lines $G_{a1}$ to $G_{a8}$, the source signal lines $S_1$ to $S_m$, the erasure gate signal lines $G_{e1}$ to $G_{e8}$, and light emitting elements $OLED_1$ to $OLED_8$. For simplicity, only the first line of pixels and the second line of pixels are explained.

First, an explanation relating only to the subframe periods appearing in the number 1 line of pixels is given below. The number 1 bit subframe period $SF_1$, the number 2 bit subframe period $SF_2$, and the number 3 bit subframe period $SF_3$ are shown in the figure for the number 1 line of pixels.

The number 1 bit subframe period $SF_1$ begins after the number 1 bit of the digital video signal is input to the pixels when the write in selection signal is input to the number 1 line write in gate signal line $G_{a1}$. The number 1 bit display period $T_{r1}$ begins at the same time as the number 1 bit subframe period $SF_1$ begins. The number 1 bit display period $T_{r1}$ ends when the erasure selection signal is input to the number 1 line erasure gate signal line $G_{e1}$, and the number 1 bit non-display period $T_{d1}$ begins.

The number 1 bit non-display period $T_{d1}$ of the number 1 bit subframe period $SF_1$ ends when the write in selection signal is input to the number 1 line write in gate signal line $G_{a1}$ and the number 2 bit of the digital video signal is input to the pixels. The number 2 bit subframe period $SF_2$ begins when the number 2 bit of the digital video signal is input to the pixels, and the number 2 bit display period $T_{r2}$ begins at the same time.

The number 2 bit display period $T_{r2}$ of the number 2 bit subframe period $SF_2$ ends when the write in selection signal is input to the number 1 line write in gate signal line Gal and the number 3 bit of the digital video signal is input to the pixels. The number 3 bit subframe period $SF_3$ begins when the number 3 bit of the digital video signal is input to the pixels, and the number 3 bit display period $T_{r3}$ begins at the same time.

Although not shown in the figure, the number 3 bit display period $T_{r3}$ of the number 3 bit subframe period $SF_3$ ends when the write in selection signal is input to the number 1 line write in gate signal line $G_{a1}$ and the number 1 bit of the digital video signal is input to the pixels. The number 1 bit subframe period $SF_1$ of the new frame period $F_2$ begins when the number 1 bit of the digital video signal is input to the pixels.

In the odd number lines of pixels (the number 1 line of pixels, for example), the number 1 bit subframe period $SF_1$, the number 2 bit subframe period $SF_2$, and the number 3 bit subframe period $SF_3$ appear in order in the respective frame periods.

Next, the number 1 bit subframe period $SF_1$, the number 3 bit subframe period $SF_3$, and the number 2 bit subframe period $SF_2$ appear in this sequence in the number 2 line of pixels for each of the frame periods.

In the number 2 line of pixels, the number 3 bit subframe period $SF_3$ and the number 2 bit subframe period $SF_2$ of the frame period $F_0$, and the number 1 bit subframe period $SF_1$ and the number 3 bit subframe period $SF_3$ of the frame period $F_1$ are shown in the figure for convenience. Display of the frame period $F_1$ is performed in the number 2 line of pixels when the frame period $F_0$ begins in the number 1 line of pixels.

The number 3 bit display period $T_{r3}$ of the number 3 bit subframe period $SF_3$ of the frame period $F_0$ ends when the write in selection signal is input to the write in gate signal line $G_{a2}$ and the number 2 bit of the digital video signal is input to the pixels. The number 2 bit subframe period $SF_2$ begins when the number 2 bit of the digital video signal is input to the pixels, and the number 2 bit display period $T_{r2}$ begins at the same time.

The number 2 bit display period $T_{r2}$ of the number 2 bit subframe period $SF_2$ of the frame period $F_0$ ends when the write in selection signal is input to the number 2 line write in gate signal line $G_{a2}$ and the number 1 bit of the digital video signal is input to the pixels. The number 1 bit subframe period SE of the new frame period $F_1$ begins when the number 1 bit of the digital video signal is input to the pixels, and the number 1 bit display period $T_{r1}$ begins at the same time. The time at which the number 1 bit subframe period begins is thus shifted greatly in the number 2 line of pixels compared to the number 1 line of pixels.

The number 1 bit display period $T_{r1}$ of the number 1 bit subframe period SF ends when input of the erasure selection signal to the number 2 line erasure gate signal line $G_{e2}$ begins. The number 1 bit non-display period $T_{d1}$ of the number 1 bit subframe period $SF_1$ begins when the erasure selection signal is input to the pixels.

The number 1 bit non-display period $T_{d1}$ of the number 1 bit subframe period $SF_1$ ends when the write in selection signal is input to the number 2 line write in gate signal line $G_{e2}$ and the number 3 bit of the digital video signal is input to pixels. The number 3 bit display period $T_{r3}$ of the number 3 bit subframe period $SF_3$ begins when the number 3 bit of the digital video signal is input to the pixels.

Although not shown in the figure, the number 3 bit display period $T_{r3}$ of the number 3 bit subframe period $SF_3$ ends when write in selection signal is input to the number 2 line write in gate signal line $G_{e2}$ and the number 2 bit of the digital video signal is input to the pixels. The number 2 bit display period $T_{r2}$ of the number 2 bit subframe period $SF_2$ begins when the number 2 bit of the digital video signal is input to the pixels.

In the even number lines of pixels, the number 1 bit subframe period $SF_1$, the number 3 bit subframe period $SF_3$, and the number 2 bit subframe period $SF_2$ appear in this sequence during the respective frame periods. The order in which the subframe periods appear in the even number lines of pixels is thus different from the order in which they appear in the odd number lines of pixels. In addition, the time at which a frame period G begins is shifted greatly between the even number lines of pixels and the odd number lines of pixels.

Similar to Embodiment Modes 1 and 2, the time at which the pixels emit light is different for adjacent to each other, and therefore the continuous perception of a pixel non-light emitting state or a pixel light emitting state can be prevented when the line of sight moves in portions at which the gray scale changes, and when the gray scale changes during dynamic display in accordance with the drive of Embodiment Mode 3. The generation of unnatural light lines and unnatural dark lines can therefore be suppressed, and display disturbances due to false contouring are reduced.

In addition, false contouring can be reduced without increasing the number of subframe period divisions, and therefore it is possible to improve the display quality without depending upon the drive performance of the driver circuit, and good display quality can be achieved without increasing the amount of electric power consumption.

Note that it is possible to combine Embodiment Mode 3 with Embodiment Modes 5 and 6.

Embodiment Mode 4

The order of appearance of subframe periods, and the times at which the subframe periods begin, are changed in Embodiment Mode 4 to be per four lines. Embodiment Mode 4 is explained with reference to FIG. 11.

Figure 11:
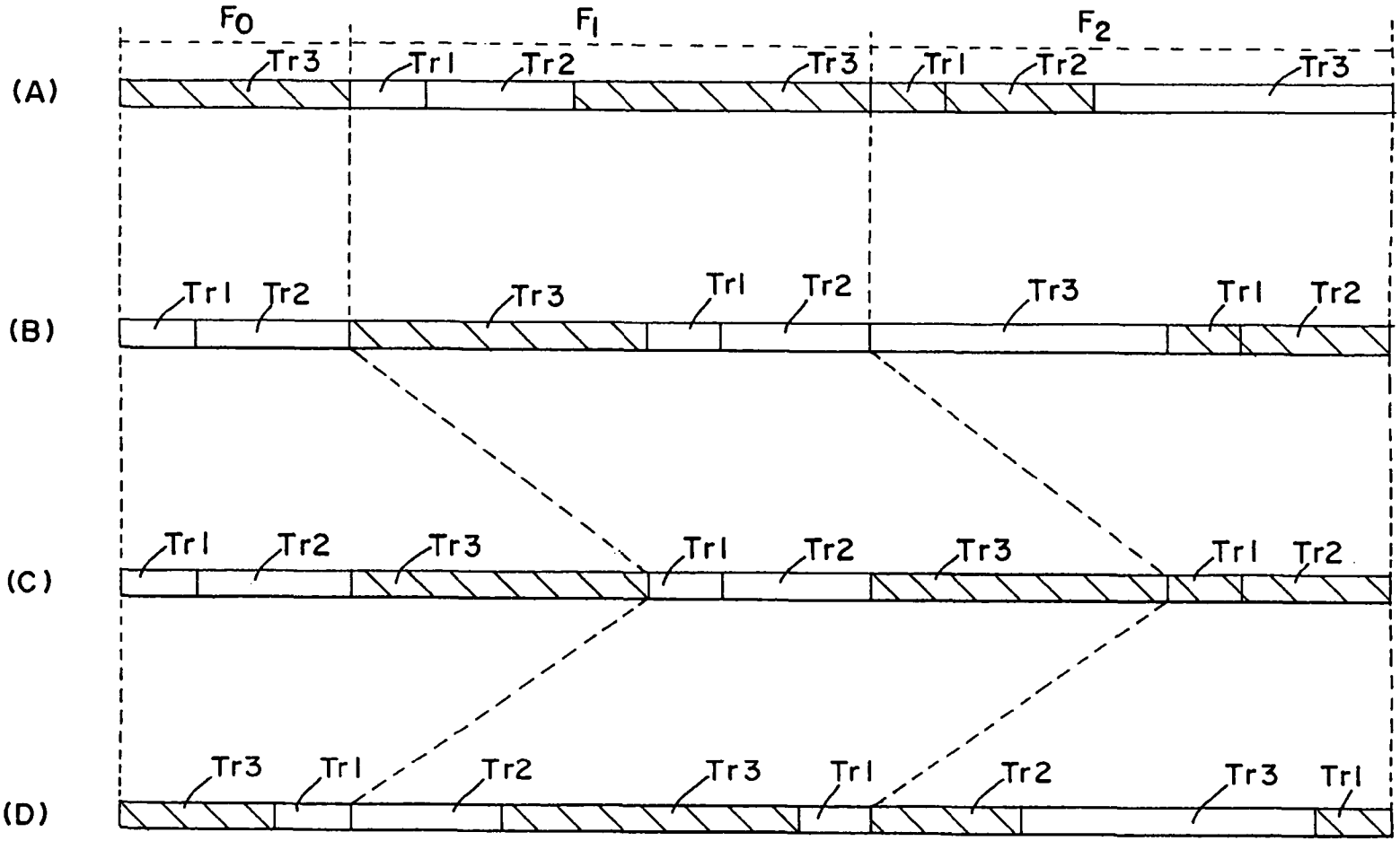
FIG. 11 shows timing charts for time division gray scale display drive (Embodiment Mode 4)

Lines A to D of FIG. 11 are diagrams showing frame periods and display periods for each line of pixels. Note that the frame periods are divided into a plurality of subframe periods. The subframe periods are structured by a display period, or a display period and a non-display period. The lengths of time for each of the display periods differ, and gray scales are controlled by summing the lengths of time of the display periods during which light emission is performed.

A number 1 bit subframe period contains the number 1 bit display period $T_{r1}$, a number 2 bit subframe period contains the number 2 bit display period $T_{r2}$, and a number 3 bit subframe period contains the number 3 bit display period $T_{r3}$.

Further, the subframe periods also have non-display periods, not only display periods, for cases in which the display period is short compared to the subframe period. For simplicity, an explanation is given with only the frame periods and the display periods shown in lines A to D of FIG. 11. Pixels arranged in an m column×n row matrix shape, and the subframe periods appearing in the pixels are explained in Embodiment Mode 4.

Line A of FIG. 11 shows the order of appearance of the subframe periods in a number 4x+1 line of pixels (where x is an integer equal to or greater than 0, and $1 \leqq 4x+1 \leqq n$), and the time at which the subframe periods begin. The subframe periods appear in the number 4x+1 line of pixels, namely the pixels having a number 4x+1 line gate signal line, in a sequence of the number 1 bit subframe period, the number 2 bit subframe period, and the number 3 bit subframe period. The display periods corresponding to the respective subframe periods therefore appear in a sequence of the number 1 bit display period $T_{r1}$, the number 2 bit display period $T_{r2}$, and the number 3 bit display period $T_{r3}$.

Line B of FIG. 11 shows the order of appearance of the subframe periods in a number 4x+2 line of pixels (where x is an integer equal to or greater than 0, and $2 \leqq 4x+2 \leqq n$), and the time at which the subframe periods begin. The subframe periods appear in the number 4x+2 line of pixels, namely the pixels having a number 4x+2 line gate signal line, in a sequence of the number 3 bit subframe period, the number 1 bit subframe period, and the number 2 bit subframe period. The display periods corresponding to the respective subframe periods therefore appear in a sequence of the number 3 bit display period $T_{r3}$, the number 1 bit display period $T_{r1}$, and the number 2 bit display period $T_{r2}$.

Line C of FIG. 11 shows the order of appearance of the subframe periods in a number 4x+3 line of pixels (where x is an integer equal to or greater than 0, and $3<4x+3<n$), and the time at which the subframe periods begin. The subframe periods appear in the number 4x+3 line of pixels, namely the pixels having a number 4x+3 line gate signal line, in a sequence of the number 1 bit subframe period, the number 2 bit subframe period, and the number 3 bit subframe period. The display periods corresponding to the respective subframe periods therefore appear in a sequence of the number 1 bit display period $T_{r1}$, the number 2 bit display period $T_{r2}$, and the number 3 bit display period $T_{r3}$. The order in which the number 1 bit display period $T_{r1}$ to the number 3 bit display period $T_{r3}$ appear is the same in the number 4x+1 line of pixels and the number 4x+3 line of pixels, but the times at which the frame periods begin, that is the times at which the number 1 bit display periods $T_{r1}$ begin, are shifted greatly between the number 4x+1 line of pixels and the number 4x+3 line of pixels.

Line D of FIG. 11 shows the order of appearance of the subframe periods in a number 4x+4 line of pixels (where x is an integer equal to or greater than 0, and $4<4x+4<n$), and the time at which the subframe periods begin. The subframe periods appear in the number 4x+4 line of pixels, namely the pixels having a number 4x+4 line gate signal line, in a sequence of the number 2 bit subframe period, the number 3 bit subframe period, and the number 1 bit subframe period. The display periods corresponding to the respective subframe periods therefore appear in a sequence of the number 2 bit display period $T_{r2}$, the number 3 bit display period $T_{r3}$, and the number 1 bit display period $T_{r1}$.

Lines A to D of FIG. 11 show an example in which display of the number 3 gray scale is performed in the frame periods $F_0$ and $F_1$, and display of the number 4 gray scale is performed in the frame period $F_2$. When non-light emitting display periods appear continuously, as in the number 4x+1 line of pixels shown in line A of FIG. 11 wherein the non-light emitting number 3 bit display period $T_{r3}$ appears in the frame period $F_1$, and the non-light emitting number 1 bit display period $T_{r1}$ and the non-light emitting number 2 bit display period $T_{r2}$ appear in the frame period $F_2$, the following occurs. The light emitting display periods $T_{r1}$, $T_{r2}$, and $T_{r3}$ are continuous in the number 4x+2 line of pixels shown in line B of FIG. 11, the light emitting display periods $T_{r1}$ and $T_{r2}$, and the non-light emitting display period $T_{r3}$ appear in the number 4x+3 line of pixels shown in line C of FIG. 11, and the non-light emitting display period $T_{r3}$, the light emitting display period $T_{r1}$, and the non-light emitting display period $T_{r2}$ appear in the number 4x+4 line of pixels shown in line D of FIG. 11.

Light emitting display periods and non-light emitting display periods appear in adjacent pixels, and therefore the brightness of these pixels is seen as averaged by human eyes. The generation of unnatural light lines or unnatural dark lines is suppressed when switching gray scales during dynamic display.

A case of performing dynamic display is taken as an example, but light emitting display periods and non-light emitting display periods also appear in adjacent pixels when performing display of a static image, and therefore the summation by human eyes of only the brightness of light emitting pixels, or only the brightness of non-light emitting pixels, following movement of the line of sight, can be prevented. Display disturbances due to false contours are thus suppressed.

The order of appearance of the subframe periods, and the times at which the subframe periods begin may of course be changed at periods equal to or greater than four lines of pixels, and may also be changed at random, with no periodicity. This may be determined in consideration of visibility.

In accordance with Embodiment Mode 4, it is possible to reduce the surface area of portions continuously emitting light, or continuously not emitting light, to a level not perceivable by the resolution of human eyes, and display disturbances due to false contouring can be suppressed. In addition, false contouring can be reduced without increasing the number of divisions of the subframe periods. It is therefore possible to improve display quality without depending upon the driver performance of the driver circuit, and a good display quality can be achieved without increasing electric power consumption.

It is possible to combine Embodiment Mode 4 with Embodiment Modes 5 and 6.

Embodiment Mode 5

Figure 12:
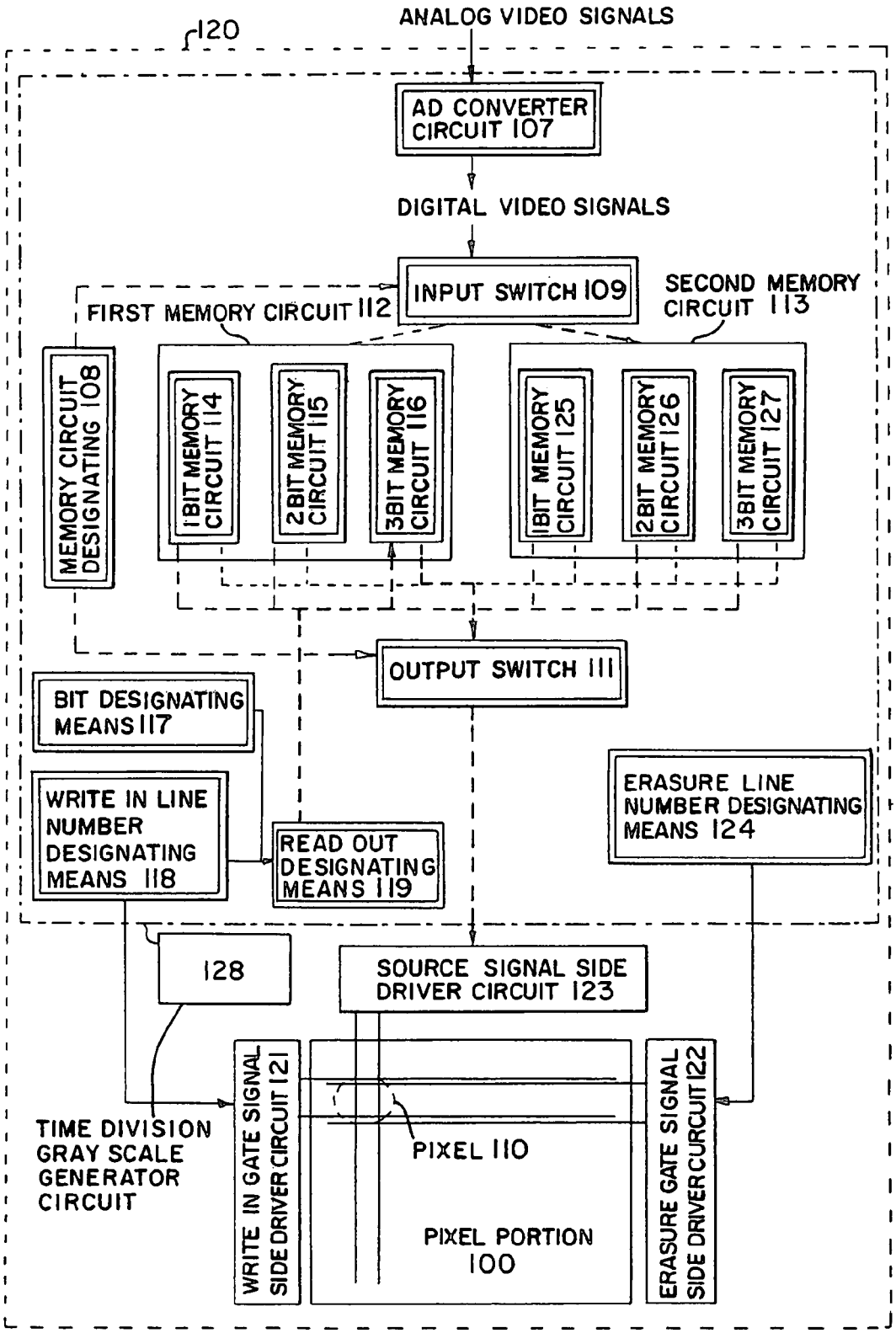
FIG. 12 is a diagram showing an example of an organic light emitting display driver circuit of the present invention (Embodiment Mode 5)

An example of a driver circuit for inputting signals into pixels is shown with reference to FIG. 12. FIG. 12 is a block diagram showing an example of a structure of an organic light emitting display of Embodiment Mode 5.

An organic light emitting display 120 of Embodiment Mode 5 has a pixel portion 100 and a driver circuit portion formed on the same insulating surface (glass). Pixels 110 are arranged in a matrix shape in the pixel portion. The driver circuit portion has a write in gate signal side driver circuit 121, an erasure gate signal side driver circuit 122, and a source signal side driver circuit 123. Note that the drive of Embodiment Mode 5 is performed by signals output from a time division gray scale signal generator circuit 128 mounted in an IC chip.

An analog video signal input to the organic light emitting display 120 is input to an AD converter circuit 107 and converted to a digital video signal.

For example, for a case of performing 3-bit display by gray scales 1 to 8, the analog video signal is converted to a number 1 bit of a digital video signal to a number 3 bit of the digital video signal.

The number 1 bit of the digital video signal to the number 3 bit of the digital video signal have "0" or "1" information. If the number 1 bit of the digital video signal to the number 3 bit of the digital video signal have "0" information, then the pixels to which the number 1 bit of the digital video signal to the number 3 bit of the digital video signal are input will emit light. Conversely, if the number 1 bit of the digital video signal to the number 3 bit of the digital video signal have "1" information, then the pixels to which the number 1 bit of the digital video signal to the number 3 bit of the digital video signal are input will not emit light.

For example, the number 1 bit of the digital video signal that is the least significant bit, has "1" information, the number 2 bit of the digital video signal has "1" information, and the number 3 bit of the digital video signal has "0" information for cases of performing display of the number 3 gray scale.

For the number 1 bit of the digital video signal to the number 3 bit of the digital video signal of one image, an input switch over 109 switches in order to input the digital video signal into a first memory circuit 112 or a second memory circuit 113, in correspondence with a designation from a memory circuit designating means 108. The explanation is given here assuming that the number 1 bit of the digital video signal to the number 3 bit of the digital video signal are stored in the first memory circuit 112.

The first memory circuit 112 stores the digital video signal of one image. The first memory circuit 112 has a number 1 bit memory circuit, a number 2 bit memory circuit, . . . , and a number n bit memory circuit. For simplification, the explanation is given with a number 1 bit memory circuit to a number 3 bit memory circuit formed in the first memory circuit 112 in Embodiment Mode 5.

The number 1 bit of the digital video signal is stored in a number 1 bit memory circuit 114. Further, the number 2 bit of the digital video signal is stored in a number 2 bit memory circuit 115, and the number 3 bit of the digital video signal is stored in a number 3 bit memory circuit 116.

After the digital video signal of one image is stored in the first memory circuit, the input switch over 109 designates the second memory circuit 113 corresponding to a designation of the memory circuit designating means 108, and the newly input digital video signal is input to the second memory circuit 113.

At the same time, an output switch over 111 designates the first memory circuit 112 corresponding to a designation of the memory circuit designating means, and the number 1 bit of the digital video signal to the number 3 bit of the digital video signal stored in the first memory circuit 112 are read out in order from the first memory circuit to the source signal line driver circuit.

At the same time, a write in line number designating means (a first line number designating means) 118 designates a line number, and the line number designated by the first line number designating means 118 is input to the write in gate signal line driver circuit 121 and a read out designating means 119.

At the same time, a bit designating means (also referred to as a memory circuit designating means) 117 designates one memory circuit from among the number 1 bit memory circuit to the number 3 bit memory circuit of the first memory circuit. The explanation is given below assuming that the bit designating means designates the number 1 bit memory circuit. The number 1 bit of the digital video signal having "0" or "1" information for each pixel is stored in the number 1 bit memory circuit. Addresses for each pixel are determined by a line number and a column number, and the number 1 bit of the digital video signal for all pixels having the line number designated by the first line number designating means 118 is input to the source signal line driver circuit 123, through the output switch over 111.

The write in gate signal line driver circuit 121 and the source signal line driver circuit 123 select the pixels into which the number 1 bit of the digital video signal is input, the number 1 bit of the digital video signal is input to these pixels, and display of the number 1 bit subframe period is performed.

Note that, for cases in which the bit designating means designates the number 2 bit memory circuit instead of the number 1 bit memory circuit, the number 2 bit of the digital video signal of all pixels having the line number designated by the first line number designating means 118 is input to the source signal line driver circuit 123. The number 2 bit of the digital video signal determines whether the pixels emit light or do not emit light in the number 2 bit subframe period, and display of the number 2 bit subframe period is performed.

Also, for cases in which the bit designating means designates the number 3 bit memory circuit instead of the number 1 bit memory circuit, the number 3 bit of the digital video signals of all pixels having the line number designated by the first line number designating means 118 are all input to the source signal line driver circuit 123. The number 3 bit of the digital video signal determines whether the pixels emit light or do not emit light in the number 3 bit subframe period, and display of the 3 bit subframe period is performed.

If the amount of time that the pixels emit light in the number 1 bit subframe period is taken as $T_{r1}$, the amount of time that the pixels emit light in the number 2 bit subframe period is taken as $T_{r2}$, and the amount of time that the pixels emit light in the number 3 bit subframe period is taken as $T_{r3}$, then $T_{r1}:T_{r2}:T_{r3}=2^0:2^1:2^2$. The gray scale is determined by summing the amounts of time that light is emitted during one frame period. Note that it is also possible to perform display by time division gray scales by forming the number 1 bit subframe period to the number 3 bit subframe period one at a time, and it is also possible to perform display by time division gray scales by forming any two or more of the number 1 bit subframe period to the number 3 bit subframe period.

The pixel lines can thus be designated in an arbitrary order by specifying the line number and the bit number by the first line number designating means and the bit designating means, based upon a desired design, and arbitrary bit subframe periods can be made to appear in the designated pixels.

On the other hand, a frame designating means designates the second memory circuit 113 while the digital video signal of the one image is being output to the pixels from the first memory circuit, and a new one image portion of the digital video signal is input to the second memory circuit. The number 1 bit of the digital video signal is input to a number 1 bit memory circuit 125. The number 2 bit of the digital video signal is input to a number 2 bit memory circuit 126, and the number 3 bit of the digital video signal is input to a number 3 bit memory circuit 127.

Display of the first image ends when read out of the digital video signal of the first memory circuit is completed. Next, read out of the digital video signal data from the second memory circuit begins, and display of a second image begins. The frame designating means designates the first memory circuit 112 while the digital video signal of the second image is being output to the pixels from the second memory circuit, and a new one image portion of the digital video signal is input to the first memory circuit, through the input switch over 109.

The above stated operations are repeated, and an image is displayed.

For example, design is performed so that the line number is specified in increasing order from the number 1 line to the number n line, the bit designating means designates a number 2 bit storing means when the odd number line numbers (the number 1 line number) are designated, and the bit designating means designates a number 3 bit storing means when the even number line numbers (the number 2 line number) are designated, By doing so, the number 2 bit subframe period can be made to appear in the odd number lines of pixels, and next, the number 3 bit subframe period can be made to appear in the even number lines of pixels.

As another example, the odd number line numbers are specified in increasing order from the number 1 line number to the number n line number when the bit designating means designates a number 1 bit storing means. Next, after a predetermined period of time, the even number line numbers are specified in increasing order from the number 1 line number to the number n line number when the bit designating means designates the number 1 bit storing means. The number 1 bit subframe period thus begins only in the odd number lines of pixels, and after the number 1 bit subframe period has finished in all of the odd number lines of pixels, it then becomes possible for the number 1 bit subframe period to begin in the even number lines of pixels.

Note that line number specification may also be performed in descending order instead of increasing order. Further, the line number may also be specified in random order.

There are two methods, roughly speaking, for ending the subframe periods. First, for cases in which the display period is shorter than the subframe period, the line numbers are designated by an erasure line number designating means (second line number designating means) 124, and if the line number designated by the second line number designating means is input to the erasure gate signal line driver circuit 122, then the subframe periods of all pixels connected to the erasure signal line having the line number designated will end. For cases in which the subframe period and the display period have roughly the same length, the subframe period is made to end by designating the line number using the write in line number designating means 118, and at the same time designating a different bit memory circuit by using the bit designating means 117. Differing bit subframe periods can thus be made to start.

Note that for cases in which write in and erasure of the digital video signal are performed in an arbitrary order, the write in gate signal line driver circuit 121 and the erasure gate signal line driver circuit 122 may also be structured by having address decoders (decoders and encoders).

Further, the present invention is not limited to the above structure, and a structure having known circuits such as flip-flop circuits, shift register circuits, and multiplexer circuits may also be employed.

Furthermore, although there are two memory circuits in Embodiment Mode 5 consisting of the first memory circuit and the second memory circuit, there are no limitations placed on the number of memory circuits, and additional memory circuits may also be formed.

Embodiment Mode 6

The present invention can be combined with a variety of techniques to increase display quality. For example, in the time division gray scales of the present invention, display disturbances due to false contouring can be prevented with additional effectiveness by separating and dividing the subframe periods of arbitrary bits. However, the driving frequency increases when combining conventional upper bit subframe periods with separating and dividing drive, and therefore it is necessary to determine the number of divisions of the subframe periods by the relationship with the driver performance of the driver circuit and the allowable value of the electric power consumption.

Further, the time division gray scales of the present invention can also be combined with another method as a means of achieving the multi-gray scales, for example surface area gray scales in which pixels are divided into a plurality of sub-pixels, and the light emission and non-light emission of each of the sub-pixels are controlled.

Embodiment 1

Figure 13:
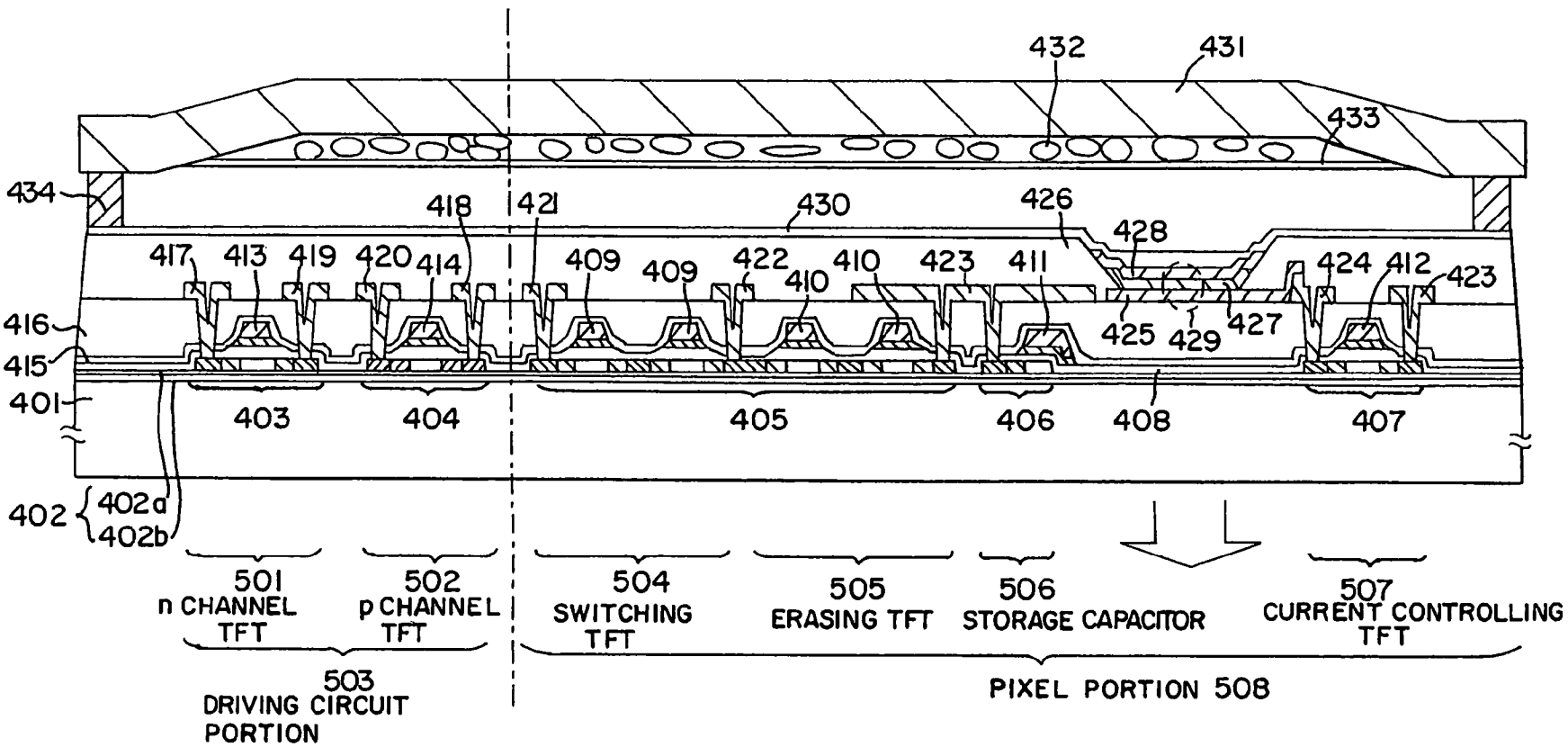
FIG. 13 is a cross sectional diagram of a pixel portion and a driver circuit portion of an organic light emitting display (Embodiment 1)

The present invention can be applied to every display device that uses an organic light emitting element. FIG. 13 shows an example thereof and an active matrix display device using a TFT.

A substrate 401 is a quartz substrate or a substrate of glass such as barium borosilicate glass and aluminum borosilicate glass, typical examples of which are Corning Corp. #7059 glass and #1737 glass. Although, in this embodiment, a substrate made of glass is used, it is possible to use a substrate made of silicon.

Next, an insulating film such as a silicon oxide film, a silicon nitride film, and a silicon oxynitride film is formed as a base film 402. For example, a silicon oxynitride film 402*a* formed by plasma CVD from $SiH_4$, $NH_3$, and $N_2O$ to have a thickness of 10 to 200 nm (preferably 50 to 100 nm) and a silicon oxynitride film 402*b* formed by plasma CVD from $SiH_4$ and $N_2O$ to have a thickness of 50 to 200 nm (preferably 100 to 150 nm) are layered. Although the base film 402 in this embodiment has a two-layered structure, the base film may be a single layer or three or more layers of the above insulating films.

Next, a semiconductor layer is formed and patterned. This semiconductor layer is formed to have a thickness of 10 to 80 nm (preferably 15 to 60 nm). And a first semiconductor layer 403, a second semiconductor layer 404, a third semiconductor layer 405, a fourth semiconductor layer 406, and a fifth semiconductor layer 407 are formed.

A gate insulating film 408 is formed to cover these semiconductor layers. The gate insulating film is a silicon oxynitride film formed of $SiH_4$ and $N_2O$ and here has a thickness of 10 to 200 nm, preferably 50 to 150 nm.

A laser such as a pulse oscillation type or continuous light emission type excimer laser, a YAG laser, or a $YVO_4$ laser can be used to fabricate the crystalline semiconductor films by the laser crystallization method. A method of condensing laser light emitted from a laser oscillator into a linear shape by an optical system and then irradiating the light to the semiconductor film may be used when these types of lasers are used. The crystallization conditions may be suitably selected by the operator, but when using the excimer laser, the pulse oscillation frequency is set to 30 Hz, and the laser energy density is set form 100 to 400 mJ/cm$^2$ (typically between 200 and 300 mJ/cm$^2$). Further, when using the YAG laser, the second harmonic is used and the pulse oscillation frequency is set from 1 to 10 kHz, and the laser energy density may be set from 300 to 600 mJ/cm$^2$ (typically between 350 and 500 mJ/cm$^2$). The laser light condensed into a linear shape with a width of 100 to 1000 μm, for example 400 μm, is then irradiated over the entire surface of the substrate. This is performed with an overlap ratio of 80 to 98% for the linear laser light.

A tantalum nitride (TaN) film is formed by sputtering and an aluminum alloy film mainly containing aluminum (Al) is formed next. The two layers of conductive films are patterned to form a writing gate signal line 409, an erasing gate signal line 410, a capacitance electrode 411, an island-like gate electrode 412 and gate electrodes of the driver circuit 413 and 414. These conductive films are used as masks for self-aligning doping with an impurity element.

Next, a silicon oxynitride film is formed by plasma CVD from $SiH_4$, $NH_3$, and $N_2O$ to have a thickness of 10 to 200 nm (preferably 50 to 100 nm) as a first interlayer insulating film 415. The first interlayer insulating film may be an oxynitride film. An organic resin film with a thickness of 0.5 to 10 μm (preferably 1 to 3 μm) is formed as a second interlayer insulating film 416. The second interlayer insulating film is preferably an acrylic resin film or a polyimide resin film. Desirably, the second interlayer insulating film is thick enough to level the unevenness due to the semiconductor layers, the gate electrodes or the like.

The insulating film made of low-k materials having 2.5 to 3.0 dielectric constants can be used as an interlayer insulating film 415. Decreasing permittivity of an interlayer insulating film is aimed at lowering the parasitic capacitance and preventing signal from being delayed. The insulating film made of low-k materials has both an organic system and an inorganic system. A material of which $SiO_2$ film having a lowered permittivity by adding C and H can be used as an inorganic material. As an organic materials, poliarylether consisting minute holes in its inside, amorphous Teflon (the Teflon is a registered trademark) and polyimide fluoride. Especially, resin film of fluoride system is expected as a material to be realizing the low permittivity. A low-k insulating film of an organic system can be further lowered the permittivity by a molecular design and deposited easily by spin coating. Thus, the low-k insulating film of an organic system is a prospect for low-k materials.

The first interlayer insulating film, the second interlayer insulating film and the gate insulating film are selectively etched to form contact holes. A conductive film is formed so as to cover the contact holes and then patterned. The conductive film is a laminate structure of a Ti film with a thickness of 50 nm and an alloy film (film of an alloy of Al and Ti) with a thickness of 500 nm. In a driving circuit portion 503, wiring lines of the source side 417 and 418 and wiring lines of the drain side 419 and 420 are formed. In the pixel portion, a source signal line 421, a connection electrode 422, a power supply line 423 and a drain side electrode 424 are formed. The source signal line 421 is connected to a source of a switching TFT 504 and the connection electrode 422 is connected to a drain of the switching TFT 504. Though not shown in the drawing, the connection electrode 422 is connected to the gate electrode 412 of a current controlling TFT 507. The power supply line 423 is connected to a source of the current controlling TFT 507 and the drain side electrode 424 is connected to a drain of the current controlling TFT 507.

In above way, the driving circuit portion 503 which has an n-channel TFT 501 and a p-channel TFT 502 and the pixel portion 508 which has the switching TFT 504, the erasing TFT 505, the storage capacitor 506 and the current controlling TFT 507 can be formed on the same substrate.

Next, an ITO (Indium Tin Oxide) film is formed by vacuum sputtering. The ITO film is patterned for each pixel to be in contact with the drain side electrode 424, to form an anode (pixel electrode) 425 of an organic light emitting element. ITO has high work function which value is 4.5 to 5.0 eV and is capable of injecting holes to an organic light emitting layer efficiently.

Next a photosensitive resin film is formed. A part of the photosensitive resin film that is inside the perimeter of the pixel electrode 425 is removed by patterning to form a bank 426. The organic compound layer is formed along the gentle slope of the bank, in order to prevent wire breakage of the organic compound layer at the perimeter of the pixel electrode and prevent short circuit of the pixel electrode and the opposite electrode at the point of the wire breakage.

Next, an organic compound layer 427 of the organic light emitting element is formed by evaporation. The organic compound layer may be a single layer or a laminate structure. With a laminate structure, the organic compound layer can provide better light emission efficiency. Generally, an organic compound layer is composed of a hole injecting layer, a hole transporting layer, a light emitting layer, and an electron transporting layer which are formed in this order on an anode. Other examples include a structure consisting of a hole transporting layer, a light emitting layer, and an electron transporting layer, and a structure consisting of a hole injecting layer, a hole transporting layer, a light emitting layer, an electron transporting layer, and an electron injecting layer. The present invention may employ any known structure for the organic compound layer.

In this embodiment, a color image is displayed by forming three types of light emitting layers, namely, forming Red light emitting layers, Green light emitting layers, and Blue light emitting layers through evaporation. Specifically, cyanopolyphenylene is used for a red light emitting layer, polyphenylen vinylene is used for a green light emitting layer, and polyphenylen vinylene or polyalkyl phenylene is used for a blue light emitting layer. Each light emitting layer is 30 to 150 nm in thickness. The above materials are merely examples of organic compounds that can be used for light emitting layers and do not preclude employment of other materials.

A cathode (opposite electrode) 428 of the organic light emitting element is formed next by evaporation. The cathode is formed of a light-reflective material which contains a small amount of alkaline component such as MgAg and LiF. The thickness of the cathode is 100 to 200 nm. The opposite electrode covers the entire surface of the pixel portion to serve as a common electrode to all pixels. The opposite electrode is electrically connected to an FPC (Flexible Printed Circuit) through a wiring line.

The organic light emitting element 429 with the organic compound layer sandwiched between the anode and the cathode is thus completed. The pixel electrode of the organic light emitting element 429 is a transparent electrode, and the opposite electrode thereof is reflective overlaps the pixel electrode. Therefore, it is possible that light emitted from the organic light emitting element travels in the direction indicated by the arrow of FIG. 13.

Next, a protective film 430 is formed. In this embodiment, a DLC film is used to prevent the organic light emitting element from moisture.

A substrate with the structure as above is called an active matrix substrate in this specification.

Further, the drying agent 432 fills in the concave portion of the sealing substrate 431 made of aluminum, stainless and the like, and high moisture permeability film 433 covers the drying agent 432, accordingly, the drying agent 432 is encapsulated in the concave portion. The active matrix substrate is bonded to the sealing substrate 431 using an adhesive sealing material 434 so as to cover the active matrix substrate by a drying agent 432 through the film 433. Then an organic light emitting element is enclosed.

Then, the organic light emitting panel in the form of the structure as above-mentioned is adhered to FPC (Flexible Printed Circuit) by a known method. FPC is adhered to the connection wiring which transmits signals to the pixel and the driving circuit.

As above-mentioned in the Embodiment Mode 5, the pixel portion and the driver circuit formed on the insulating surface are connected to the IC tip installed a time division gray scale data signal generating circuit and the like through the FPC. At this time, TAB (Tape Automated Bonding) and the like are employed. The organic light emitting display of this embodiment is completed in such a manner.

This embodiment can be properly combined with Embodiments 3, 4, 5 and 6.

Embodiment 2

An example of an organic light emitting display with a structure having a high aperture ratio and capable of performing high brightness display is shown in Embodiment 2.

Figure 14:
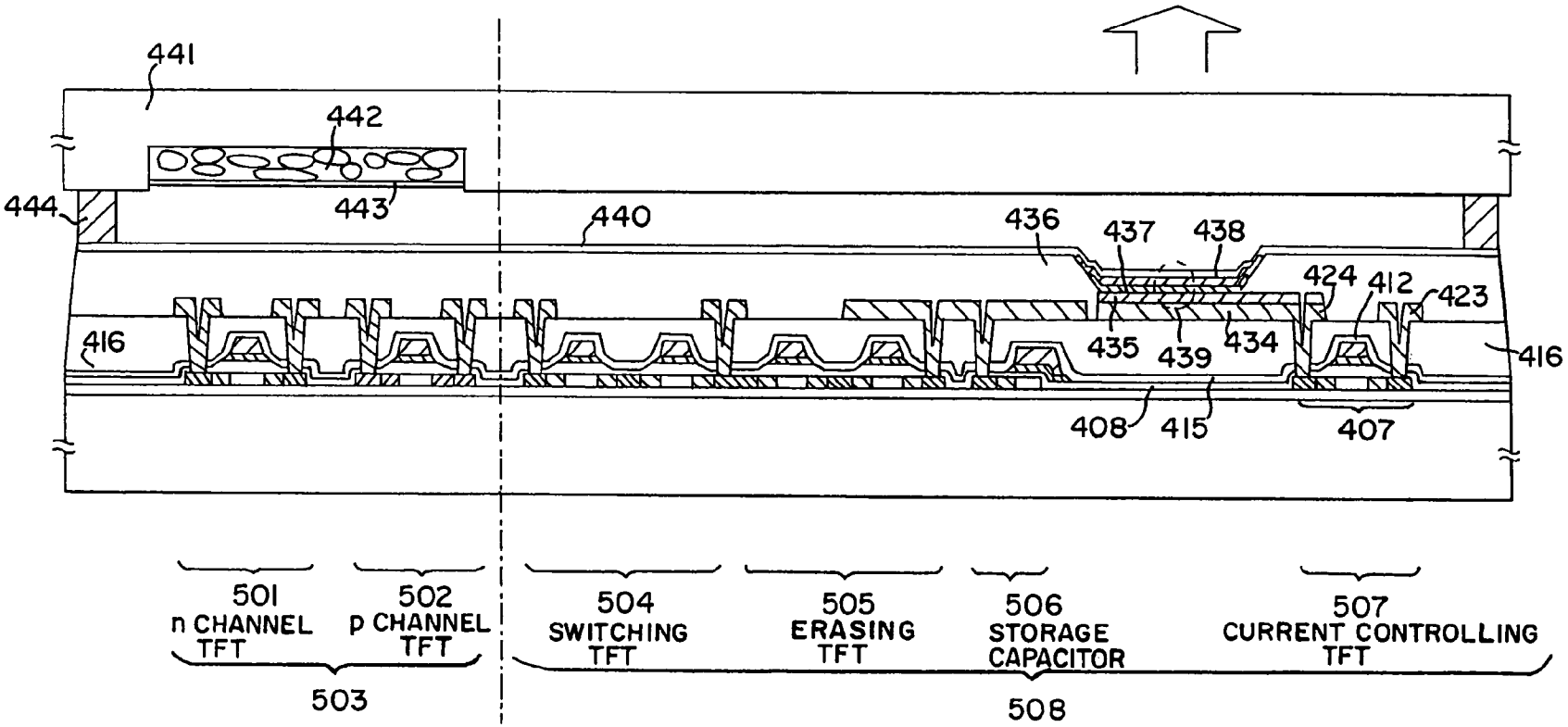
FIG. 14 is a cross sectional diagram of a pixel portion and a driver circuit portion of an organic light emitting display (Embodiment 2)

Embodiment 2 is explained with reference to FIG. 14. The light emission from light emitting elements is extracted from a sealing substrate side in Embodiment 2. Embodiment 2 is the same as Embodiment 1 up through the point at which the second interlayer insulating film 416, the first interlayer insulating film 415, and the gate insulating film 408 are selectively etched after forming the second interlayer insulating film, contact holes are formed, and in addition, the conductive film is formed so as to cover the contact holes and patterning is performed.

A driver circuit portion 503 having an n-channel TFT 501, a p-channel TFT 502, and a pixel portion 508 having a switching TFT 504, an erasure TFT 505, a storage capacitor 506, and an electric current control TFT 507 are thus formed on the same substrate.

However, a reflective electrode 434 is formed for each pixel when patterning the conductive film in Embodiment 2 as a substitute for the drain electrode 424 of Embodiment 1. The reflective electrode may be formed from high reflectivity aluminum or from an alloy having aluminum as its main constituent, and covers the gate electrode 412 of the electric current control TFT 507, the island shape semiconductor film 407, and the like. Note that while it is possible to use a single layer of aluminum as the reflective electrode, in Embodiment 2 a two layer structure having highly reflective silver overlapping with the aluminum functioning as the reflective electrode.

Next, an ITO film having a high work function is formed overlapping with the reflective electrode, and is used as an anode 435. The work function of the ITO film is high at 4.5 to 5.0 eV, and holes can be injected to the organic light emitting layer with good efficiency. Further, silver is formed between the ITO film and the aluminum film, and therefore electrolytic corrosion between the ITO film and the aluminum film can be prevented. Note that it is also possible to use as the anode a film of an element having a high work function, such as Cr, W, Au, or Pt, or a laminate layer of these films as a substitute for the ITO film.

A photosensitive resin film is formed next, and the photosensitive resin film on an inner periphery portion of the anode 435 is removed by patterning, forming a bank 436. A polyimide resin film or an acrylic resin film can be used as the material for the photosensitive resin film. Further, a non-photosensitive polyimide resin film or a non-photosensitive acrylic resin film can also be formed as a substitute for the photosensitive resin film, and then etched by a reactive gas, forming the bank.

An organic compound layer 437 is formed next by evaporation. Single layer and laminate layer structures may be used for the organic compound layer, but the use of a laminate layer structure gives good light emission efficiency. In general, on the anode a hole injecting layer, a hole transporting layer, a light emitting layer, and an electron transporting layer are formed in sequence. However, a structure in which a hole transporting layer, a light emitting layer, and an electron transporting layer are formed, and a structure in which a hole injecting layer, a hole transporting layer, a light emitting layer, an electron transporting layer, and an electron injecting layer are formed can also be used. All known structures may be used in Embodiment 2.

Note that color display is performed in Embodiment 2 by three types of light emitting layers corresponding to the colors RGB formed by evaporation. Specifically, cyano polyphenylene may be used in the red color light emitting layer, polyphenylene vinylene may be used in the green color light emitting layer, and polyphenylene vinylene or polyalkylphenylene may be used in the blue color light emitting layer. The light emitting layers may be formed having a thickness of 30 to 150 nm. The aforementioned materials are only examples of organic compounds that can be used for the light emitting layer, and there are no limitations placed upon the use of these organic compounds.

Next, a cathode 438 is formed by evaporation. A material having a low work function and containing a small amount of an alkaline component, such as MgAg, AlMg, or AlLi, is used for the cathode. In particular, TFT contamination can be prevented if an alkaline component with low mobility containing MgAg or AlMg is used for the cathode, and these materials are therefore preferable. The cathode is formed having a thin film thickness between 10 and 30 nm such that a light can be transmitted therethrough. Note that the cathode may also be provided with light transmitting characteristics by using a laminate structure in which a 2 to 5 nm thick Cs (cesium) film is laminated together with an Ag (silver) film having a thickness of 10 to 20 nm. The cathode is formed so as to cover the entire surface area of the pixel portion and used as a common electrode for all pixels.

A light emitting element 439 in which the organic compound layer 437 is sandwiched between the anode 435 and the cathode 438 is thus formed. The cathode 438 of the light emitting element 439 has light transmitting characteristics, and the reflective electrode 434 beneath the cathode has light reflecting characteristics, and therefore light emitted from the light emitting element can be irradiated from the side shown by the arrow in FIG. 14. Further, high reflectivity silver is used in the reflective electrode beneath the cathode in Embodiment 2, and therefore light emitted from the light emitting element can be irradiated in the direction of the arrow with good efficiency.

A silicon oxynitride film is formed next as a protective film 440. The band gap of the silicon oxynitride film is from 5 to 8 eV, and the absorption end for light is 248 nm. Good light transmittivity can therefore be assured with almost no absorption of light in the visible light region. Further, the silicon nitride film functions to suppress the passage of moisture, and therefore degradation of the light emitting element can be prevented.

Substrates on which the above stated structures are formed are referred to as active matrix substrates within this specification.

The active matrix substrate and a sealing substrate 441 formed opposing the active matrix substrate use substrates made from glass such as barium borosilicate glass, aluminoborosilicate glass, or quartz glass. There are no limitations placed on the sealing substrate 441 provided that it is a material having light transmitting characteristics, but the use of a material having a thermal expansion coefficient equal to that of the active matrix substrate 401 will prevent damage of the substrate due to rapid temperature changes, and such use is therefore preferable.

The surface of the sealing substrate is processed by sand blasting, selectively removing portions over the driver circuit portion 503 of the active matrix substrate. A drying agent 442 and a film 443 covering the drying agent are disposed in the portions that have been selectively removed. Known materials such as calcium oxide and barium oxide can be used for the drying agent.

The active matrix substrate and the sealing substrate are bonded in a nitrogen atmosphere using a sealing material 444. The sealing material may have a thickness of 10 to 50 μm.

In addition, an FPC (flexible printed circuit) is joined to an organic light emitting panel formed by the above structure using a known method. The FPC is joined to connection wirings for transmitting signals to the pixels and to the driver circuits.

Embodiment 2 can be combined with Embodiments 3 to 6.

Embodiment 3

A method of laser crystallization for achieving good electric field effect mobility is explained in Embodiment 3.

Figure 15B:
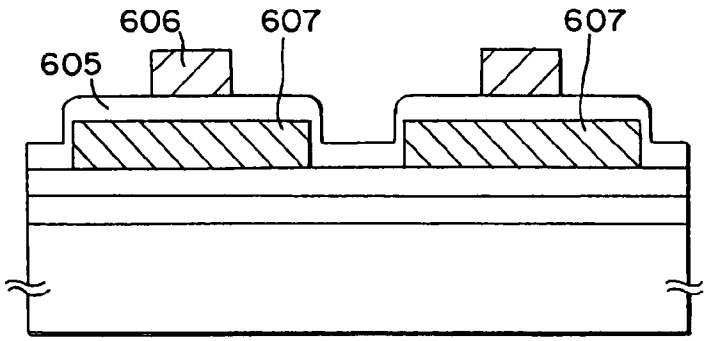
FIGS. 15A and 15B are a cross sectional diagram and an upper surface diagram, respectively, showing a process of crystallizing a semiconductor layer (Embodiment 3)
Figure 15A:
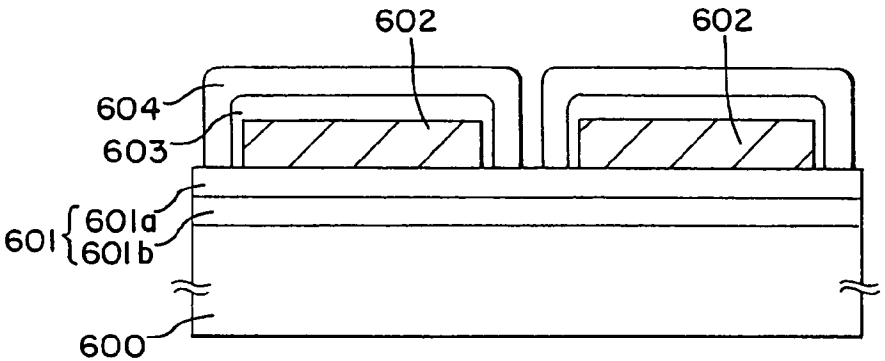

FIGS. 15A and 15B are cross sectional diagrams for explaining a process of laser crystallization.

A substrate made from quartz or glass, such as barium borosilicate glass or alumino-borosilicate glass, typically Corning Corp. #7059 glass or #1737 glass, is used as a substrate 600.

A base film 601 is formed next from an insulating material such as a silicon oxide film, a silicon nitride film, or a silicon oxynitride film. The base film is formed having a thickness from 50 to 500 nm so that impurities contained within glass substrates do not elute. A silicon oxynitride film 601*a* manufactured from $SiH_4$, $NH_3$, and $N_2O$ by using plasma CYD is formed having a thickness of 10 to 200 nm (preferable between 50 and 100 nm), and a silicon oxynitride film 601*b* similarly manufactured from $SiH_4$ and $N_2O$ having a thickness of 50 to 200 nm (preferably between 100 and 150 nm) is formed and laminated on the film 601*a*. Although a two layer structure is shown for the base film 601 in Embodiment 3, a single layer film, and structures in which three or more layers are laminated, may also be used.

Next, a semiconductor layer is formed, and patterned into an island shape. The semiconductor layer is formed at a thickness of 10 to 80 nm preferably 15 to 60 nm). A 30 nm thick semiconductor layer is formed here.

Note that patterning is performed on the semiconductor layer 602 so as to make the width of a region used as a channel thinner than the width of regions used as sources and drains when seen from the substrate surface. Further, the width of the region used as the channel is made to decrease rapidly with closeness to the regions used as the sources and drains.

The semiconductor layer is amorphous at the film formation stage, and therefore laser crystallization is performed in order to increase the electric field effect mobility. The following method is used in Embodiment 3 in order to increase the crystallinity of the region of the semiconductor layer used as the channel.

First, a separation $SiO_2$ film 603 is formed with a thickness of 50 to 150 nm covering the semiconductor layer, and a silicon film 604 is formed with a thickness of 200 nm covering the separation $SiO_2$ film. That is, the silicon film covers sidewalls and an upper surface of the semiconductor layer through the separation $SiO_2$ film. A silicon film having a large heat capacity is used, but there are no particular limitations placed on the use of the silicon film, and other materials can also be used, provided that they are materials having a greatly different heat capacity from that of the substrate made from glass or the base film.

Laser light is then irradiated to the semiconductor layer from the rear surface of the glass substrate, performing laser crystallization. A CW laser (Nd:$YVO_4$) having a highly stable irradiation energy is used here. Laser light of the second harmonic of $YVO_4$ at 532 nm as a wavelength having high transmittivity is irradiated on the glass substrate with the amorphous semiconductor layer having a high absorption coefficient. The scanning speed of the laser light may be freely regulated within a range of 10 to 200 cm/sec. There is a tendency to obtain a good electric field effect mobility if the laser light scanning speed is set low.

The semiconductor layer is placed into a melted state when the laser light is irradiated. Cooling and solidification take place next, followed by crystallization. The silicon film having a high heat capacity is formed overlapping the semiconductor layer here, and therefore the cooling speed of the interface of the semiconductor layer 602 surrounded by the silicon is slow compared to the bulk semiconductor layer. Crystallization proceeds from the bulk semiconductor layer to the interface of the semiconductor layer surrounded by the thermal storage film due to a temperature gradient.

Further, portions irradiated by the laser light melt, and then solidify, and therefore crystallization proceeds in the laser light scanning direction. A boundary between the region used as the channel and the regions used as the sources and drains has a narrower width than the size of the crystal grains here, and therefore crystallization proceeds from a single crystal grain when the region that becomes the channel is scanned by the laser and crystallized. A state close to that of a single crystal can thus be achieved. That is, a state close to that of a single crystal can be formed in the channel region by preventing crystallization from proceeding due to a plurality of crystal nuclei.

Crystallization is thus made to proceed, and crystals are deposited, gradually upward from the interface of the semiconductor layer and the base film, and downstream from the upstream irradiation of the laser light, and crystals.

The generation of a plurality of crystal nuclei is thus controlled, and crystallization can be performed in a nearly single crystal state. It is possible to achieve a good electric field mobility of 300 to 500 $cm^2/Vs$ in a semiconductor layer 607 thus formed (see FIG. 15A).

The silicon film 604 is removed next by etching, and in addition, the separation $SiO_2$ film 603 is removed.

A gate insulating film 605 is formed covering the semiconductor layer 607. The gate insulating film is a silicon oxynitride film manufactured from $SiH_4$ and $N_2O$, and is formed at a thickness of 10 to 200 nm, preferably 50 to 150 nm.

A gate electrode 606 is formed next on the gate insulating film (see FIG. 15B). The structure of an organic light emitting display obtained by subsequent processing is the same as that of Embodiments 1 and 2, and therefore an explanation of the structure is omitted here.

Note that although the shapes of the gate insulating film and the gate electrode are shown schematically here, the gate insulating film structure and the gate electrode structure are elements having a very large amount of influence on the TFT characteristics, and therefore processes may be added or suitably changed after considering the TFT characteristics.

The semiconductor layer obtained by Embodiment 3 has a high electric field effect mobility, and the drain current when driving the TFT can be made higher, and therefore the amount of electric current flowing in the light emitting elements can be increased, and a good display having high light emission brightness can be obtained.

It is possible to suitably combine Embodiment 3 with Embodiments 1, 2, 4, 5, and 6.

Embodiment 4

In the present invention, the organic material used as an organic compound layer of an organic light emitting element may be a low molecular weight organic material or a high molecular weight organic material. Major examples of the low molecular weight organic material include $Alq_3$ (tris-8-quinolilite-aluminum) or TPD (triphenylamine derivative) and the like. A π-conjugate polymer material can be given as an example of the high molecular weight organic material. Typically, a 1-conjugate polymer is PPV (polyphenylene vinylene), PVK (polyvinyl carbazole), or polycarbonate and the like.

A high molecular weight organic material can be formed into a thin film by a simple method such as spin coating, dipping, dispensing, printing, or ink jet, and has higher heat resistance than a low molecular weight organic material.

In an organic light emitting element of an organic light emitting display of the present invention, if an organic compound layer of the organic light emitting element has an electron transporting layer and a hole transporting layer, an inorganic material may be used for the electron transporting layer and the hole transporting layer. Examples of the inorganic material include an amorphous Si or an amorphous semiconductor layer such as an amorphous $Si_{1-x}C_x$ and the like.

An amorphous semiconductor has a large number of trap levels and forms many interface levels at the interface between the amorphous semiconductor and another layer. Therefore, the organic light emitting element can emit light at a low voltage and can have high luminance.

The organic compound layer may be doped with a dopant to change the color of light emitted from the organic light emitting element. Examples of the dopant include DCM1, Nile red, rubrene, Coumarin 6, TPB, and quinacridon and the like.

This embodiment can be properly combined with Embodiments 1, 2, 3, 5 and 6.

Embodiment 5

Figure 16:
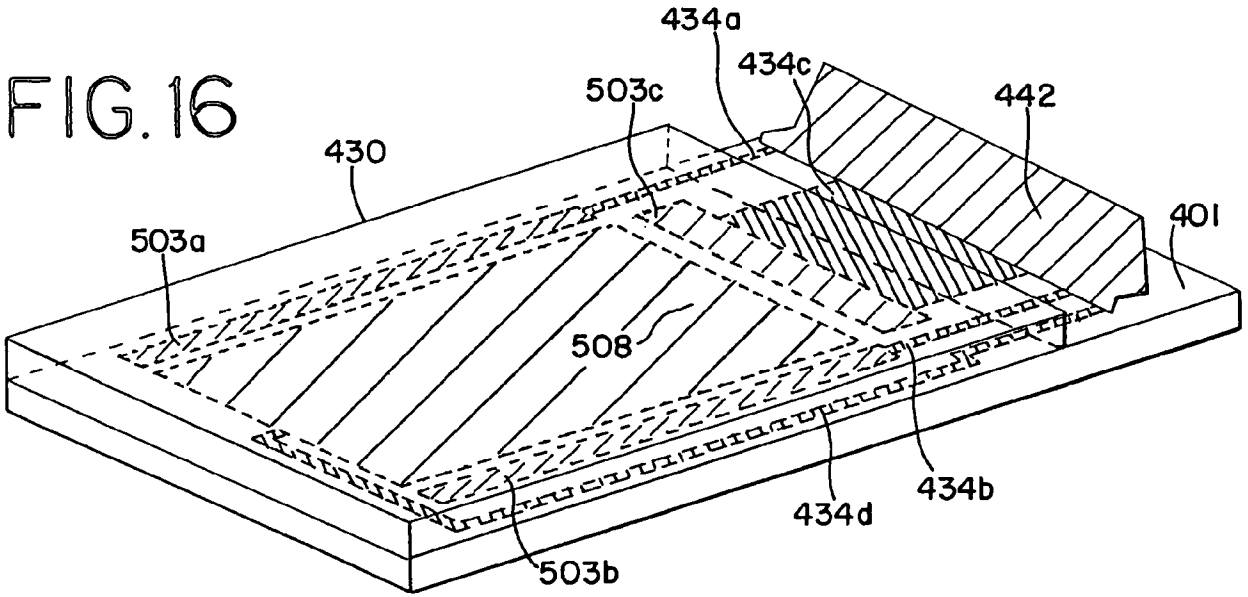
FIG. 16 is a perspective view showing an example of the appearance of an organic light emitting display (Embodiment 4)

An example of an external view of an organic light emitting display of the present invention is explained in Embodiment 5 using FIG. 16. FIG. 16 is a perspective diagram showing a state up through performing sealing of organic light emitting elements on an active matrix substrate on which the organic light emitting elements are formed, and an FPC (flexible printed circuit) is formed in addition. Elements that are the same as those of Embodiment 1 have identical reference numerals attached.

Signals input from the FPC 442 are input to the driver circuit portion and the pixel portion 508 through connection wirings 434*a* to 434*d*. The driver circuit portion is formed using a CMOS circuit or the like in which an n-channel TFT and a p-channel TFT are combined cooperatively. The driver circuit portion has a write in gate signal line driver circuit 503*a*, an erasure gate signal line driver circuit 503*b*, and a source signal line driver circuit 503*c*.

Note that the connection wirings 434*d* for inputting signals into the pixel portion 508 are connected to an electric power source supply line for imparting an electric potential to the light emitting elements, and are connected to opposing electrodes of the light emitting elements.

The substrate 401 on which the pixel portion and the driver circuit portion are formed is bonded to the sealing substrate 430 using a sealing material not shown in the figure while maintaining a gap between the two substrates.

In addition, it becomes necessary to attach an EPC by using TAB (tape automated bonding) of an IC chip on which a time division gray scale data signal generator circuit and the like, not shown in the figure, are mounted when necessary as stated above in Embodiment Mode 5 for cases of performing the time division gray scale method of the present invention.

Note that although a structure in which the pixel portion and the driver circuit portion are formed together on the same substrate is shown in Embodiment 5 as a structure for a polysilicon TFT active layer of the pixel portion, there are no limitations placed on the structure of the present invention. It is also possible to use amorphous silicon in the TFT active layer of the pixel portion, provided that a sufficient amount of electric current can be made to flow so that the light emitting elements emit light at a high brightness. The organic light emitting element of the present invention is structured in this case by mounting the driver circuit portion, having the source signal line driver circuit, the write in gate signal line driver circuit, and the erasure gate signal line driver circuit, on an IC chip.

Further, it becomes possible to incorporate the time division gray scale date signal generator circuit on the silicon substrate for cases in which the organic light emitting elements are driven by FETs (field effect transistors) formed on the silicon substrate. The organic light emitting display of the present invention thus has a structure in which the time division gray scale data signal generator circuit is built-in.

Embodiment 5 can be combined with Embodiments 1, 2, 3, and 4.

Embodiment 6

A display device formed by implementing the present invention can be incorporated to various electric-equipment, and a pixel portion is used as an image display portion. Given as such electronic equipment of the present invention are cellular phones, PDAs, electronic books, video cameras, notebook computers, and image play back devices with the recording medium, for example, DVD (Digital Versatile Disc) players, digital cameras, and the like. Specific examples of those are shown in FIGS. 17A to 18C.

Figures 17A, 17B, 17C, 17D, 18A, 18B, 18C:
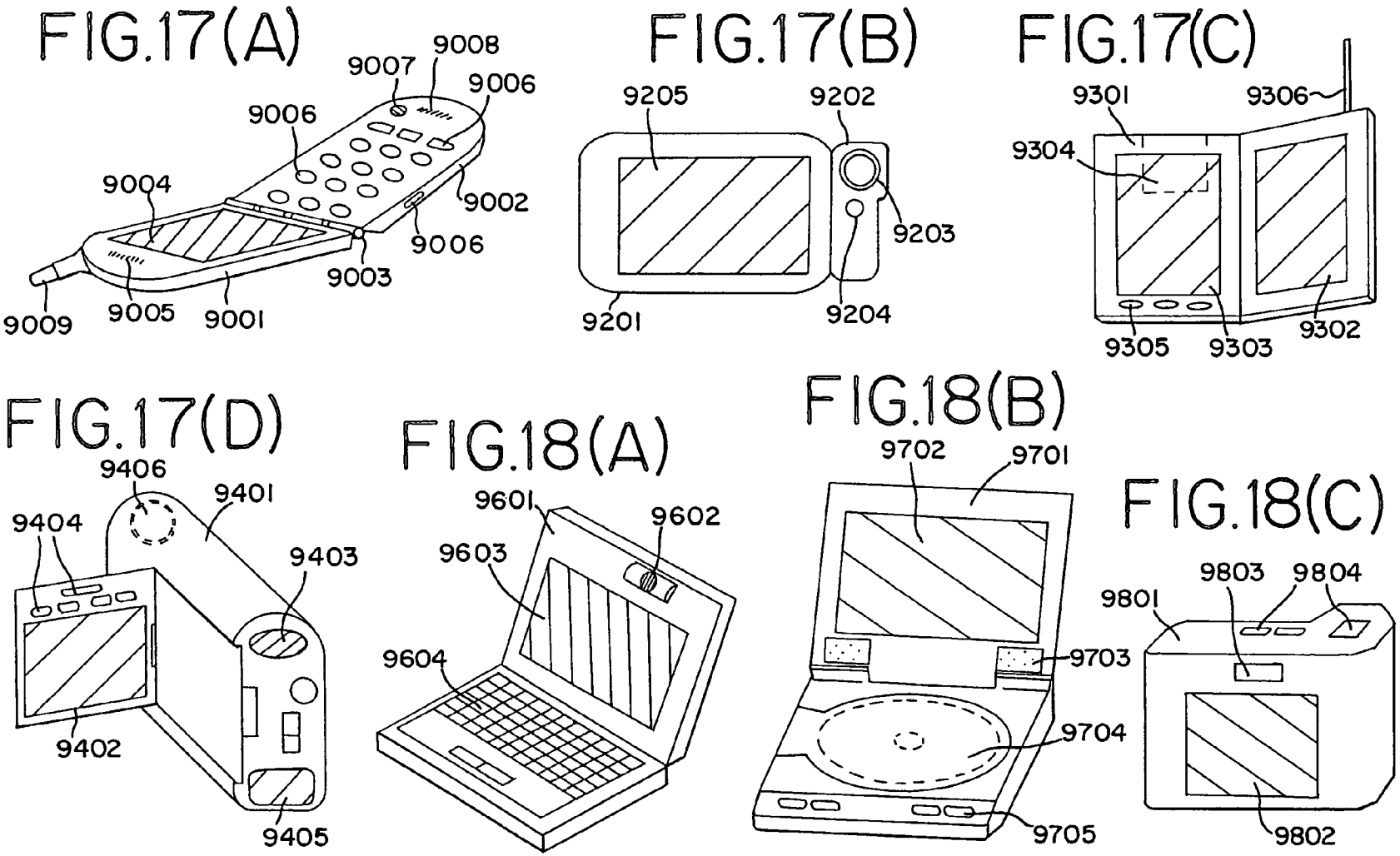
FIGS. 17A to 17D are perspective views showing examples of electronic equipment (Embodiment 5)
FIGS. 18A to 18C are perspective views showing examples of electronic equipment (Embodiment 5)
Figure 19A:
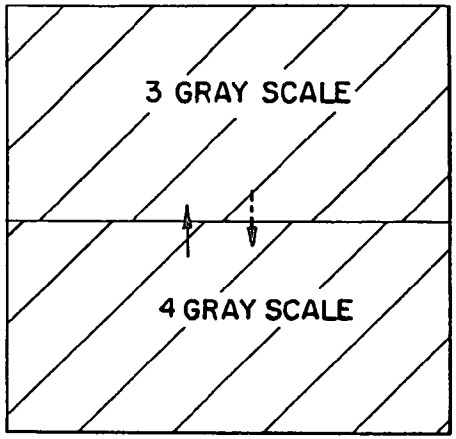
FIGS. 19A to 19C are diagrams showing an organic light emitting display, and conventional light emission timing for performing display, respectively.
Figure 19B:
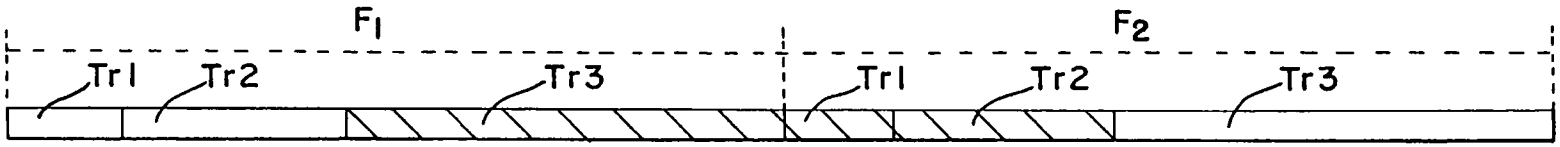
Figure 19C:
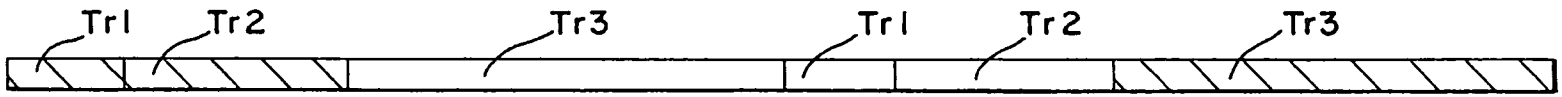
Figure 20A:
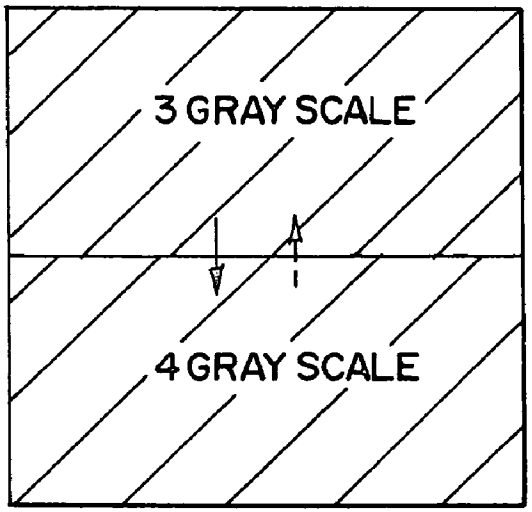
FIGS. 20A and 20B are diagrams showing an organic light emitting display, and conventional light emission timing for performing display, respectively.
Figure 20B:
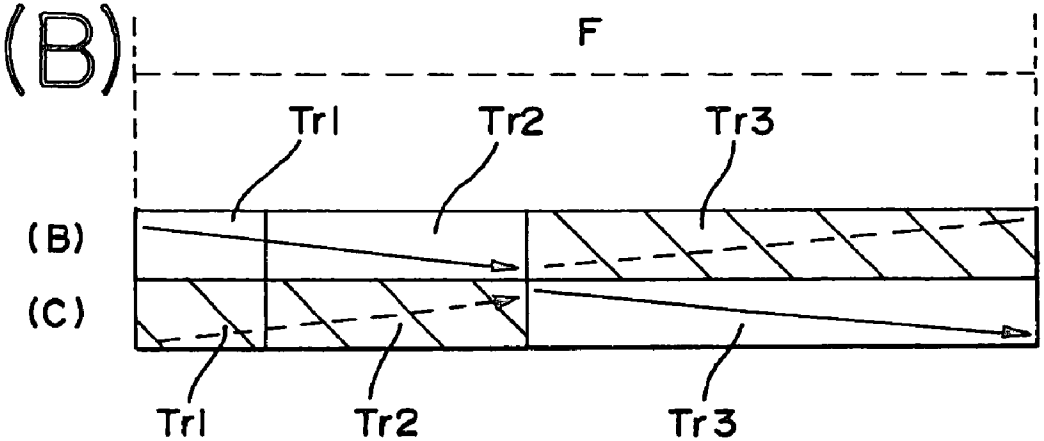

FIG. 17A shows a cellular phone, which is composed of a display panel 9001, an operation panel 9002, and a connecting portion 9003. The display panel 9001 is provided with a display device 9004, an audio output portion 9005, an antenna 9009, etc. The operation panel 9002 is provided with operation keys 9006, a power supply switch 9007, an audio input portion 9008, etc. The present invention is applicable to the display device 9004.

FIG. 17B shows a mobile computer, or a portable information terminal, which is composed of a main body 9201, a camera portion 9202, an image receiving portion 9203, operation switches 9204, and a display device 9205. The present invention can be applied to the display device 9205. In such electronic devices, the display device of 3 to 5 inches is employed, however, by employing the display device of the present invention, the reduction of the weight in the portable information terminal can be attained.

FIG. 17C shows a portable book, which is composed of a main body 9301, display devices 9302 and 9303, and a recording medium 9304, an operation switch 9305, and an antenna 9306, and which displays the data recorded in Minidisk (MD) or DVD and the data received by the antenna. The present invention can be applied to the display devices 9302 and 9303. In the portable book, the display device of the 4 to 12 inches is employed. However, by employing the display device of the present invention, the reduction of the weight and thickness in the portable book can be attained.

FIG. 17D shows a video camera, which is composed of a main body 9401, a display device 9402, an audio input portion 9403, operation switches 9404, a battery 9405, an image receiving portion 9406 and the like. The present invention can be applied to the display device 9402.

FIG. 18S shows a personal computer, which is composed of a main body 9601, an image input portion 9602, a display device 9603, and a key board 9604. The present invention can be applied to the display device 9603.

FIG. 18B shows a player employing a recording medium with programs recorded thereon (hereinafter referred to as recording medium), which is composed of a main body 9701, a display device 9702, a speaker portion 9703, a recording medium 9704, and an operation switch 9705. The device employs DVD (Digital Versatile Disc), CD, etc. as the recording medium so that music can be listened, movies can be seen and games and internet can be done. The present invention can be applied to the display device 9702.

FIG. 18C shows a digital camera, which is composed of a main body 9801, a display device 9802, an eyepiece portion 9803, an operation switch 9804, and an image receiving portion (not shown). The present invention can be applied to the display device 9802.

The display device of the present invention is employed in the cellular phones in FIG. 17A, the mobile computer or the portable information terminal in FIG. 17B, the portable book in FIG. 17C and the personal computer in FIG. 18A. The display device can reduce the power consumption of the above device by displaying the black display in a standby mode.

In the operation of the cellular phone shown in FIG. 17A, the luminance is lowered when the operation keys are used, and the luminance is raised after usage of the operation switch, whereby the low power consumption can be realized. Further, the luminance of the display device is raised at the receipt of a call, and the luminance is lowered during a call, whereby the low power consumption can be realized. Besides, in the case where the cellular phone is continuously used, the cellular phone is provided with a function of turning off a display by time control without resetting, whereby the low power consumption can be realized. Note that the above operations may be conducted by manual control.

Although it is not shown here, the present invention can be applied to the display device which is employed in a navigation system, a refrigerator, a washing machine, a micro-wave oven, a fixed telephone, a fax machine, etc. As described above, the applicable range of the present invention is so wide that the present invention can be applied to various products.

The present invention can prevent the existence over a wide area of pixels that continuously emit light or continuously do not emit light when performing display by time division gray scales. False contouring can be prevented with good efficiency. In other words, the continuous visibility of pixels that emit light, and the continuous visibility of pixels that do not emit light, in lines of adjacent pixels can be prevented, and therefore false contouring can be prevented with good efficiency.

Further, the above stated effect can be obtained even if subframe periods are not separated and divided, and therefore display disturbances due to false contouring can be greatly reduced even at a driver frequency equivalent to a conventional driver frequency. Images having good quality can therefore be provided without increasing the amount of electric power consumption.

What is claimed is:

1. A method of driving a light-emitting display device comprising the steps of:

selecting a K-th line to input first data to light-emitting pixels of the K-th line;

selecting a L-th line to input second data to light-emitting pixels of the L-th line;

selecting a M-th line to input third data to light-emitting pixels of the M-th line, selecting the K-th line to erase the first data of the light-emitting pixels of the K-th line; and selecting the M-th line to erase the third data of the light-emitting pixels of the M-th line, wherein K is a natural number, L is a natural number larger than K, and M is a natural number larger than L, wherein one frame comprises a plurality of subframes, wherein the steps of selecting the K-th line to input the first data, selecting the L-th line to input the second data and selecting the M-th line to input the third data are comprised in one of the plurality of subframes, wherein an order of appearance of the subframes of the light-emitting pixels of the K-th line differs from an order of appearance of the subframes of the light-emitting pixels of the L-th line, wherein the order of appearance of the subframes of the light-emitting pixels of the K-th line is the same as an order of appearance of the subframes of the light-emitting pixels of the M-th line, wherein, in each of the subframe periods, selecting the L-th line to input the second data for the first time is performed after selecting the K-th line to input the first data for the first time, wherein, in each of the subframe periods, selecting the M-th line to input the third data for the first time is performed after selecting the L-th line to input the second data for the first time, and wherein the step of selecting the K-th line to erase the first data and the step of selecting the M-th line to erase the third data are performed at different times in each of the subframe periods.

2. The method according to claim 1, further comprising the steps of:

selecting the K-th line to input fourth data of the light-emitting pixels of the K-th line; and selecting the M-th line to input fifth data of the light-emitting pixels of the M-th line;

wherein the first data are overwritten with the fourth data, and the third data are overwritten with the fifth data.

3. The method according to claim 1, wherein each of the first data, the second data and the third data are digital data.

4. The method according to claim 1, wherein gradation levels are controlled with selections of the plurality of subframes.

5. The method according to claim 1, wherein the light-emitting display device is an organic light emitting display.

6. A method of driving a light-emitting display device comprising the steps of:

selecting a K-th line to input first data to light-emitting pixels of the K-th line;

selecting a L-th line to input second data to light-emitting pixels of the L-th line;

selecting a M-th line to input third data to light-emitting pixels of the M-th line, selecting the K-th line to erase the first data of the light-emitting pixels of the K-th line; and selecting the M-th line to erase the third data of the light-emitting pixels of the M-th line, wherein K is a natural number, L is a natural number larger than K, and M is a natural number larger than L, wherein one frame comprises a plurality of subframes, wherein the steps of selecting the K-th line to input the first data, selecting the L-th line to input the second data and selecting the M-th line to input the third data are comprised in one of the plurality of subframes, wherein an order of appearance of the subframes of the light-emitting pixels of the K-th line is the same as an order of appearance of the subframes of the light-emitting pixels of the M-th line, and one of n orders of appearance of the subframes, where n is an integer equal to or greater than 2, wherein an order of appearance of the subframes of the light-emitting pixels of the L-th line is another one of the n orders of appearance of the subframes, wherein, in each of the subframe periods, selecting the L-th line to input the second data for the first time is performed after selecting the K-th line to input the first data for the first time, wherein, in each of the subframe periods, selecting the M-th line to input the third data for the first time is performed after selecting the L-th line to input the second data at for the first time, and wherein the step of selecting the K-th line to erase the first data and the step of selecting the M-th line to erase the third data are performed at different times in each of the subframe periods.

7. The method according to claim 6, further comprising the steps of:

selecting the K-th line to input fourth data of the light-emitting pixels of the K-th line; and selecting the M-th line to input fifth data of the light-emitting pixels of the M-th line;

wherein the first data are overwritten with the fourth data, and the third data are overwritten with the fifth data.

8. The method according to claim 6, wherein each of the first data, the second data and the third data are digital data.

9. The method according to claim 6, wherein gradation levels are controlled with selections of the plurality of subframes.

10. The method according to claim 6, wherein the light-emitting display device is an organic light emitting display.

11. A method of driving a light-emitting display device comprising the steps of:

selecting a K-th line to input first data to light-emitting pixels of the K-th line;

selecting a L-th line to input second data to light-emitting pixels of the L-th line;

selecting a M-th line to input third data to light-emitting pixels of the M-th line, selecting the K-th line to erase the first data of the light-emitting pixels of the K-th line; and selecting the M-th line to erase the third data of the light-emitting pixels of the M-th line, wherein K is a natural number, L is a natural number larger than K, and M is a natural number larger than L, wherein one frame comprises a plurality of subframes, wherein the steps of selecting the K-th line to input the first data, selecting the L-th line to input the second data and selecting the M-th line to input the third data are comprised in one of the plurality of subframes, wherein an order of appearance of the subframes of the light-emitting pixels of the K-th line is one of n orders of appearance of the subframes, where n is an integer equal to or greater than 2, wherein the order of appearance of subframes is the same for every n lines, wherein, in each of the subframe periods, selecting the L-th line to input the second data for the first time is performed after selecting the K-th line to input the first data for the first time, and wherein, in each of the subframe periods, selecting the M-th line to input the third data for the first time is performed after selecting the L-th line to input the second data at for the first time, and wherein the step of selecting the K-th line to erase the first data and the step of selecting the M-th line to erase the third data are performed at different times in each of the subframe periods.

12. The method according to claim 11, further comprising the steps of:

selecting the K-th line to input fourth data of the light-emitting pixels of the K-th line; and selecting the M-th line to input fifth data of the light-emitting pixels of the M-th line;

wherein the first data are overwritten with the fourth data, and the third data are overwritten with the fifth data.

13. The method according to claim 11, wherein each of the first data, the second data and the third data are digital data.

14. The method according to claim 11, wherein gradation levels are controlled with selections of the plurality of subframes.

15. The method according to claim 11, wherein the light-emitting display device is an organic light emitting display.

16. A method of driving a light-emitting display device comprising the steps of:

selecting a K-th line to input first data to light-emitting pixels of the K-th line;

selecting a L-th line to input second data to light-emitting pixels of the L-th line;

selecting a M-th line to input third data to light-emitting pixels of the M-th line, selecting the K-th line to input fourth data to light-emitting pixels of the K-th line;

selecting the L-th line to input fifth data to light-emitting pixels of the L-th line;

selecting the M-th line to input sixth data to light-emitting pixels of the M-th line, selecting the K-th line to erase the first data of the light-emitting pixels of the K-th line; and selecting the M-th line to erase the third data of the pixels of the M-th line, wherein K is a natural number, L is a natural number larger than K, and M is a natural number larger than L, wherein one frame comprises a plurality of subframes, wherein the steps of selecting the K-th line to input the first data, selecting the L-th line to input the second data and selecting the M-th line to input the third data are comprised in a first one of the plurality of subframes, wherein the steps of selecting the K-th line to input the fourth data, selecting the L-th line to input the fifth data and selecting the M-th line to input the sixth data are comprised in a second one of the plurality of subframes, wherein an order of appearance of the subframes of the light-emitting pixels of the K-th line differs from an order of appearance of the subframes of the light-emitting pixels of the L-th line, wherein the order of appearance of the subframes of the light-emitting pixels of the K-th line is the same as an order of appearance of the subframes of the light-emitting pixels of the M-th line, wherein, in each of the subframe periods, selecting the L-th line to input the second data for the first time is performed after selecting the K-th line to input the first data for the first time, and wherein, in each of the subframe periods, selecting the M-th line to input the third data for the first time is performed after selecting the L-th line to input the second data at for the first time, and wherein the step of selecting the K-th line and the step of selecting the M-th line is performed at different times in each of the subframe periods.

17. The method according to claim 16, wherein the first data are overwritten with the fourth data, and the third data are overwritten with the sixth data.

18. The method according to claim 16, wherein each of the first data, the second data and the third data are digital data.

19. The method according to claim 16, wherein gradation levels are controlled with selections of the plurality of subframes.

20. The method according to claim 16, wherein the light-emitting display device is an organic light emitting display.

21. A method of driving a display device comprising the steps of:

selecting a K-th line to input first data to pixels of the K-th line;

selecting a L-th line to input second data to pixels of the L-th line;

selecting a M-th line to input third data to pixels of the M-th line, selecting the K-th line to erase the first data of the pixels of the K-th line; and selecting the M-th line to erase the third data of the pixels of the M-th line, wherein K is a natural number, L is a natural number larger than K, and M is a natural number larger than L, wherein one frame comprises a plurality of subframes, wherein the steps of selecting the K-th line to input the first data, selecting the L-th line to input the second data and selecting the M-th line to input the third data are comprised in one of the plurality of subframes, wherein an order of appearance of the subframes of the pixels of the K-th line differs from an order of appearance of the subframes of the pixels of the L-th line, wherein the order of appearance of the subframes of the pixels of the K-th line is the same as an order of appearance of the subframes of the pixels of the M-th line, and wherein the step of selecting the K-th line to erase the first data and the step of selecting the M-th line to erase the third data are performed at different times in each of the subframe periods.

22. The method according to claim 21, further comprising the steps of:

selecting the K-th line to input fourth data of the pixels of the K-th line; and selecting the M-th line to input fifth data of the pixels of the M-th line;

wherein the first data are overwritten with the fourth data, and the third data are overwritten with the fifth data.

23. The method according to claim 21, wherein each of the first data, the second data and the third data are digital data.

24. The method according to claim 21, wherein gradation levels are controlled with selections of the plurality of subframes.

25. The method according to claim 21, wherein the display device is an organic light emitting display.

26. A method of driving a display device comprising the steps of:

selecting a K-th line to input first data to pixels of the K-th line;

selecting a L-th line to input second data to pixels of the L-th line;

selecting a M-th line to input third data to pixels of the M-th line, selecting the K-th line to erase the first data of the light-emitting pixels of the K-th line; and selecting the M-th line to erase the third data of the light-emitting pixels of the M-th line, wherein K is a natural number, L is a natural number larger than K, and M is a natural number larger than L, wherein one frame comprises a plurality of suframes, wherein the steps of selecting the K-th line to input the first data, selecting the L-th line to input the second data and selecting the M-th line to input the third data are comprised in one of the plurality of subframes, wherein an order of appearance of the subframes of the pixels of the K-th line is the same as an order of appearance of the subframes of the pixels of the M-th line, and one of n orders of appearance of the subframes, where n is an integer equal to or greater than 2, wherein an order of appearance of the subframes of the pixels of the L-th line is another one of the n orders of appearance of the subframes, and wherein the step of selecting the K-th line to erase the first data and the step of selecting the M-th line to erase the third data are performed at different times in each of the subframe periods.

27. New The method according to claim 26, further comprising the steps of:

selecting the K-th line to input fourth data of the pixels of the K-th line; and selecting the M-th line to input fifth data of the pixels of the M-th line;

wherein the first data are overwritten with the fourth data, and the third data are overwritten with the fifth data.

28. The method according to claim 26, wherein each of the first data, the second data and the third data are digital data.

29. The method according to claim 26, wherein gradation levels are controlled with selections of the plurality of subframes.

30. The method according to claim 26, wherein the display device is an organic light emitting display.

31. A method of driving a display device comprising the steps of:

selecting a K-th line to input first data to pixels of the K-th line;

selecting a L-th line to input second data to pixels of the L-th line;

selecting a M-th line to input third data to pixels of the M-th line, selecting the K-th line to erase the first data of the light-emitting pixels of the K-th line; and selecting the M-th line to erase the third data of the light-emitting pixels of the M-th line, wherein K is a natural number, L is a natural number larger than K, and M is a natural number larger than L, wherein one frame comprises a plurality of subframes, wherein the steps of selecting the K-th line to input the first data, selecting the L-th line to input the second data and selecting the M-th line to input the third data are comprised in one of the plurality of subframes, wherein an order of appearance of the subframes of the pixels of the L-th line is another one of n orders of appearance of the subframes, where n is an integer equal to or greater than 2, wherein the order of appearance of subframes is the same for every n lines, and wherein the step of selecting the K-th line to erase the first data and the step of selecting the M-th line to erase the third data are performed at different times in each of the subframe periods.

32. The method according to claim 31, further comprising the steps of:

selecting the K-th line to input fourth data of the pixels of the K-th line; and selecting the M-th line to input fifth data of the pixels of the M-th line;

wherein the first data are overwritten with the fourth data, and the third data are overwritten with the fifth data.

33. The method according to claim 31, wherein each of the first data, the second data and the third data are digital data.

34. The method according to claim 31, wherein gradation levels are controlled with selections of the plurality of subframes.

35. The method according to claim 31, wherein the display device is an organic light emitting display.

36. A method of driving a display device comprising the steps of:

selecting a K-th line to input first data to pixels of the K-th line;

selecting a L-th line to input second data to pixels of the L-th line;

selecting a M-th line to input third data to pixels of the M-th line, selecting the K-th line to input fourth data to pixels of the K-th line;

selecting the L-th line to input fifth data to pixels of the L-th line; and selecting the M-th line to input sixth data to pixels of the M-th line, selecting the K-th line to erase the first data of the light-emitting pixels of the K-th line; and selecting the M-th line to erase the third data of the pixels of the M-th line, wherein K is a natural number, L is a natural number larger than K, and M is a natural number larger than L, wherein one frame comprises a plurality of subframes, wherein the steps of selecting the K-th line to input the first data, selecting the L-th Line to input the second data and selecting the M-th line to input the third data are comprised in a first one of the plurality of subframes, wherein the steps of selecting the K-th line to input the fourth data, selecting the L-th line to input the fifth data and selecting the M-th line to input the sixth data are comprised in a second one of the plurality of subframes, wherein an order of appearance of the subframes of the pixels of the K-th line differs from an order of appearance of the subframes of the pixels of the L-th line, wherein the order of appearance of the subframes of the pixels of the K-th line is the same as an order of appearance of the subframes of the pixels of the M-th line, and wherein the step of selecting the K-th line and the step of selecting the M-th line is performed at different times in each of the subframe periods.

37. The method according to claim 36, wherein the first data are overwritten with the fourth data, and the third data are overwritten with the sixth data.

38. The method according to claim 36, wherein each of the first data, the second data and the third data are digital data.

39. The method according to claim 36, wherein gradation levels are controlled with selections of the plurality of subframes.

40. The method according to claim 36, wherein the display device is an organic light emitting display.

* * * * *

UNITED STATES PATENT AND TRADEMARK OFFICE

CERTIFICATE OF CORRECTION

PATENT NO. : 8,373,625 B2
APPLICATION NO. : 11/974163
DATED : February 12, 2013
INVENTOR(S) : Hajime Kimura It is certified that error appears in the above-identified patent and that said Letters Patent is hereby corrected as shown below:

In the specification:
Column 1, Line 29; Change "EDAs" to --PDAs--
Column 14, Line 12; Change "$T_{q1}$" to --$T_{a1}$--
Column 15, Line 20; Change "AG" to --ΔG--
Column 15, Line 51; Change "$T_{n1}$" to --$T_{r1}$--
Column 18, Line 17; Change "$T_{e1}$" to --$T_{a1}$--
Column 18, Line 53; Change "Gas" to --$G_{a8}$--
Column 19, Line 33; Change "TEDs" to --TFDs--
Column 25, Line 28; Change "$G_{a3}$" to --$G_{e3}$--
Column 29, Line 53; Change "SE" to --$SF_1$--
Column 29, Line 60; Change "SF" to --$SF_1$--
Column 41, Line 29; Change "CYD" to --CVD--
Column 41, Line 40; Change "80 nm preferably" to --80 nm (preferably--
Column 43, Line 7; Change "1-conjugate" to --π-conjugate--
Column 43, Line 64; Change "EPC" to --FPC--
Column 45, Line 3; Change "18S" to --18A--

In the claims:

Claim 27, Column 50, Line 24; Change "New The method" to --The method--
Claim 31, Column 50, Line 59; Change "L-th line is another one of" to --K-th line is one of--
Claim 31, Column 50, Lines 61 thru 62; Change "to or greater than 2, wherein the order of appearance of subframes is the same" to --to or greater than 2, wherein an order of appearance of the subframes of the pixels of L-th line is another one of the n orders of appearance of the subframes, wherein the order of appearance of subframes is the same--

Signed and Sealed this
Fourth Day of June, 2013

Teresa Stanek Rea
*Acting Director of the United States Patent and Trademark Office*